US008175501B2

(12) United States Patent
Kamiya et al.

(10) Patent No.: US 8,175,501 B2
(45) Date of Patent: May 8, 2012

(54) DEVELOPMENT ROLLER INCLUDING A DEVELOPMENT SLEEVE, SURFACE TREATMENT DEVICE THAT TREATS AN OUTER SURFACE OF THE DEVELOPMENT SLEEVE AND WIRE MEMBER THAT ROUGHENS THE OUTER SURFACE OF THE DEVELOPMENT SLEEVE

(75) Inventors: Noriyuki Kamiya, Yamato (JP); Tsuyoshi Imamura, Sagamihara (JP); Sumio Kamoi, Tokyo (JP); Kyohta Koetsuka, Fujisawa (JP); Yoshiyuki Takano, Hachioji (JP); Mieko Terashima, Zama (JP); Satoshi Terashima, Zama (JP); Hiroya Abe, Yokohama (JP); Shigeharu Nakamura, Atsugi (JP); Masaki Watanabe, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/030,451

(22) Filed: Feb. 18, 2011

(65) Prior Publication Data

US 2011/0142501 A1 Jun. 16, 2011

Related U.S. Application Data

(63) Continuation of application No. 11/519,914, filed on Sep. 13, 2006, now abandoned.

(30) Foreign Application Priority Data

Sep. 13, 2005 (JP) ..... 2005-264860
Sep. 16, 2005 (JP) ..... 2005-271137
Sep. 16, 2005 (JP) ..... 2005-271138
Sep. 16, 2005 (JP) ..... 2005-271139
Sep. 16, 2005 (JP) ..... 2005-271140
Sep. 16, 2005 (JP) ..... 2005-271141

(51) Int. Cl.
*G03G 15/09* (2006.01)

(52) U.S. Cl. ..... 399/276; 399/265; 399/277; 399/279

(58) Field of Classification Search ..... 399/265, 399/276, 277, 279
See application file for complete search history.

(56) References Cited

U.S. PATENT DOCUMENTS 3,848,363 A 11/1974 Loveness et al.
4,306,386 A 12/1981 Sakulevich et al.
4,597,661 A 7/1986 Yamashita
(Continued)

FOREIGN PATENT DOCUMENTS

EP 0 696 494 A1 2/1996
(Continued)

OTHER PUBLICATIONS

English Translation JP 2000-141225 to Tanaka.

*Primary Examiner* — Ryan Walsh
(74) *Attorney, Agent, or Firm* — Oblon, Spivak, McClelland, Maier & Neustadt, L.L.P.

(57) ABSTRACT

A development roller, including a development sleeve disposed near a photo conductive drum, a magnetic roller disposed in the development sleeve, and a supplying device configured to supply a developer including a toner and a magnetic carrier to the photo conductive drum uniformly, the development sleeve having an outer surface on which the developer including the toner and the magnetic carrier is adsorbed by a magnetic force of the magnetic roller.

9 Claims, 37 Drawing Sheets

U.S. PATENT DOCUMENTS

| | | | | |
|---|---|---|---|---|
| 5,227,849 | A * | 7/1993 | Katsumi et al. | 399/276 |
| 6,541,174 | B1 * | 4/2003 | Tanikawa et al. | 430/902 |
| 7,352,983 | B2 | 4/2008 | Kamiya et al. | |
| 2001/0023225 | A1 * | 9/2001 | Litman et al. | 399/286 |
| 2002/0067933 | A1 | 6/2002 | Shintani | |
| 2003/0152856 | A1 | 8/2003 | Mizoe et al. | |
| 2004/0096245 | A1 | 5/2004 | Kai et al. | |
| 2005/0111886 | A1 | 5/2005 | Kawano | |
| 2005/0135843 | A1 | 6/2005 | Kakegawa et al. | |

FOREIGN PATENT DOCUMENTS

| | | |
|---|---|---|
| EP | 1 041 450 A2 | 10/2000 |
| JP | 61-38862 | 2/1986 |
| JP | 2-204764 | 8/1990 |
| JP | 07064389 | 3/1995 |
| JP | 7-227755 | 8/1995 |
| JP | 8-160736 | 6/1996 |
| JP | 8-328376 | 12/1996 |
| JP | 2000-10336 | 1/2000 |
| JP | 2000-141225 | 5/2000 |
| JP | 2000-194194 | 7/2000 |
| JP | 2000-194195 | 7/2000 |
| JP | 2001-138207 | 5/2001 |
| JP | 2003-156931 | 5/2003 |
| JP | 2003-305634 | 10/2003 |
| JP | 2004-198468 | 7/2004 |
| JP | 2005-36534 | 2/2005 |

* cited by examiner

| MAGNETIC FLUX DENSITY OF ADJACENT POLE TO MAGNETIC FLUX DENSITY OF DEVELOPMENT POLE [%] | AMOUNT OF MAGNETIC CARRIER ATTACHED TO PHOTO CONDUCTIVE DRUM [PARTICLES/75cm$^2$] |
|---|---|
| 86 | 61 |
| 88 | 51 |
| 92 | 47 |
| 100 | 48 |
| 110 | 47 |
| 120 | 46 |

※50 [PARTICLES/cm$^2$] OBJECTIVE

DEVELOPMENT ROLLER INCLUDING A DEVELOPMENT SLEEVE, SURFACE TREATMENT DEVICE THAT TREATS AN OUTER SURFACE OF THE DEVELOPMENT SLEEVE AND WIRE MEMBER THAT ROUGHENS THE OUTER SURFACE OF THE DEVELOPMENT SLEEVE

CROSS-REFERENCE TO THE RELATED APPLICATIONS

The present application is a continuation of application Ser. No. 11/519,914, filed on Sep. 13, 2006, now abandoned which is based on and claims the priority benefit of each of Japanese Patent Application No. 2005-264860 filed on Sep. 13, 2005, Japanese Patent Application No. 2005-271137 filed on Sep. 16, 2005, Japanese Patent Application No. 2005-271138 filed on Sep. 16, 2005, Japanese Patent Application No. 2005-271139 filed on Sep. 16, 2005, Japanese Patent Application No. 2005-271140 filed on Sep. 16, 2005, and Japanese Patent Application No. 2005-271141 filed on Sep. 16, 2005, the contents of each of which are incorporated herein by reference.

BACKGROUND OF THE INVENTION

1. Field of the Invention

The present invention relates to a development roller used for copying machines, facsimiles, printers or the like, more specifically to a development roller which includes a development sleeve disposed adjacently to a photo conductive drum and a magnetic roller disposed in the development sleeve and in which a developer including a toner and a magnetic carrier is adsorbed to an outer surface of the development sleeve by a magnetic force of the magnet roller, a surface treatment device configured to treat the outer surface of the development sleeve, and a wire member used to roughen the outer surface of the development sleeve.

2. Description of Related Art

Various development devices as disclosed in, for example, Patent Documents 1 and 2 are used for image forming apparatuses such as copying machines, facsimiles, printers or the like. As shown in FIG. 7, the development device 100 of this kind includes a development roller 104 which is configured to feed a developer 101 including a toner and a magnetic carrier to a development area 103 facing a photo conductive drum 102 and develop a latent image formed on the photo conductive drum 102 by the developer 101 to form a toner image on the photo conductive drum.

The development roller 104 includes a development sleeve 105 which has, for example, a cylindrical shape, and a magnetic roller 106 which is disposed in the development sleeve 105 and configured to generate a magnetic field to form raised portions, or ears of the developer on a surface of the development sleeve 105. Here, the magnetic roller 106 has, for example, a cylindrical shape. The magnetic roller 106 has a plurality of magnetic poles which comprise bar-like magnets. Of the plurality of poles, development poles facing the development area 103 are configured to form the ears of the developer on the surface of the development sleeve 105 and supply the toner of the developer to the photo conductive drum 102.

When the developer 101 rises to form the ears, the magnetic carrier of the developer 101 is raised on the development sleeve 105 along magnetic lines generated by the magnetic roller 106. The toner of the developer 101 is adsorbed to the raised magnetic carrier. In addition, the development roller 104 is configured to feed the raised developer 101 to the surface of the development sleeve 105 by rotating at least one of the development sleeve 105 and the magnetic roller 105.

Generally, the above-mentioned development roller 104 is configured to rotate the development sleeve 105 in order to facilitate the feeding of the developer 101. In the development roller 104 shown in FIG. 7, the development sleeve 105 is configured to be rotatable by attaching a flange to an end of the development sleeve 105 and supporting the flange by a bearing. The development sleeve 105 is disposed close to the photo conductive drum 102 and a control member 107 to control an amount of the developer 101 fed to the photo conductive drum 102.

Moreover, the above-mentioned development sleeve 105 (in particular, see Patent Document 4) has an outer surface on which sand blast processing or roughing treatment is provided, or in which V-shaped grooves or concave grooves are provided to convey the developer to the photo conductive drum certainly.

If a rotational center of the development roller 105 deviates from an axis, wobble of rotation of the development sleeve 105 occurs. The generation of the wobble of rotation of the development sleeve causes a gap between the control member 107 and the photo conductive drum 102 to vary to generate variation in an amount of the developer 101 supplied to the photo conductive drum 102, thereby generating variation of density in a formed image. Therefore, the above-mentioned development device 100 is configured to match the rotational center of the development sleeve 105 with the axis as much as possible, maintain straightly the axis as much as possible and maintain a shape in section of the development sleeve in a constant perfect circle so that the wobble of rotation of the development sleeve does not occur to obtain a high quality image.

On the other hand, there is known a surface treatment device to roughen an outer surface of a supplying member such as a development sleeve of a development roller to convey a developer attached to the supplying member to a photo conductive drum (for reference, see Patent Documents 6 to 9). The surface treatment device is configured to contain the supplying member and abrasive grains in a containing tank, generate a rotational magnetic field to move the abrasive grains, excite the abrasive grains randomly by an electromagnetic force operating between the rotational magnetic field and the abrasive grains, and hit the abrasive grains to the supplying member to roughen the outer surface of the supplying member.

It is known that the surface treatment device of this kind has working efficiency higher than a sand blast device or shot blast device configured to hit abrasive grains to a supplying member by blowing out the abrasive grains by air pressure or water pressure.

Moreover, there has been known a development roller to convey a developer to a photo conductive drum, in which sand blast processing is provided on an outer surface of a development sleeve of the development roller to roughen the outer surface and V-shaped grooves are provided on the outer surface.

There is also proposed a so-called electro-magnetic blast which is configured to contain abrasive grains and a development sleeve in a containing tank, generate a rotational magnetic field to move the abrasive grains, excite the abrasive grains randomly by an electro-magnetic force operating between the rotational magnetic field and the abrasive grains and hit the abrasive grains to the development sleeve to roughen the outer surface of the development sleeve.

It is known that the electro-magnetic blast of this kind has working efficiency higher than a sand blast or shot blast configured to hit the abrasive grains to the development sleeve by blowing out the abrasive grains by air pressure or water pressure.

In the above-mentioned sand blast, hitting spherical glass beads to the outer surface of the development sleeve is proposed (for reference, see Patent Document 10).

Here, it is desired that the developer is adapted to be supplied from the development roller to the photo conductive drum uniformly, in the development roller, the surface treatment device, and the wire member used to provide a roughing treatment on the outer surface of the development sleeve.

(Patent Document 1): Japanese Patent Laid-Open No. 2000-194194

(Patent Document 2): Japanese Patent Laid-Open No. 2000-194195

(Patent Document 3): Japanese Patent Laid-Open No. 2004-198468

(Patent Document 4): Japanese Patent Laid-Open No. 2005-036534

(Patent Document 5): Japanese Patent Laid-Open No. 8-160736

(Patent Document 6): Japanese Patent Laid-Open No. 2003-305634

(Patent Document 7): Japanese Patent Laid-Open No. 2001-138207

(Patent Document 8): Japanese Patent No. 3486221

(Patent Document 9): Japanese Patent Laid-Open No. 61-38862

(Patent Document 10): Japanese Patent Laid-Open No. 2000-10336

However, in prior art as mentioned above, there is a first problem that not only the toner but also the magnetic carrier tend to be attached to the photo conductive drum 102 in the development area 103, although it is desired to attach only the toner of the toner and the magnetic carrier constituting the developer to the photo conductive drum. A magnetic force by the development roller 104, an electric force by the photo conductive drum 102, and a centrifugal force by the rotation of the development roller 104 are imparted to the magnetic carrier. The magnetic force is a force in a direction attracting the magnetic carrier to the development roller 104 whereas each of the electric force and the centrifugal force is a force in a direction drawing the magnetic carrier from development roller 104.

The magnetic carrier should be remain on the development roller 104 by the magnetic force, but, if a combined force of the electric force and the centrifugal force is larger than the magnetic force, the magnetic carrier is separated from the development roller 104 and attached to the photo conductive drum 102. This is a phenomenon referred to as "carrier attachment".

If the magnetic carrier is attached to the photo conductive drum 102, the magnetic carrier together with the toner is moved to a transferred member or paper, there is a problem that this results in harmful influence for a transfer device or fixing device and low reliability of the image forming apparatus. In recent years, with the aim of high image quality of the image forming apparatus, small particulate magnetic carrier or low electric potential phenomenon has been reviewed in the development process. However, such a method is also insufficient to eliminate the carrier attachment.

To solve this problem, there has been proposed a device having high magnetic characteristic of development poles of the development roller 104 and adjacent different poles disposed downstream the development poles (for reference, see Patent Document 3). However, the device does not specifically disclose a relationship of magnetic flux densities of the development poles and the adjacent different poles. Generally, the magnetic flux density of the adjacent different poles is lesser than that of the development poles. If the magnetic flux density of the adjacent different poles is lesser than that of the development poles, A drop occurs in a combined distribution of magnetic flux density combining a distribution of the magnetic flux density of the development roller 104 in a normal direction and a distribution of the magnetic flux density of the development roller 104 in a tangent direction. Consequently, there is a problem that a low magnetic force occurs in a portion of the drop of distribution of magnetic flux density and therefore flexibility of the carrier attachment lacks.

On the other hand, there is a second problem that a particulate characteristic of the magnetic carrier is changed by filling in a surface of the magnetic carrier with an addition agent or friction of the surface of the magnetic carrier. The change of the particulate characteristic of the magnetic carrier causes an amount of the developer 101 picked up by the development sleeve 105 to change easily. Accordingly, there is a tendency that it is difficult to obtain high quality image throughout a long period for secular variation of the developer 101.

In the above-mentioned development sleeve 105 which includes an outer surface having a surface roughness of 10 formed by providing cutting or grinding process on the development sleeve 105 to maintain the axis of the development sleeve linearly, maintain inner and outer diameters of the development sleeve constantly, and maintain the sectional shape of the development sleeve in a constantly sized perfect circle or eliminate the wobble of the development sleeve, thereafter, by providing sand blast on the surface of the development sleeve, because very fine concave and convex portions are formed by the sand blast, the concave and convex portions of the outer surface wear gradually for secular variation. In the development sleeve 105 on which the sand blast is provided, because the concave and convex portions of the outer surface wear gradually for secular variation, an amount of the developer 101 picked up by the development sleeve is gradually reduced, as shown in FIGS. 25 and 26. In addition, the picked amount of the developer 101 is further reduced even by secular variation of the developer 101 as mentioned above.

Therefore, the use of the development roller 105 on which the sand blast is provided tends to lower image quality such as generation of variations in an image. Consequently, it is difficult to acquire high quality image throughout a long period in the development roller 105 on which the sand blast is provided.

Here, FIG. 25 illustrates an initial state of the outer surface of the development sleeve after using, and FIG. 26 illustrates a state varying across the ages after ten papers from initiation of use are printed. In FIGS. 25A and 26A, the developer 101 is shown by black mark, in FIGS. 25B and 26B, the developer 101 is shown by parallel diagonal lines.

In the development sleeve 105 on the outer surface of which the grooves are provided, friction of the grooves by secular variation is less, but there is a case that the wobble accuracy of development sleeve such as curvature of the axis, change of the inner and outer diameters of the sleeve, and generation of elliptical shape of the sleeve is lower than that of development sleeve formed by the sand blast, by a stress given in forming the grooves. In addition, when performing the cutting or grinding on the development sleeve after forming the grooves, burr occurs on an outer edge of each of the grooves. There is a case that the burr drops when forming an image to form a defective image and block the feeding of the developer. In this way, in the development sleeve 105 on the outer surface of which the grooves are provided, it is difficult to acquire an image having uniform density by low wobble accuracy.

Furthermore, even in the development sleeve 105 on the outer surface of which the grooves are provided, an amount of the developer 101 picked up by the development sleeve 105 is gradually reduced by the above-mentioned secular variation of the developer 101 (see FIGS. 27 and 28). Therefore, it is difficult for the development sleeve having the grooves to obtain high quality image throughout a long period.

Here, FIG. 27 illustrates an initial state of the outer surface of the development sleeve after using, and FIG. 28 illustrates a state varying across the ages after ten papers from initiation of use are printed. In FIGS. 27A and 28A, the developer 101 is shown by black mark, in FIGS. 27B and 28B, the developer 101 is shown by parallel diagonal lines.

The development sleeve 105 as disclosed in the Patent Document 5 includes an outer surface provided with a plurality of projection portions at ridge lines each having a polygonal shape and fine concave and convex portions provided on portions other than the projection portions, and a conductive resinous coating and a metallic treatment layer are provided on the outer surface to accomplish high accuracy and high durability. However, in the development sleeve 105 as disclosed in the Patent Document 5, when it is used continuously, there is a problem that the toner is adhered to the fine concave and convex portions to lower development ability or the like (for example, reduction of an amount of the developer 101 supplied to the photo conductive drum 102). In other words, it is difficult to acquire high image quality throughout a long period. In addition, as mentioned above, a troublesome process is required for forming the plurality of polygonal projection portions and the fine concave and convex portions other than the projection portions, thereby a cost for the process tends to increase.

Next, there is a third problem that the concave and convex portions formed by the sand blast process gradually wear to flatten by the developer or the like with increment of the number of printed papers or secular variation because the concave and convex portions formed on the outer surface of the development sleeve on which the above-mentioned sand blast process is provided are very fine. Consequently, in the development sleeve on which the above-mentioned sand blast process is provided, a conveyed amount of the developer is gradually reduced, and hence gradually thin images are formed.

Moreover, in the development sleeve as the supplying member having the outer surface provided with the V-shaped grooves, concavity and convexity of the V-shaped grooves are significantly larger than that of the concave and convex portions. In other words, because the V-shaped grooves formed on the outer surface of the development sleeve are very larger or deeper than the magnetic carrier in fineness, in the development sleeve having the V-shaped grooves, it is difficult to wear the V-shaped grooves, and hence the conveyed amount of the developer is not reduced as varying across the ages. However, in the development sleeve on the outer surface of which the V-shaped grooves are provided, because the developer conveyed by the V-shaped grooves is more than that conveyed by portions where the V-shaped grooves are not provided, variations of density of image are easy to occur in the formed image by the variations of the conveyed amount of the developer.

There is a fourth problem that a picked amount of the developer by the opposite ends of the development sleeve in the longitudinal direction is lesser than that of the developer by the central portion of the development sleeve in the longitudinal direction as known, when the outer surface of the development sleeve is formed in a uniform surface-roughness. In this case, if a desired image is printed on a recording paper, a thinner image than an image on a central portion of the paper is formed on the ends of the paper. In this way, there is a problem that variations occur in the image on the recording paper when the outer surface the development sleeve is formed in the uniform surface-roughness.

Furthermore, in the sand blast process using the glass beads, because the abrasive particles are larger than that used for a usual sand blast, the bending or distortion easily occurs in the development sleeve. In addition, in the sand blast process using the glass beads, because spherical glass beads are blown to the development sleeve, it is easy to generate periodicity in concave and convex portions of the outer surface of the development sleeve. Therefore, in the development sleeve on which the sand blast process using the glass beads is provided, the concave and convex portions formed on the outer surface are difficult to wear and the conveyed amount of the developer is not reduced by the secular variation. However, the variations in the density of the formed image easily occur by the periodicity generated in the concave and convex portions.

SUMMARY OF THE INVENTION

A first object of the present invention is to provide a development roller capable of supplying a developer to a photo conductive drum uniformly.

A second object of the present invention is to provide a surface treatment device capable of providing a roughing treatment on an outer surface of a development sleeve to prevent variation in image from occurring on a photo conductive drum.

A third object of the present invention is to provide a wire member configured to provide a roughing treatment on an outer surface of a development sleeve to prevent variation in image from occurring on a photo conductive drum.

To accomplish the above-mentioned first object, a development roller according to one embodiment of the present invention includes a development sleeve disposed near a photo conductive drum, a magnetic roller disposed in the development sleeve, and a supplying device configured to supply a developer including a toner and a magnetic carrier to the photo conductive drum uniformly.

The development sleeve has an outer surface on which the developer including the toner and the magnetic carrier is adsorbed by a magnetic force of the magnetic roller.

To accomplish the above-mentioned second object, a surface treatment device according to one embodiment of the present invention is configured to surface-treat a supplying member to supply a developer from the supplying member to a supplied member uniformly. The surface treatment device includes a containing tank configured to contain the supplying member and magnetic abrasive grains, a magnetic field-generation section configured to generate a rotational magnetic field to move the magnetic abrasive grains in the containing tank and hit the magnetic abrasive grains on the supplying member by the rotational magnetic field, and a control device configured to control the magnetic abrasive grains.

To accomplish the above-mentioned third object, a wire member according to one embodiment of the present invention comprises a circular post-like short wire made of a magnetic material and configured to be randomly hit on an outer surface of a development sleeve which has a magnetic roller disposed therein and is configured to adsorb a developer to the outer surface by a magnetic force of the magnetic roller to provide a roughing treatment on the outer surface.

An outer diameter of the circular post-like wire member is within a range of 0.5 mm to 1.2 mm.

DETAILED DESCRIPTION OF THE PREFERRED EMBODIMENTS

Preferred embodiments of the present invention will be explained in detail with reference to the accompanying drawings below.

Figure 1:
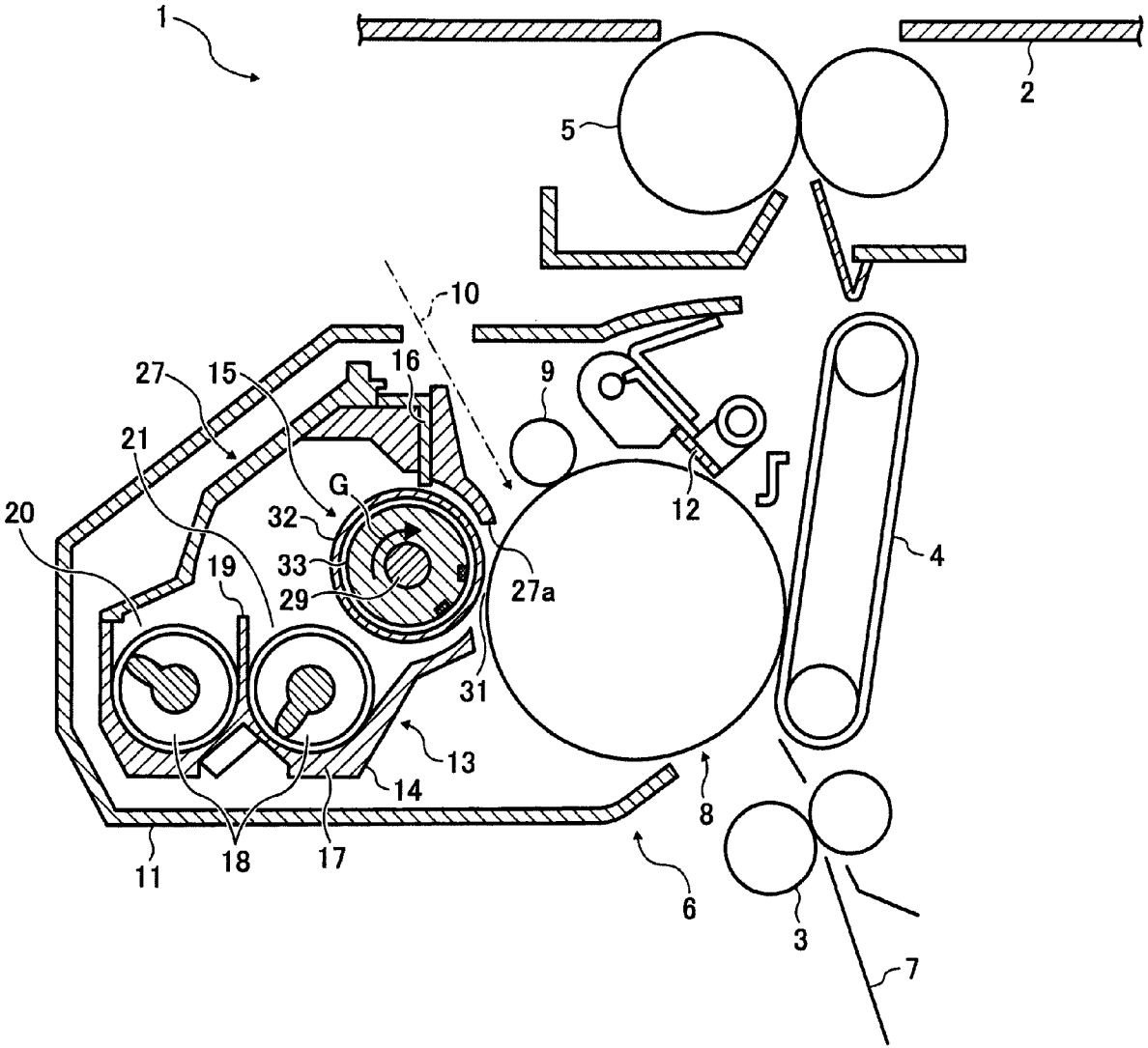
FIG. 1 is a sectional view showing a main part of an image forming apparatus according to one embodiment of the present invention.
Figure 2:
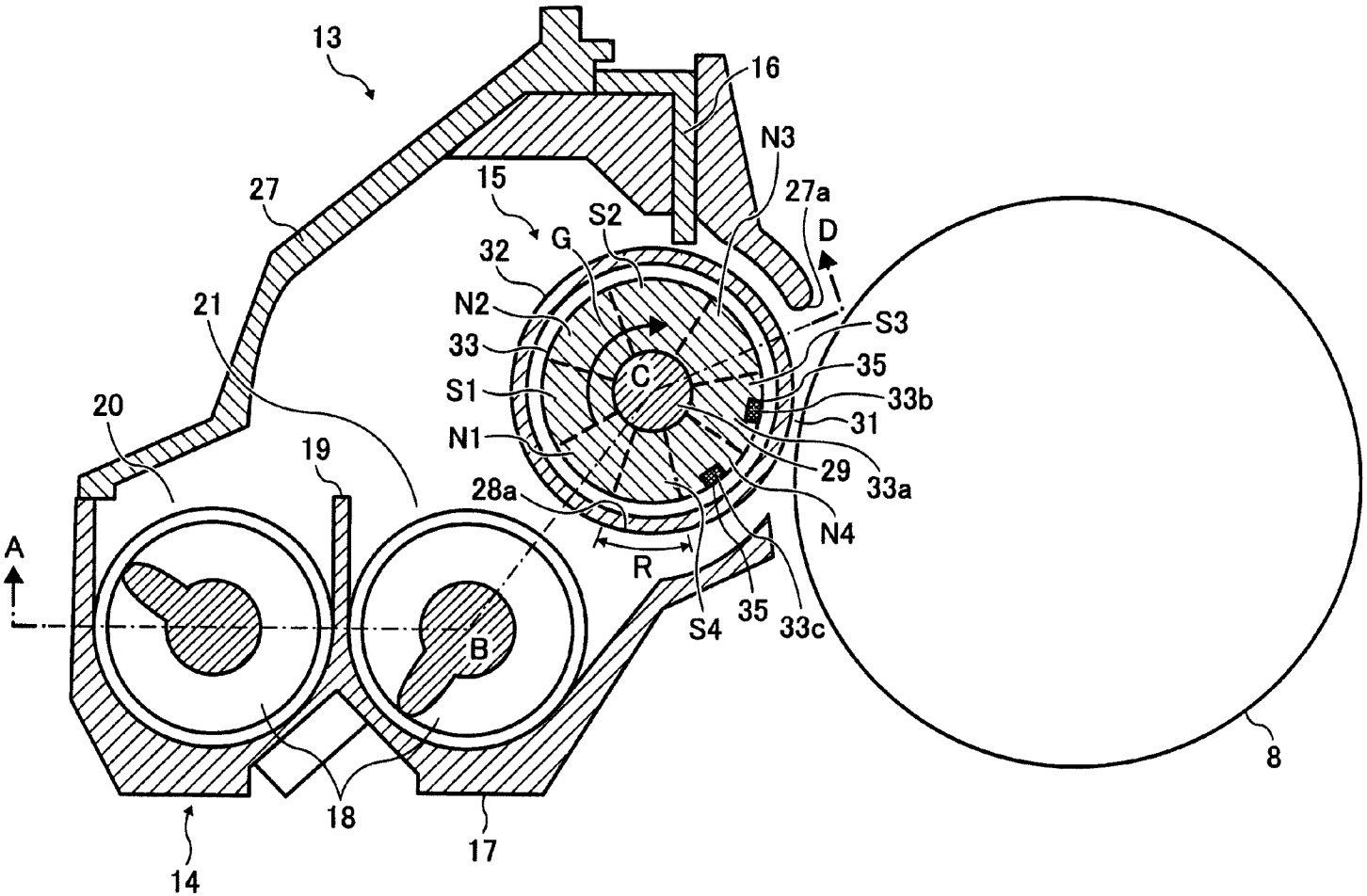
FIG. 2 is a sectional view showing one embodiment of a development device used in the image forming apparatus as shown in FIG. 1.
Figure 3:
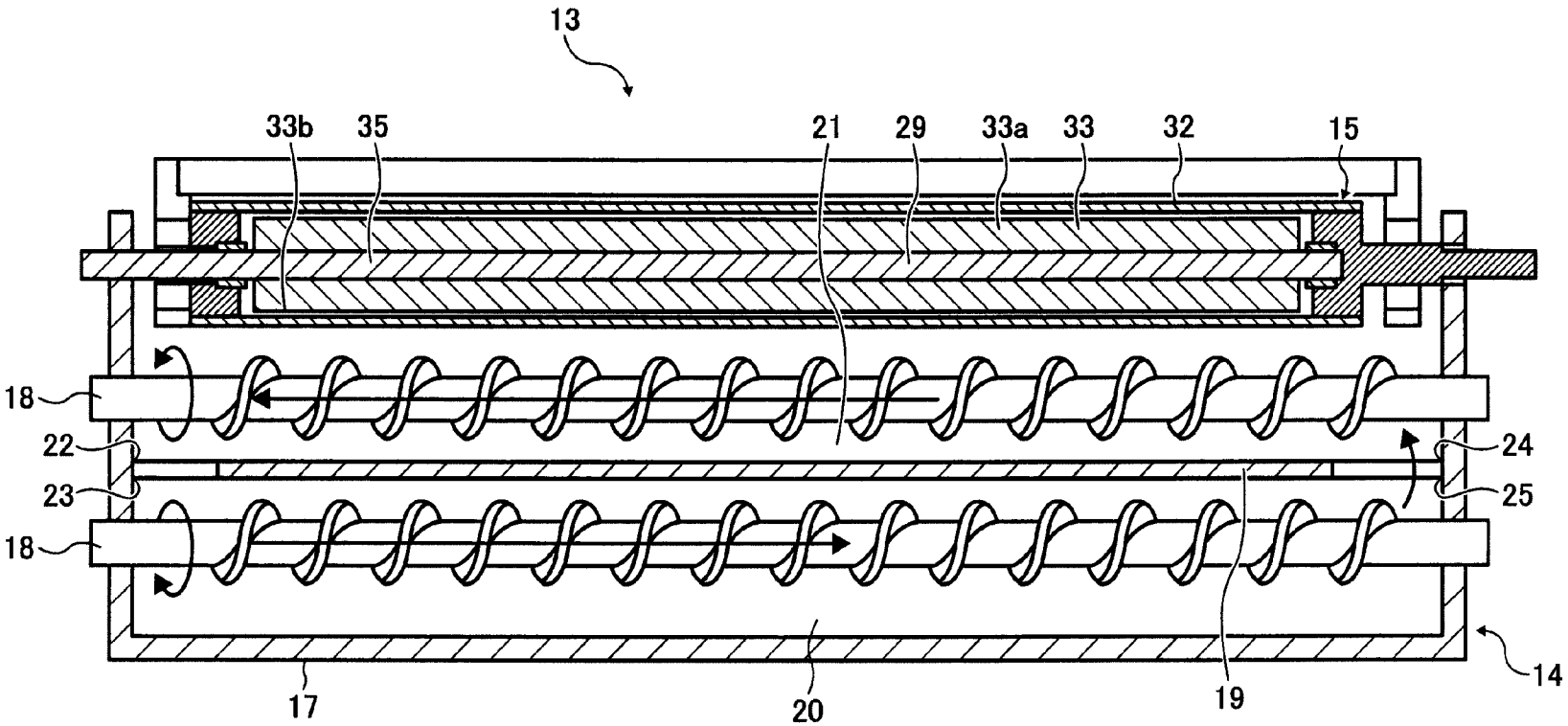
FIG. 3 is a sectional view taken along line A-B-C-D in FIG. 2.
Figure 4:
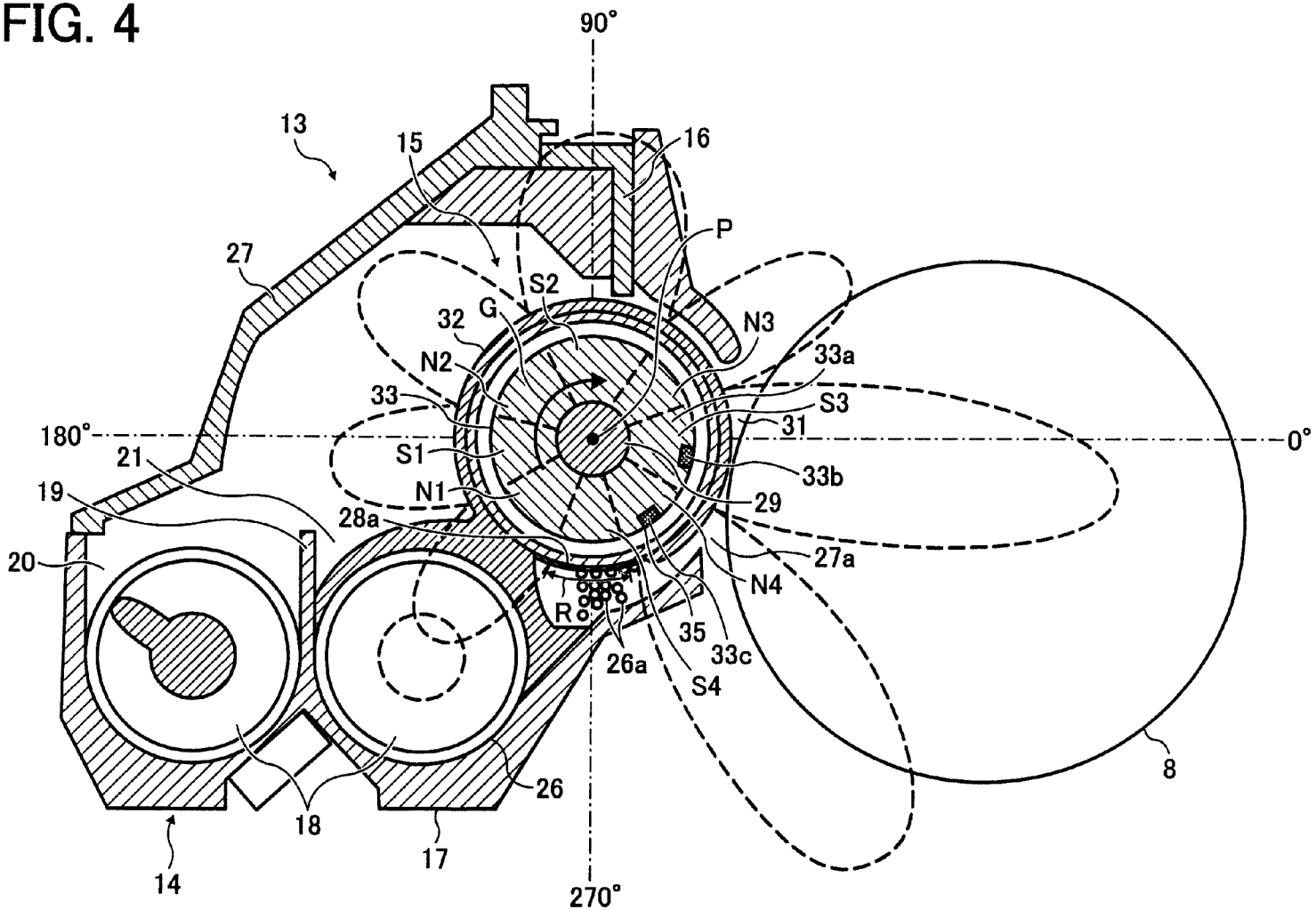
FIG. 4 is an explanatory view showing an operation state of the development device shown in FIG. 2.

A first embodiment of the present invention is described with reference to FIGS. 1 to 4 as follows. FIG. 1 is a sectional view showing a main part of an image forming apparatus according to the first embodiment of the present invention. FIG. 2 is a sectional view showing a development device of the image forming apparatus shown in FIG. 1 according to the first embodiment of the present invention. FIG. 3 is a sectional view as viewed along line A-B-C-D of FIG. 2. FIG. 4 is an explanatory view showing an operating state of the development device shown in FIG. 2

The image forming apparatus 1 includes at least a main body 2 (only a part is shown in FIG. 1), a paper supplying roller 3, a transfer member 4, a fixing device 5, a laser writing device (not shown) and a process cartridge 6 as shown in FIG. 1.

The main body 2 is for example formed in a box shape and mounted on a floor. The main body 2 contains the paper supplying roller 3, the transfer member 4, the fixing device 5, the laser writing device, and the process cartridge 6. The paper supplying roller 3 sends a recording paper 7 as a transferred material to between the transfer member 4 and a photo conductive drum 8 mentioned below.

The transfer member 4 is a circulating belt and reciprocates in a tangential direction of the photo conductive drum 8 mentioned below. The transfer member 4 compresses the recording paper 7 which is sent from the paper supplying roller 3 onto an outer surface of the photo conductive drum 8 to transfer a toner image which is formed on the photo conductive drum 8 to the recording paper 7. The transfer member 4 sends the recording paper 7 to which the toner image is transferred, toward the fixing device 5. The fixing device 5 fixes the toner image, which is transferred from the photo conductive drum 8 on the recording paper 7, to the recording paper 7 by compressing and heating the recording paper 7 which is sent from the transfer member 4. The laser writing device irradiates the outer surface of the photo conductive drum 8, which is charged uniformly by a charged roller 9 mentioned below, with a laser 10 to form an electrostatic latent image.

The process cartridge 6 is detachably disposed to the main body 2. The process cartridge 6 includes at least a cartridge case 11, the charged roller 9 as a charging device, the photo conductive drum 8 as a photo conductor (also, referred to as an image supporting body), a cleaning blade 12 as a cleaning device, and a development device 13. Thereby, the image forming apparatus 1 includes at least the charged roller 9, the photo conductive drum 8, the cleaning blade 12, and the development device 13.

The cartridge case 11 is detachably disposed on the main body 2 and contains the charged roller 9, the photo conductive drum 8, the cleaning blade 12, and the development device 13. The charged roller 9 charges uniformly the outer surface of the photo conductive drum 8. The photo conductive drum 8 is disposed with an interval from a development roller 15 mentioned below of the development device 13. The photo conductive drum 8 is formed in a cylindrical or tube-like shape to be capable of rotating about an axis. On the outer surface of the photo conductive drum 8, the electrostatic latent image is developed by the laser writing device. On the outer surface of the photo conductive drum 8, the toner image is developed by attaching a toner on the electrostatic latent image which is formed and supported on the outer surface of the photo conductive drum 8 to be transferred to the recording paper 7 positioned between the transfer member 4 and the photo conductive drum 8. The cleaning blade 12 removes a toner remained on the outer surface of the photo conductive drum after the toner image is transferred onto the recording paper 7.

The development device 13 includes at least a developer supplying portion 14, a case 27, the development roller 15 as a developer supporting body, and a control blade 16 as a control member as shown in FIGS. 1 to 3.

The developer supplying portion 14 includes a containing tank 17 and a pair of agitating screws 18 as an agitating member. The containing tank 17 is formed in a box shape which has the generally same length as the photo conductive drum 8. Provided in the containing tank 17 is a partition wall 19 extending in a longitudinal direction of the containing tank 17. The partition wall 19 partitions the containing tank 17 into a first space 20 and a second space 21. The first space 20 and the second space 21 have ends 22, 23, 24, and 25 which are communicated with each other.

The developer 26 (see FIG. 4) is contained in both of the first space 20 and the second space 21 of the containing tank 17. The developer 26 includes the toner and a magnetic carrier (also referred to as a magnetic powder). The toner is optionally provided to the end 23 of the first space 20 of the first space 20 and the second space 21 which is away from the development roller 15. A toner particle is formed in a spherical particle prepared by an emulsion polymerization method or a suspension polymerization method. In addition, the toner may be prepared by crushing a mass of plastics obtained by mixing and dispersing various types of dye and colorant. An average diameter of the toner particles is within a range of 3 μm to 7 μm. The magnetic carrier comprises particles and is contained in both of the first space 20 and the second space 21. The particle diameter of the magnetic carrier is within a range of 20 μm to 50 μm.

The agitating screws 18 are contained in the first space 20 and the second space 21, respectively. Longitudinal directions of the agitating screws 18 are in parallel to longitudinal directions of the containing tank 17, the development roller 15 and the photo conductive drum 8. The agitating screws 18 are disposed to be capable of rotating about axes to agitate the toner and magnetic carrier as well as to convey the developer 26 along the axes.

In the illustrated embodiment, the agitating screw 18 in the first space 20 conveys the developer 26 from the end 23 to another end 25. The agitating screw 18 in the second space 21 conveys the developer 26 from the other end 24 to an end 22.

According to the above-mentioned structure, the developer supplying portion 14 conveys the toner provided to the end 23 of the first space 20 to the other end 25 while agitating with the magnetic carrier, and then conveys from the other end 25 to the other end 25 of the second space 21. The developer supplying portion 14 agitates the toner and the magnetic carrier in the second space 21, and then, provides them on an outer surface of the development roller 15 while conveying in an axial direction thereof.

The case 27 is formed in a box shape and mounted on the containing tank 17 of the above-mentioned developer supplying portion 14 to cover the development roller 15 as well as the containing tank 17 and so on. Furthermore, an opening 27*a* is provided on an opposing part from the photo conductive drum 8 of the case 27.

The development roller 15 is formed in a cylindrical shape and provided between the second space 21 and the photo conductive drum 8 and provided near the above-mentioned opening 27*a*. The development roller 15 is in parallel to both of the photo conductive drum 8 and the containing tank 17. The development roller 15 is disposed with the interval from the photo conductive drum 8. A space between the development roller 15 and the photo conductive drum 8 makes a development area 31 to attach the toner of the developer 26 on the photo conductive drum 8 thereby developing the electrostatic latent image and obtaining and obtaining the toner image.

In the development area 31, the development roller 15 is disposed to face the photo conductive drum 8.

The development roller 15 includes a cored bar 29, a tube-like magnet roller (also, referred to as a magnet body) 33 and a tube-like development sleeve 32 as a nonmagnetic tube-like body as shown in FIGS. 2 and 3. The cored bar 29 is disposed as a longitudinal direction thereof is in parallel to the longitudinal direction of the photo conductive drum 8, and fixed on the above-mentioned case 27 without rotating.

The magnet roller 33 includes a roller body 33*a* which is formed in a tube-like shape and on which mentioned-below magnetic pole setting grooves 35 are formed, and magnetic blocks 33*b*, 33*c* which are mounted on the roller body 33*a*. The roller body 33*a* is fixed on an outer periphery of the cored bar 29 without rotating about an axis. Two magnetic pole setting grooves 35 are mounted on the roller body 33*a*. The magnetic pole setting grooves 35 are formed in a concave shape from an outer surface of the roller body 33*a* and extend linearly in an axial direction of the roller body 33*a*, that is to say, in a longitudinal direction of the magnet roller 33.

The magnetic blocks 33*b*, 33*c* are magnets formed in a long and stick-like shape, and are inserted in the above-mentioned magnetic pole setting grooves 35 to be mounted on the roller body 33*a*. Therefore, the magnetic blocks 33*b*, 33*c* are lengthened in the longitudinal direction of the magnet roller 33, that is to say, of the development roller 15, and provided over an entire length of the magnet roller 33. The magnet roller 33 having the structure mentioned above is contained in the development sleeve 32.

The roller body 33*a*, that is to say, the magnet roller 33 has eight magnetic poles N1, S1, N2, S2, N3, S3, N4, and S4 which are magnetized. The pole N1 is a picking-up developer pole and opposing from the above-mentioned agitating screw 18. The magnetic pole N1 has an N polar character and generates a magnetic force on the outer surface of the development sleeve 32, that is to say, on the outer surface of the development roller 15 to attract the developer on the outer surface of the development sleeve 32 disposed in the second space 21 of the containing tank 17.

The magnetic pole S3 is a development pole and opposing from the above-mentioned photo conductive drum 8. The magnetic pole S3 has an S polar character and generates the magnetic force on the outer surface of the development sleeve 32, that is to say, the development roller 15 to form a magnetic field between the development sleeve 32 and the photo conductive drum 8. The magnetic pole S3 forms a magnetic brush by the magnetic field to send the toner of the developer 26 sucked onto the outer surface of the development sleeve 32 to the photo conductive drum 8.

The plurality of magnetic poles S1, N2, S2, and N3, which are provided between the above-mentioned magnetic poles N1 and S3 and provided upstream of a mentioned-below arrow G above the magnetic pole S3, are magnetic poles conveying the preceding developer 26. These magnetic poles S1, N2, S2, and N3 have an S polar character, an N polar character, an S polar character, and an N polar character, respectively, in order from the magnetic pole N1 above a picking up developer pole and generate the magnetic force on the outer surface of the development sleeve 32, that is to say, of the development roller 15 to convey the preceding developer to the photo conductive drum 8. Furthermore, one of the magnetic poles S2 is disposed in a position facing the control blade 16. The one of the magnetic poles S2 keeps a thickness of the developer 26 on the outer surface of the development sleeve 32 a predetermined thickness in corporation with the control blade 16.

The mentioned-above magnetic pole N4, which is provided between the above-mentioned magnetic poles N1 and S3 and provided downstream of the allow G below the magnetic pole S3, is a conveying magnetic pole conveying a developed developer 26 (hereinafter, shown by 26*a*). This magnetic pole N4 has an N polar character and generates a repulsive magnetic field between the magnetic pole N1 as the picking up developer pole and the magnetic pole N4 to form a developer removing region R on the outer surface of the development sleeve 32, that is to say, of the development roller 15 to remove the developed developer 26 from the development sleeve 32 toward the containing tank 17. Therefore, the magnetic pole N4 is situated near the magnetic pole N1 as the picking up developer pole and forms the developer removing region R (=the magnetic pole S4) in corporation with the magnetic pole N1. The developer removing region R is provided on the outer surface of the development sleeve 32 in a region from the magnetic pole S3 as the development pole to the magnetic pole N1 as the picking up developer pole.

The developer removing region R is a region where a weak magnetic force, for example about 5 mT (milli-tesla) of a magnetic flux density is generated, and where the developed developer 26*a* which is attached to the outer surface of the development sleeve 32 is removed from the outer surface of the development sleeve 32 by its own weight, and so on. As mentioned above, in this description, a region where the weak force generates and the developed developer 26*a* is removed from the outer surface of the development sleeve 32 by its own weight and so on, is called the developer removing region R. Additionally, in the developer removing region R, the magnetic force in a normal direction of at least a part of the outer surface of the development sleeve 32 is selected in a direction to remove the developed developer 26*a* from the outer surface of the development sleeve 32. The above-mentioned magnetic pole N4 is an unlike pole of the development pole described in this description and forms an adjacent pole provided downstream and near the development pole. Moreover, dashed lines shown in FIG. 4 show a distribution of the magnetic force which is formed by these magnetic poles N1, S1, N2, S2, N3, S3, N4, and S4 in the normal direction.

The development sleeve 32 is comprised of non-magnetic body (material), formed in a tube-like shape, and provided to be capable of rotating about the axis. The development sleeve 32 includes (contains) the magnet roller 33, and rotates along the clockwise allow G in FIG. 2 so that an inner surface of the development sleeve 32 is opposing to the magnetic poles in order of N1, S1, N2, S2, N3, S3, N4 and S4. The development sleeve 32 includes aluminum, stainless steel (SUS), and so on. Aluminum has advantageous effects such as its workability and its lightness. In case that aluminum is used, A6063, A5056 and A3003 are preferable to use. In case that SUS is used, SUS303, SUS304, and SUS316 are preferable to use.

Furthermore, a plurality of grooves are formed lengthening along the axis of the development sleeve 32, that is to say, of the development roller 15 on the outer surface of the development sleeve 32. In addition, a well-known blast treatment may be performed to form micro concave and convex portions on the outer surface of the development sleeves 32.

The control blade 16 is provided on an end of the development device 13 which is disposed close to the photo conductive drum 8. The control blade 16 is mounted on the above-mentioned case 27 with an interval from the outer surface of the development sleeve 32. The control blade 16 scrapes the developer 26 on the outer surface of the development sleeve 32, which has the thickness over a desirable value, into the containing tank 17 to set the developer 26 on the outer surface of the development sleeve 32, which is conveyed to the development area 31, in the desirable thickness.

The above-mentioned magnet roller 33 is described as follows. In this embodiment, the magnetic flux density of the magnetic pole N4 as the adjacent pole which is the unlike pole of the magnetic pole S3 as the development pole of the above-mentioned magnet roller 33 and provided downstream near the allow G, is at least 90% or more. In particular, when the magnetic flux density of the magnetic pole S3 (the development pole) is 100 mT (milli-tesla), the magnetic flux density of the magnetic pole N4 is at least 90 mT or more.

Figure 5:
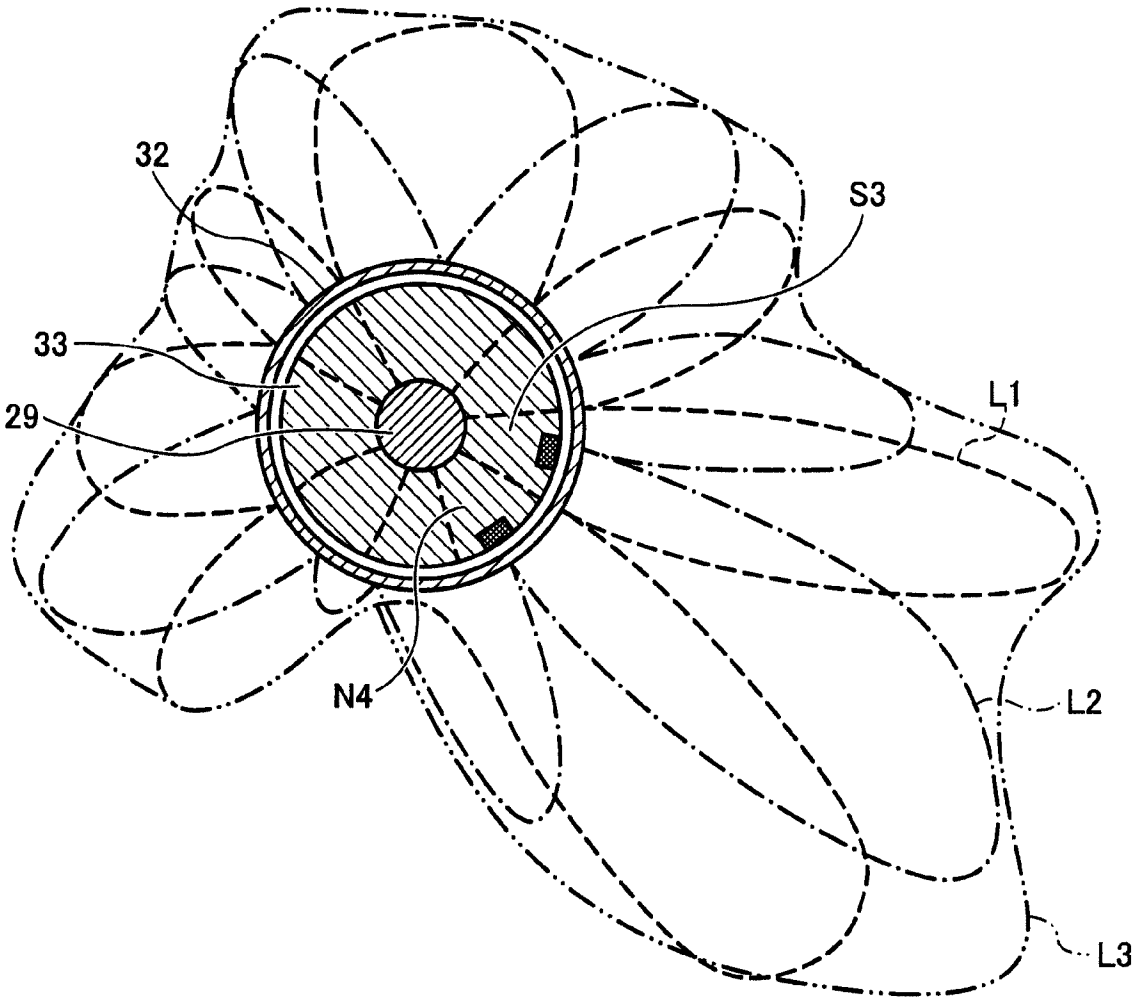
FIG. 5 is a view showing a distribution of a magnetic flux density of a development roller in the development device as shown in FIG. 2.

A distribution of the magnetic flux density of the development roller 15, at this time, is shown in FIG. 5. In FIG. 5, dotted lines L1 show a distribution of the magnetic flux density in a normal direction to the development roller 15. Dashed-dotted lines L2 show a distribution of the magnetic flux density in a tangential direction to the development roller 15. Dashed-double-dotted lines L3 show a distribution of a conflated magnetic flux density formed by conflating the distribution of the magnetic flux density in the normal direction with that in the tangential direction. As shown in FIG. 5, a peak of the magnetic flux density in the tangential direction formed between the magnetic pole S3 (development pole)—the magnetic pole N4 (adjacent pole) is positioned in almost middle position between a peak of the distribution of the magnetic flux density of the magnetic pole S3 (development pole) in the normal direction and a peak of the distribution of the magnetic flux density of the magnetic pole N4 (adjacent pole) in the normal direction, that is to say, between the magnetic pole S3 and N4. Thereby, declined parts of the conflated density distribution formed by conflating the distribution of the magnetic flux density in the normal direction between the magnetic pole S3 (development pole) and N4 (adjacent pole) with that in the tangential direction are reduced to eliminate a low magnetic force region. Therefore the development roller 15 which has a high margin of a carrier attachment can be obtained.

Therefore, the magnetic flux density of the adjacent pole in the magnet roller 33 of the embodiment is higher than that in conventional magnet roller, so that the decline of the conflated density distribution between the magnetic pole S3 (development pole) and the pole (adjacent pole) is reduced more effectively than prior art to eliminate the low magnetic force region.

Figures 6A, 6B:
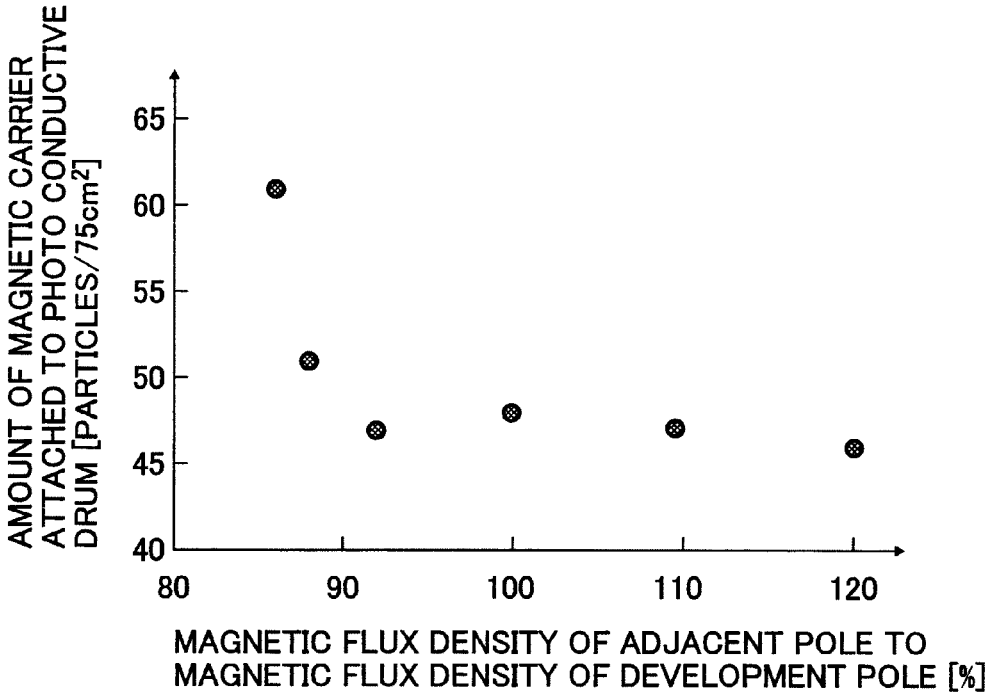
FIG. 6A is a graph showing an adhered number (particles/75 cm2) of a magnetic carrier to a photo conductive drum when changing a ratio of a magnetic flux density of an adjacent different magnetic pole to a magnetic flux density of a development pole.
FIG. 6B is a table showing the adhered number (particles/75 cm2) of the magnetic carrier to the photo conductive drum when changing the ratio of the magnetic flux density of the adjacent different magnetic pole to the magnetic flux density of the development pole.
Figure 7:
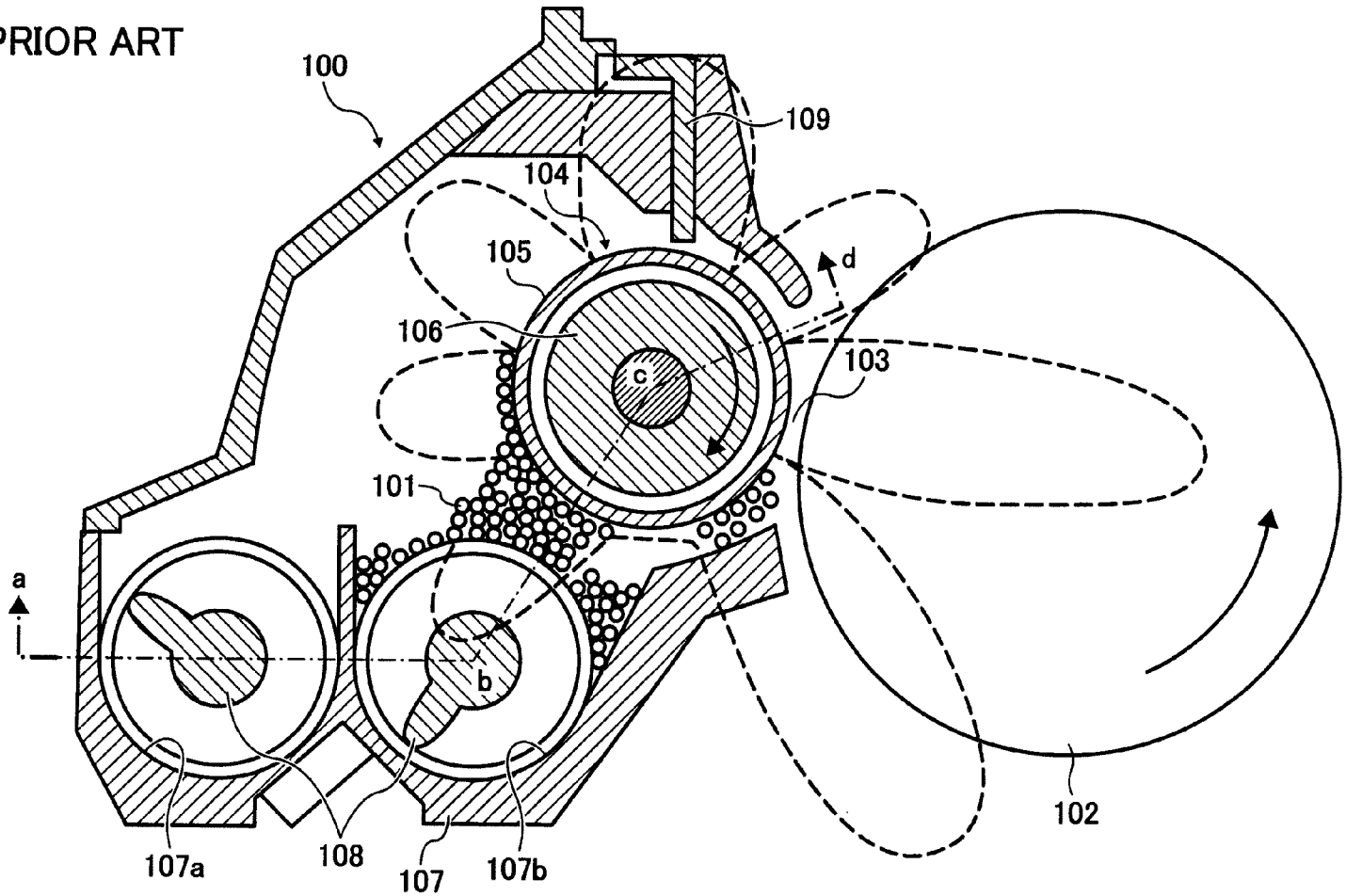
FIG. 7 PRIOR ART
FIG. 7 is a sectional view showing a main part of a development device having a conventional development roller.

Furthermore, the inventors of the present invention measured experimentally attachment numbers (particles/75 cm2) of magnetic carrier particles on the photo conductive drum 8 according to a ratio of the magnetic flux density of the magnetic pole N4 (adjacent pole) to that of the magnetic pole S3 (development pole) for the above-mentioned invention's product. A result is shown in FIG. 6. In FIG. 6A, a horizontal axis indicates the ratio (%) of the magnetic flux density of the magnetic pole N4 (adjacent pole) to that of the magnetic pole S3 (development pole), and a vertical axis indicates the attachment numbers (particles/75 cm2) of the magnetic carrier on the photo conductive drum 8.

As shown in this figure, when the ratio of the magnetic flux density of the magnetic pole N4 (the adjacent pole) to that of the magnetic pole S3 (the development pole) is 86%, the attachment number (particles/75 cm2) is 61 (particles), when the ratio is 88%, the attachment number (particles/75 cm2) is 51 (particles), when the ratio is 92%, the attachment number (particles/75 cm2) is 47 (particles), when the ratio is 100%, the attachment number (particles/75 cm2) is 48 (particles), when the ratio is 110%, the attachment number (particles/75 cm2) is 47 (particles), and when the ratio is 120%, the attachment number (particles/75 cm2) is 46 (particles). According to the experimental result, it is found that the more ratio of the magnetic flux density of the magnetic pole N4 (adjacent pole) to that of the magnetic pole S3 (development pole) increases, the more attachment number of the magnetic carrier particles on the photo conductive drum 8 decreases. Moreover, it is found that at least 90% or more of the ratio of the magnetic flux density of the magnetic pole N4 (adjacent pole) to that of the magnetic pole S3 (development pole) causes the attachment number (particles/75 cm2) of the magnetic carrier on the photo conductive drum 8 to be reduced to less than 50 (particles). If the attachment number (particles/75 cm2) can be reduced to less than 50, the attachment of the magnetic carrier particles to the photo conductive drum doesn't result in harmful influence for a transfer device or fixing device because the magnetic carrier can be transferred together with the toner on a transferred body or a paper.

Moreover, as mentioned-above, the magnet roller 33 comprises the roller body 33*a* on which the magnetic pole setting grooves 35 are formed at parts corresponding to the magnetic pole S3 (development pole) and the magnetic pole N4 (adjacent pole), and the magnetic blocks 33*b*, 33*c* which are inserted in the magnetic pole setting grooves 35 as the development pole or the adjacent pole.

The above-mentioned roller body 33*a* is formed by a magnet which is obtained by using paste-like molding material fusing magnetic powder to the polymer material as a binder (for example, a plastic magnet or a gum magnet). Moreover, the magnetic blocks 33*b*, 33*c* are comprised of a high magnetic force magnet having a higher magnet force than the roller body 33*a*. The high magnetic force magnet may be comprised of magnets for example, which has higher content of the magnetic powder than the magnet of the roller body 33*a*, to have the higher magnetic force than the roller body 33*a*.

A sintered magnet is well-known as a magnet used for the mentioned magnet roller 33 in old times. On the other hand, nowadays, the magnet which is comprised of the molding materials fusing the magnetic powder to the polymer material predominates because any form can be obtained relatively easily. The mentioned magnet comprised of the polymer material and the magnet powder can have higher magnetic properties as the content of the magnetic powders of the molding material increases. For example, as the content of the magnetic powders increases 1 weight (hereinafter, referred to as wt) %, the peak magnetic flux density rises by 2-3 mT. However, if the content of the magnetic powder increases, a viscosity of the molding material becomes higher and the molding properties becomes worse, so that the magnetic properties don't progress even though the content of the magnetic powder increases more than a certain value. Due to these problems, the magnet comprised of the polymer material and the magnetic powder cannot easily have the high magnetic properties compared to the sintered magnet. As seen in the examples, the higher magnetic force the magnet has, the molding properties becomes lower.

Moreover, in this embodiment, the mentioned magnet comprised of the polymer material and the magnetic powder is molded in the magnetic field by using anisotropic magnetic powder, and the magnetic powder is oriented in a direction of an axis to be magnetized easily the magnetic powder. It is expected that the oriented magnetic powder allow the peak magnetic flux density to rise by 70% compared to the non-oriented magnetic powder. In this way, as methods of molding in the magnetic field, an injection molding and an extrusion molding are cited.

In a case of the mentioned injection molding, molten material is sent into a die, the magnetic powder is oriented by applying the magnetic field, held in the die until the viscosity of the molten material becomes in a value where the orientation of the magnetic powder can be held, and then cooled so that the magnetic powder can be oriented easily and the magnetic properties which the material has can be utilized. However, in the case of a long wire member used in the magnet roller 33, the orientation is liable to vary according to a distance from a gate, and a deviation of the magnetic property in a longitudinal direction is liable to be large.

On the other hand, in a case of the extrusion molding, the magnetic powder is liable to be oriented in the region where the magnetic field is applied as long as a viscosity of the molding material is lower than a certain level, and the oriented magnetic powder is liable to be disordered because the molding material is in a direction perpendicular to an oriented direction of the magnetic powder. Therefore, generally the extrusion molding cannot obtain the higher magnetic property than the injection molding. However, even in a case of long wire member such as the magnet roller 33, a deviation of the magnetic property in a longitudinal direction is small. Moreover, a continuous integral-type molding can provide simplification of a process, and a short processing time. In this embodiment, the extrusion molding is adopted due to advantages such as a simple and small die structure compared to the injection molding and its cost performance.

Generally, the peak magnet flux density of the magnetic pole for the development roller of the developer including the toner and the magnetic carrier is required to be within a range of 40 mT to 90 mT. A number of magnetic poles of the magnet roller 33 is required to be for example at least 8 or more to hold the toner and the magnetic carrier of the developer in a good dispersion state. In order to accomplish having at least 8 magnetic poles or more of the magnet roller 33 and keeping the magnetic property of each poles within a range of 40 mT to 90 mT, it is required to orient previously each of at least 8 or more poles while the extrusion molding. Eight or more the magnetic fields must be applied in the die while molding to orient the magnetic carrier in 8 or more poles. Even though the magnetic poles are generated by a method using an electromagnet or a permanent magnet, anyway, it is difficult to raise a degree of the orientation to generate at least 8 or more the magnetic fields, and thereby, there is a problem that the high peak magnetic flux density can not obtained.

Of the magnetic poles, for the development pole and the adjacent pole, the high peak magnetic flux density is required. A high development ability cannot be obtained when the peak magnetic flux density of the development pole is low. Moreover, the margin of the carrier attachment decreases when the peak magnetic flux density of the pole abutted downstream of the development pole is low. In this embodiment, in order to prevent these problems, the magnetic blocks 33*b*, 33*c* which are comprised of a high magnetic force magnet having a higher magnetic force than the magnet which comprises the roller body 33*a* are inserted on parts corresponding to the development pole and the adjacent pole. Thereby, a high peak magnetic flux density of the development pole and the adjacent pole can be accomplished.

Therefore, the mentioned roller body 33*a* is in a tube-like shape and has a complicated structure where the magnetic pole setting grooves 35 are provided, but is not required to have the high magnetic property compared to the development pole and the adjacent pole. In this embodiment, the roller body 33*a* is formed by the magnet which is comprised of the magnetic powder and the polymer material, and has a high molding property but the low magnetic property. On the other hand, the magnetic blocks 33*b*, 33*c* inserted in the magnetic pole setting grooves 35 are in a simple shape such as a stick-like shape, but required to have the high magnetic property to work as the development pole and the adjacent pole. In this embodiment, these magnetic blocks 33*b*, 33*c* are formed by the high magnetic force magnet which has the high magnetic force and the low molding property compared to the magnet forming the roller body 33*a*. Therefore, the development roller 15 which has the high margin of the carrier attachment can be obtained while simply ensuring the molding property and raising the magnetic force of the development pole and the adjacent pole. Moreover the roller body 33*a* can include multi-poles such as 8 or more poles to have the high magnetic force because the magnetic powder comprised of the magnet is oriented.

Furthermore, the magnetic pole setting grooves 35 need to be formed on the roller body 33*a* so that the magnetic blocks 33*b*, 33*c* are disposed. It is difficult to form walls between the magnetic pole setting grooves 35 because the poles where the magnetic pole setting grooves 35 is disposed are abutted. If the walls between the magnetic pole setting grooves 35 is removed, the magnetic force between the magnetic poles declines and the margin of the carrier attachment decreases. The polymer material which comprises the molding material of the roller body 33*a* is required to have a sufficient flexibility in vicinity of a melting point even if the content of the magnetic powder becomes high, and a thermoplastic elastomer of olefin series is preferably used. As the thermoplastic elastomer of olefin series, there are an ethylene-vinyl acetate copolymer, an ethylene-acrylate copolymer, and so on. More preferably, by using the more flexible polymer, for example, the ethylene-acrylate copolymer, the molding property can be ensured if the content of the magnetic powder is 92 wt % or more, and the parts of the walls between the magnetic pole setting grooves 35 can be oriented to eliminate the decline of the conflated density distribution formed by conflating the distribution of magnetic flux density in the normal direction and that in tangential direction.

However, if the ethylene-acrylate copolymer is used as the polymer material, the molding property cannot be ensured in the region where the content of the magnetic powder is 94 wt % or more. Therefore, in this embodiment, the content of the magnetic powder which comprises the magnet forming the roller body 33*a* is a range of less than 92 wt % to 94 wt % to ensure the molding of the roller body 33*a* by obtaining the high magnetic force.

The first embodiment of the present invention is specifically described as follows. Although the magnetic powder comprising the molding material of the roller body 33*a* is not limited, a strontium ferrite of an anisotropic ferrite is used in this embodiment. Ferrite is the most widely used as magnetic powder and is cheep and easily available. However, the magnetic powder is not limited to ferrite, the magnetic powder of the rare-earth having the high magnetic property such as Nd—Fe—B series, Sm—Co series, Sm—Fe—N series, and so on, may be used.

A large quantity of the content of the magnetic powder in the molding material causes the molding material to have the high magnetic property, but cannot ensure the molding property due to a loss of flexibility. The general plastic magnet or gum magnet cannot obtain the molding property within a range of 91 wt % to 92 wt %. For the polymer material of the present invention, a large quantity of a content of an ethyl acrylate as an amorphous component of the ethylene ethyl acrylate copolymer provides more flexible material. In this embodiment, the ethylene ethyl acrylate copolymer which has 35 wt % of the ethyl acrylate component is used. Thereby the sufficient flexibility can be ensured with 92 wt % or more of the magnetic powder content. In this embodiment, the magnetic powder content is 92.6 wt %.

Furthermore, the permanent magnet is used as magnetic field generating means to orient the magnet comprising the roller body 33*a*, and disposed on the parts corresponding to each pole in the die. It is needed that the generated magnetic field is at least 3 T to orient the roller body 33*a* and that the magnetic property is not reduced by heat of about 200° C. because the die is heated with a range of 150° C. to 200° C. To meet these requirements, the Sm—Co magnet is suited. In this embodiment, the magnet which has a maximum energy product of BHmax of 24 MGOe and a remanent magnetic flux density of Br of 1.02 T is used.

The extrusion molding is performed by using the die where the permanent magnet is disposed, to obtain the roller body 33*a* where the magnetic pole setting grooves 35 are formed. Temperature for molding is set at 160° C. The roller body 33*a* is formed in a based outer diameter of 23 mm, in a based diameter of an inside hole of 10 mm, and in a length of 314 mm. The oriented roller body 33*a* is demagnetized and an axis (SUS303) in an outer diameter of 10 mm is inserted in the inside hole of the roller body 33*a*. The magnetized magnetic blocks 33*b*, 33*c* are inserted in the magnetic pole setting grooves 35 to be attached and fixed. The magnetic blocks 33*b*, 33*c* are needed to have the higher magnetic force than the roller body 33*a* but are not limited specifically.

An alpha-cyanoacrylate adhesive is used for an adhesive. The magnet roller 33 where the magnetic blocks 33*b*, 33*c* are adhered and fixed on the roller body 33*a* is yoke-magnetized. Finally an outer periphery of the magnet roller 33 is covered with the development sleeve 32 (Aluminum A6063, a diameter of 25 mm) as the nonmagnetic tube-like body. The magnetic block 33*b* which is inserted in the magnetic pole S3 (the development pole) is formed in a height of 3 mm and a width of 3 mm, and the magnetic block 33*c* inserted in the magnetic pole N4 (the adjacent pole) is formed in a height of 2.3 mm, a width of 5 mm. Any materials are comprised of Nd—Fe—B+6 (6 nylon), and the maximum energy product BHmax is 10 MGOe.

The inventors of the present invention had produced various magnet roller 33 which have different structures from each other, and measured the magnetic property of the magnet rollers 33. A result is shown in TABLE.1 as follows.

TABLE 1

| | Peak Magnetic Flux Density [mT] | | |
|---|---|---|---|
| | S3 | N4 | S1, N1, S2, N2, N3, S4 |
| Embodiment 1-1 | 122 | 123 | *1 |
| Comparative Example 1-1 | 102 | 108 | *2 |
| Comparative Example 1-2 | 89 | 72 | *3 |

*1: Specifications accomplished in all 6 poles
*2: Specifications not to be accomplished in 1 or 2 poles
*3: Specifications not to be accomplished in 3 poles or more
S3: Development Pole
N4: Adjacent Pole provided downstream of Development Pole An Embodiment 1-1

In an embodiment 1-1, the roller body 33*a* was molded while orienting the magnetic powder of the molding material as mentioned above. Moreover, the magnetic blocks 33*b*, 33*c* are set to be comprised of the material Nd—Fe—B+PA6

(6-nylon), to have the maximum energy product BHmax of 10 MGe, to form the magnetic pole S3 (the development pole) having the height of 3 mm and the width of 3 mm, and to form the magnetic pole N4 (the adjacent pole) having the height of 2.3 mm and the width of 5 mm as mentioned above.

Comparative Example 1-1

In a comparative example 1-1, the magnet roller 33 was molded without orienting the magnetic powder of the roller body 33*a*. The magnetic blocks 33*b*, 33*c* mentioned in the embodiment 1-1 were used.

Comparative Example 1-2

In a comparative example 1-2, the magnetic blocks 33*b*, 33*c* were not used. The magnet roller 33 was molded with orienting the magnetic powder and the magnetic pole setting grooves 35 were not formed on the roller body 33*a*.

According to TABLE.1, in the embodiment 1-1 and the comparative example 1-1, the magnetic flux density of the magnetic pole S3 (the development pole) and the magnetic pole N4 (the adjacent pole) can be raised. On the contrary, in the comparative example 1-2, the magnetic flux density of the magnetic pole S3 (the development pole) and the magnetic pole N4 (the adjacent pole) cannot be raised.

As seen in above examples, the ratio of the magnetic flux density of the magnetic pole N4 as the adjacent pole to that of the magnetic pole S3 as the development pole is at least 90% or more, as well as the magnet roller 33 is configured to be comprised of the roller body 33*a*, on which the magnetic pole setting grooves 35 are provided and which is formed by the magnet including at least the magnetic powder and the polymer material, and the high magnetic force magnet, which has the higher magnetic force than the magnet comprising the roller body 33*a* and which is inserted in the magnetic pole setting grooves 35. Thereby, the magnetic forces of the development pole and the adjacent pole are raised while ensuring molding property to allow the margin of the carrier attachment to be raised.

Furthermore, in the embodiment 1-1 and the comparative example 1-2, a magnetized specification having 8 poles is accomplished, but is not accomplished in the comparative example 1-1. As seen in the above examples, the orientation of the magnetic powder of the roller body 33*a* allows the roller body 33*a* to have the multi-poles including 8 or more poles and the toner and the magnetic carrier of the developer 26 are maintained in a good dispersion state.

Moreover, in the above-mentioned embodiment, the magnetic force of the magnetic pole S3 (the development pole) and N4 (the adjacent pole) is raised by using the magnetic block 33*b*, 33*c*, but the present invention is not limited, that is to say, for example, the magnetic flux density of the magnetic pole N4 (the adjacent pole) to the magnetic pole S3 (the development pole) of the magnet roller 33 where the magnetic blocks 33*b*, 33*c* are not used, may be set in at least 90% or more.

In the above-mentioned embodiment, the magnetic powder of the magnet comprising the roller body 33*a* is oriented, but the present invention is not limited, that is to say, for example, the roller body 33*a* may be formed by the non-oriented magnet if the roller body 33*a* is not required to have the multi-poles.

Moreover, in the above-mentioned embodiment, ethylene ethyl acrylate copolymer is used as the polymer material which is molding material of the magnet comprising the roller body 33*a*, but the present invention permits any polymer material which can work as a binder of the magnet.

Furthermore, in the above-mentioned embodiment, when the ethylene ethyl acrylate copolymer is used as the polymer material which is the molding material of the magnet comprising the roller body 33*a*, the content of the magnetic powder is in a range of 92 wt to 94 wt %, but the present invention permits the content of the magnetic powder less than 92 wt % if the roller body 33*a* is not required to have the high magnetic property.

In the above-mentioned embodiment, the development device 13 includes the developer supplying portion 14, the case 27, the development roller 15, and the control blade 16. However, in the present invention, the development device 13 is required to include at least the development roller 15, and is not required to include the developer supplying portion 14, the case 27, and the control blade 16.

Figure 8:
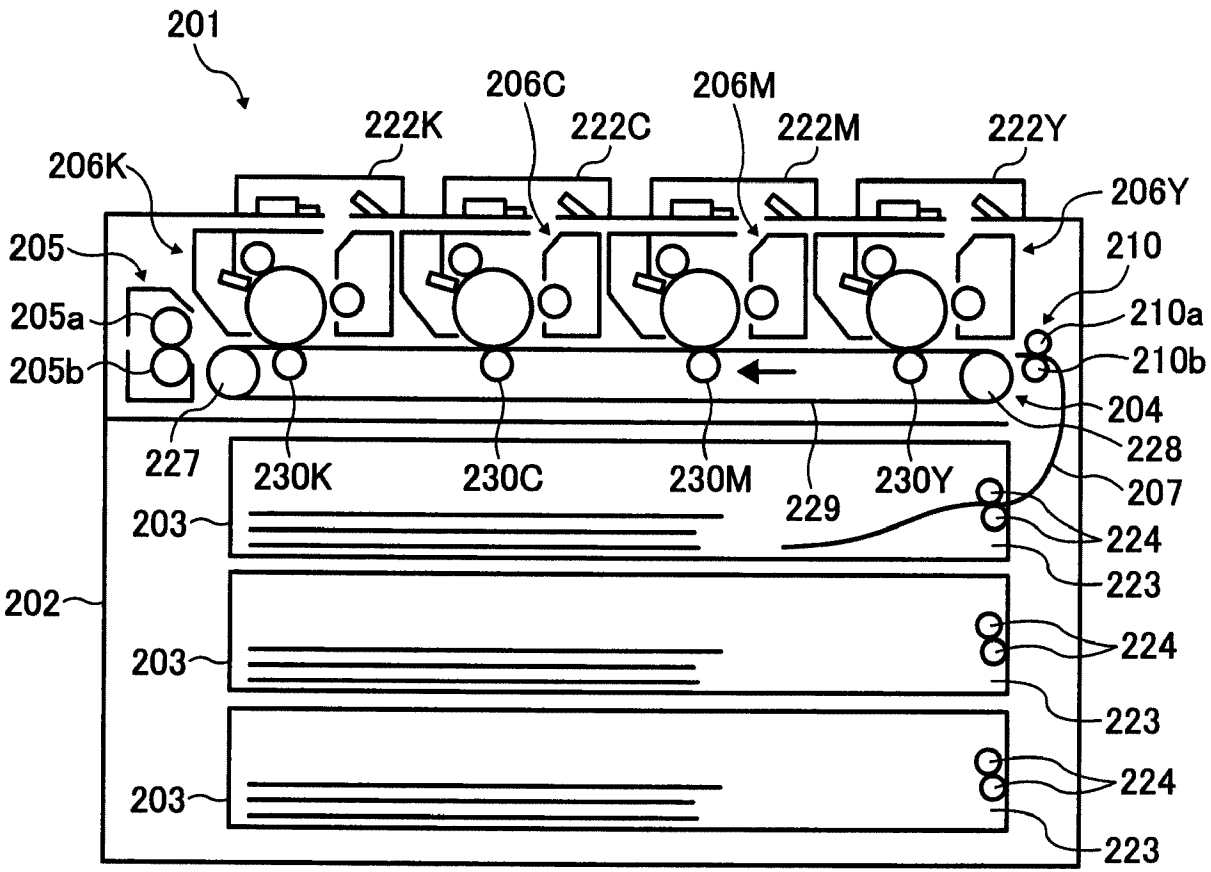
FIG. 8 is an explanatory view showing a structure of an image forming apparatus according to one embodiment of the present invention, as viewed from front.
Figure 9:
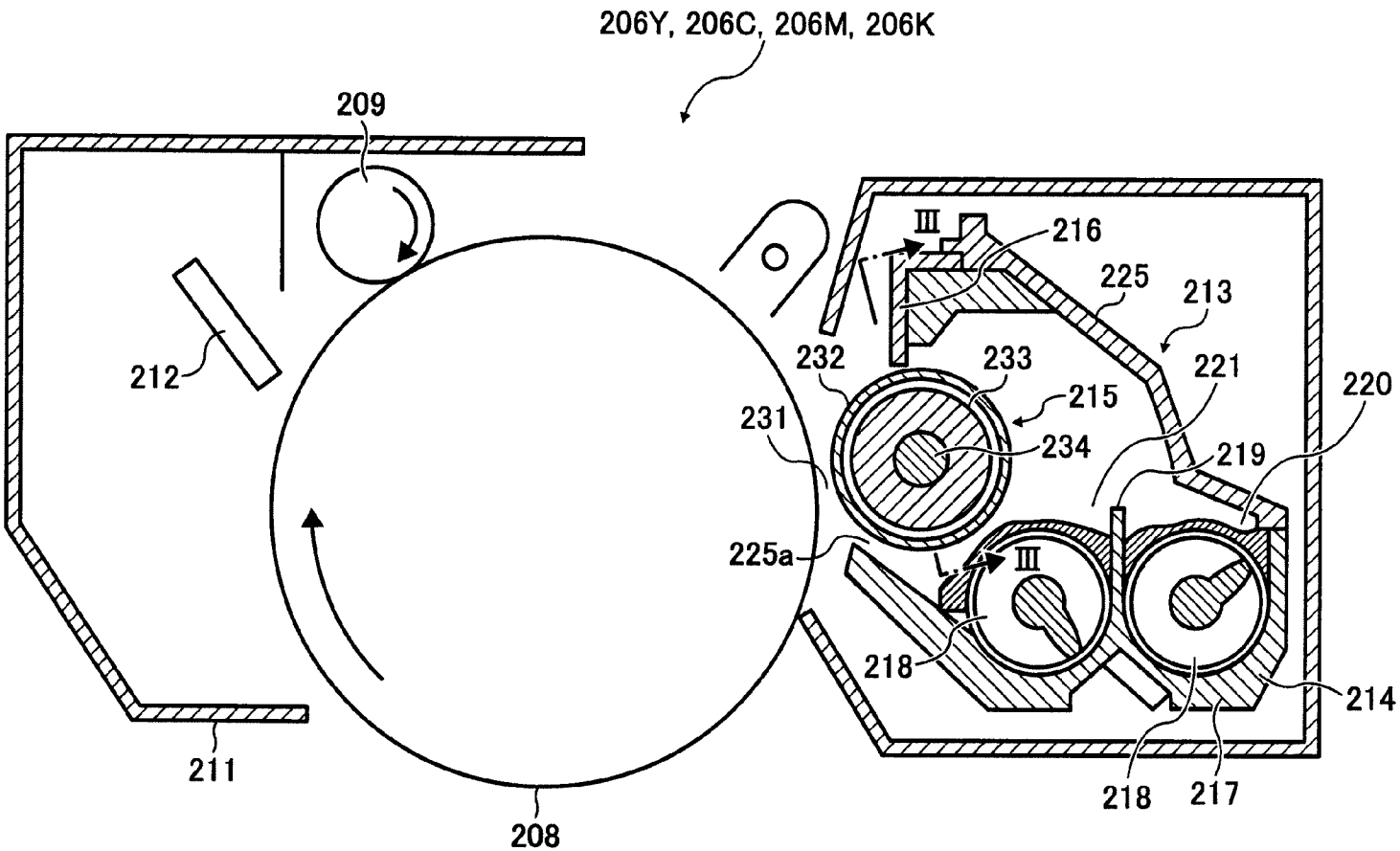
FIG. 9 is a sectional view showing a process cartridge in the image forming apparatus as shown in FIG. 8.
Figure 10:
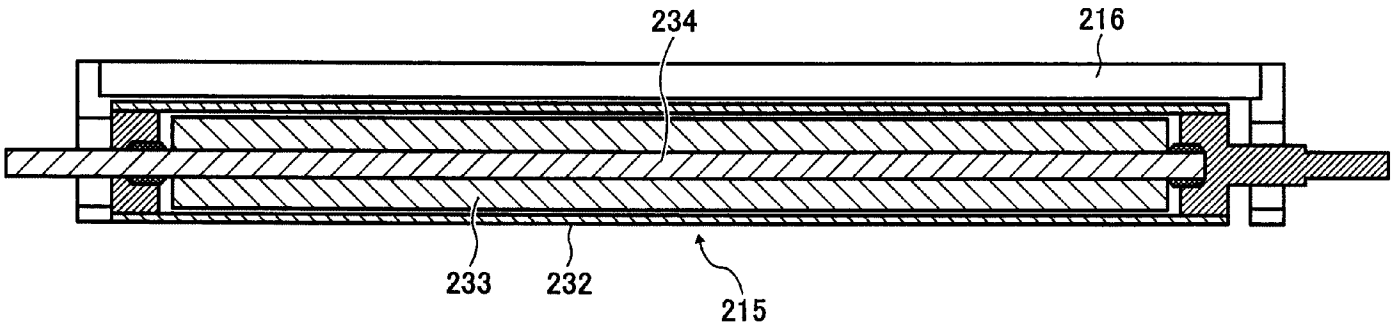
FIG. 10 is a sectional view taken along line III-III in FIG. 9.
Figure 11:
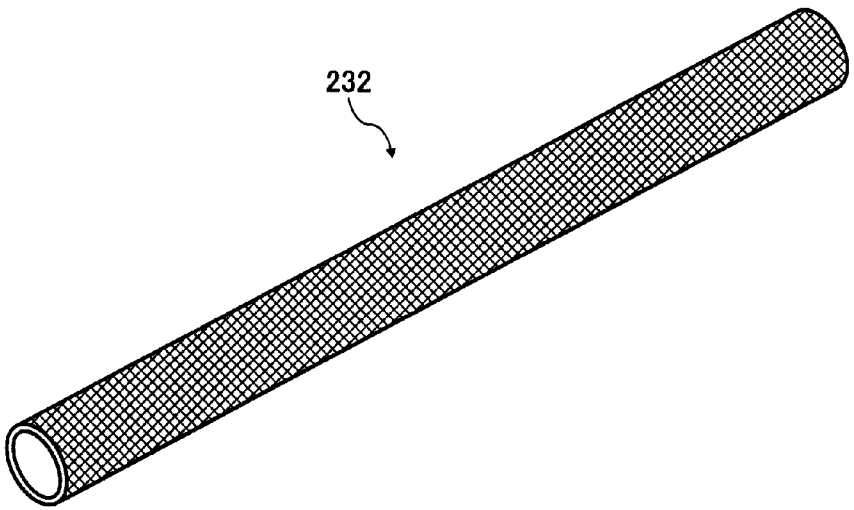
FIG. 11 is a perspective view showing a development sleeve of the development device of the process cartridge as shown in FIG. 10.
Figure 12:
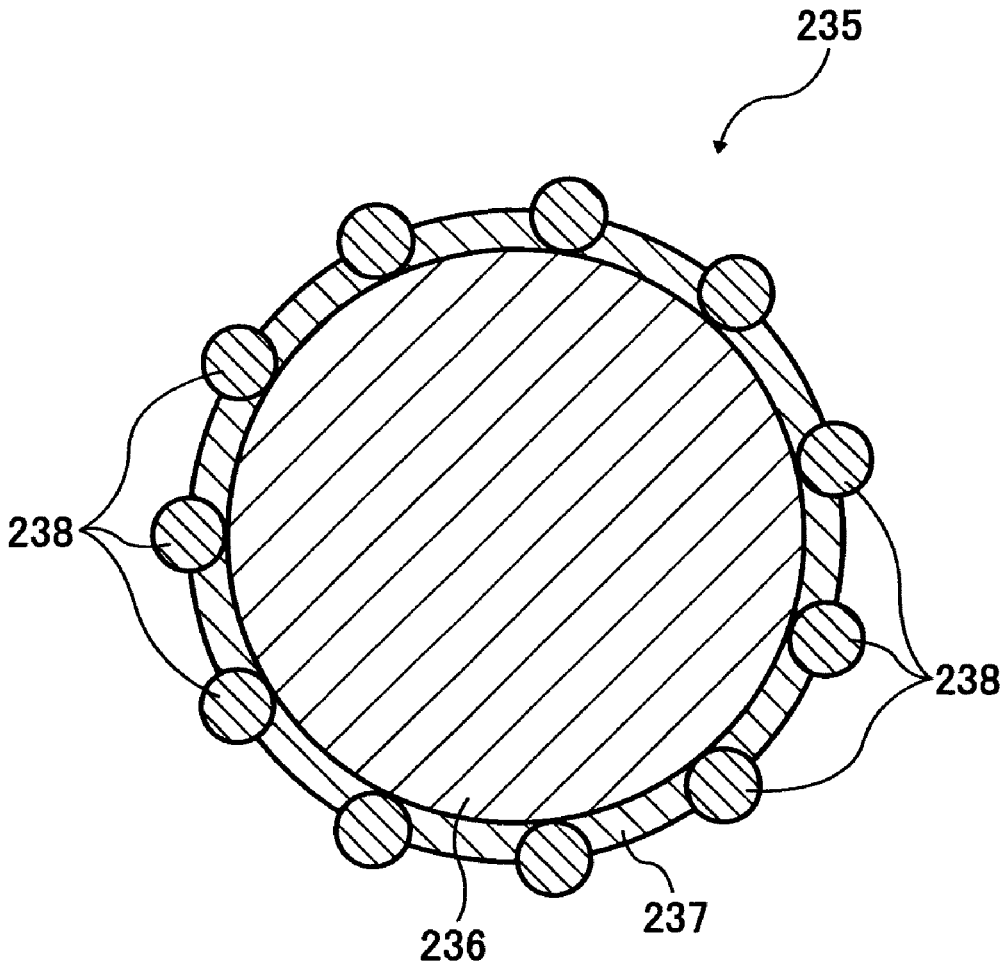
FIG. 12 is a sectional view showing a magnetic carrier of a developer used in the development device of the process cartridge.
Figure 13A:
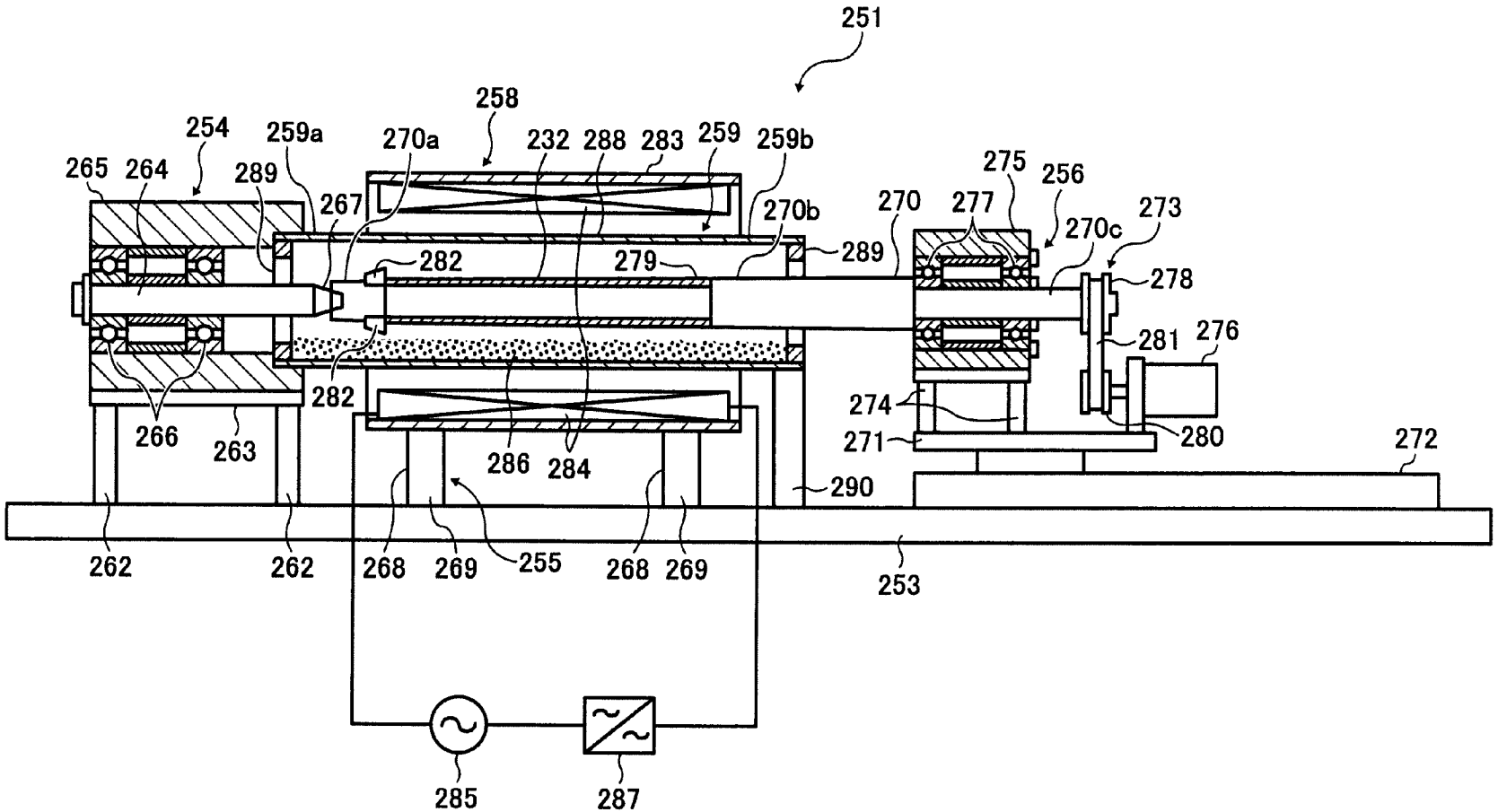
FIG. 13A is a sectional view showing a structure of a surface treatment device configured to provide roughing treatment on an outer surface of the development sleeve shown in FIG. 11.
Figure 13B:
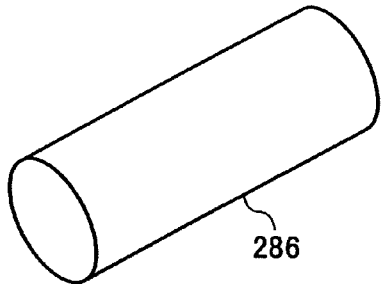
FIG. 13B is a perspective view of a wire member used in the surface treatment device as shown in FIG. 13A.

A second embodiment of the present invention is described with reference to FIGS. 8 to 15, and 17 as follows. FIG. 8 is an explanatory view as viewed from a front to show a structure of an image forming apparatus according to the second embodiment of the present invention. FIG. 9 is a sectional view showing a development device of the image forming apparatus shown in FIG. 8. FIG. 10 is a sectional view as viewed along a line III-III shown in FIG. 9. FIG. 11 is a perspective view showing a development sleeve of the development device shown in FIG. 10. FIG. 12 is a sectional view of a carrier of a developer of the development device shown in FIG. 9. FIG. 13A is a sectional view showing a structure of a surface treatment device performing a surface roughening treatment on an outer surface of the development sleeve shown in FIG. 11, and FIG. 13B is a perspective view of a wire member used in the surface treatment device shown in FIG. 13A.

The image forming apparatus 201 form an image of each color of yellow (Y), magenta (M), cyan (C), black (B), that is to say, a color image on a recording paper 207 (see FIG. 8) as a transfer member. Here, each unit corresponding to the color of yellow, magenta, cyan, black is shown with Y, N, C, K added to behind of the reference number. The image forming apparatus 201 includes at least a main body 202, a paper supplying unit 203, a resist roller pair 210, a transfer unit 204, a fixing unit 205, a plurality of laser writing units 222Y, 222M, 222C, and 222K, and a plurality of process cartridges 206Y, 206N, 206C, and 206K as shown in FIG. 8.

The main body 202 is for example formed in a box shape and mounted on a floor. The main body 202 contains the paper supplying unit 203, the resist roller pair 210, the transfer unit 204, the fixing unit 205, the plurality of laser writing units 222Y, 222M, 222C, and 222K, and the plurality of process cartridges 206Y, 206M, 206C, and 206K.

A plurality of paper supplying units 203 are provided on a lower portion of the main body 202. The paper supplying unit 203 houses the above mentioned recording papers which are stacked and includes a paper supplying cassette 223 which is capable of moving in and from the main body 202 and a paper supplying roller 224. The paper supplying roller 224 is compressed on the recording paper 207 which is positioned on a top in the paper supplying cassette 223. The paper supplying roller 224 sends the above-mentioned top recording paper 207 to a region between a mentioned-below conveying belt 229 of the transfer unit 204 and photo conductive drums 208 of a mentioned-below development device of the process cartridges 206Y, 206M, 206C, and 206K.

The resist roller pair 210 is provided on a conveying line of the recording paper 207 from the paper supplying unit 203 to the transfer unit 204, and includes a pair of rollers 210*a*, 210*b*.

The resist roller pair 210 pinches the recording paper 207 between the pair of rollers 210*a*, 210*b* and sends between the transfer unit 204 and the process cartridges 206Y, 206M, 206C, and 206K at a time when the pinched recording paper can be overlapped by the toner image.

The transfer unit 204 is provided upward of the paper supplying unit 203. The transfer unit 204 includes a driving roller 227, a driven roller 228, the conveying belt 229 and the plurality of transfer rollers 230Y, 230M, 230C, 230K. The driving roller 227 is disposed downstream of a conveying direction of the recording paper 207 and is rotated to be driven by a motor as a driving source, and so on. The driven roller 228 is supported to be capable of rotating on the main body 202 and is disposed upstream of the conveying direction of the recording paper 207. The conveying belt 229 is formed in an end less annular shape and is tacked across both of the driving roller 227 and the driven roller 228 mentioned above. The conveying belt 229 rotates clockwise around the driving roller 227 and the driven roller 228 mentioned above due to a rotate drive of the driving roller 227.

The conveying belt and the recording paper 207 on the conveying belt 229 are pinched between the transfer rollers 230Y, 230M, 230C, 230K and the photo conductive drums 208 of the process cartridges 206Y, 260M, 260C, and 260K respectively. The transfer unit 204 allows the recording paper 207 sent from the paper supplying unit 203 to be compressed on each of outer surfaces of the photo conductive drums 208 of process cartridges 206Y, 206M, 206C, and 206K and the toner image to be transferred on the recording paper 207. The transfer unit 204 sends the recording paper 207 where the toner image is transferred to the fixing unit 205.

The fixing unit 205 is provided downstream of the conveying direction of the recording paper 207 of the transfer unit 204 and includes a pair of rollers 205*a*, 205*b* which are pinching the recording paper 207 therebetween. The fixing unit 205 compresses and heats the recording paper 207 which is sent from the transfer unit 204 and passed between the pair of rollers 205*a*, 205*b* to fix the toner image transferred from the photo conductive drum 208 to the recording paper 207 thereon.

The laser writing units 222Y, 222M, 222C, and 222K are mounted on upper portions of the main body 202, respectively. The laser writing units 222Y, 222M, 222C, and 222K correspond to the process cartridges 206Y, 206M, 206C, and 206K, respectively. The laser writing units 222Y, 222M, 222C, and 222K irradiate the outer surfaces of the photo conductive drums 208 which are charged uniformly by charged rollers 209 (mentioned below) of the process cartridges 206Y, 206M, 206C, and 206K with laser lights to form the electrostatic latent image.

The plurality of process cartridges 206Y, 206M, 206C, and 206K are provided between the transfer unit 204 and the laser writing unit 222Y, 222M, 222C, and 222K. The process cartridges 206Y, 206M, 206C, and 206K are removably provided on the main body 202. The process cartridges 206Y, 206M, 206C, and 206K are provided in parallel with each other along the conveying direction of the recording paper 207.

The process cartridges 206Y, 206M, 206C, and 206K include at least a cartridge case 211, the charged roller 209 as a charging device, the photo conductive drum 208 as a photo conductor (also referred to as an image supporting body), a cleaning blade 212 as a cleaning device, and a development device 213 as shown in FIG. 9. Therefore, the image forming apparatus 201 includes at least the charged roller 209, the photo conductive drum 208, the cleaning blade 212, and the development device 213.

The cartridge case 211 is detachably disposed on the main body 202 and contains the charged roller 209, the photo conductive drum 208, the cleaning blade 212, and the development device 213. The charged roller 209 charges uniformly the outer surface of the photo conductive drum 208. The photo conductive drum 208 is disposed with an interval from a development roller 215 (mentioned below) of the development device 213. The photo conductive drum 208 is formed in a cylindrical or tube-like shape to be capable of rotating about an axis. The photo conductive drum 208 provides the electrostatic latent image thereon by the corresponding laser writing unit 222Y, 222M, 222C, and 222K. The photo conductive drum 208 is developed by attaching a toner on the electrostatic latent image which is formed and supported on the outer surface, and transfers the obtained toner image to the recording paper 207 positioned between the conveying belt 229 and the photo conductive drum 208. The cleaning blade 212 removes a toner remained on the outer surface of the photo conductive drum 208 after transferring the toner image onto the recording paper 207.

The development device 213 includes at least a developer supplying portion 214, a case 225, the development roller 215 as a developer supporting body, and a control blade 216 as a control member as shown in FIG. 9.

The developer supplying portion 214 includes a containing tank 217 and a pair of agitating screws 218 as an agitating member. The containing tank 217 is formed in a box shape of the almost same length as the photo conductive drum 208. Provided in the containing tank 217 is a partition wall 219 lengthening in a longitudinal direction of the containing tank 217. The partition wall 219 partitions the containing tank 217 into a first space 220 and a second space 221. The first space 220 and the second space 221 are communicated with each end.

The developer 226 is contained in both the first space 220 and the second space 221 of the containing tank 217. The developer 226 includes the toner and a magnetic carrier 235 (also referred to as magnetic powder, a section thereof is shown in FIG. 12). The toner is accordingly provided to an end of the first space 220 which is away from the development roller 215 of the first and second spaces 220 and 221.

The magnetic carrier 235 is contained in both the first space 20 and the second space 21. The diameter of the magnetic carrier 235 is from 20 μm to 50 μm. The magnetic carrier 235 includes a core member 236, a plastic coating membrane 237 coating an outer surface of the core member 236, and an aluminum particle 238 dispersed in the plastic coating membrane 237 as shown in FIG. 12.

The agitating screws 218 are contained in the first space 220 and the second space 221 respectively. Longitudinal directions of the agitating screws 218 are in a direction parallel to longitudinal directions of the containing tank 217, the development roller 215 and the photo conductive drum 208. The agitating screws 218 are disposed to be capable of rotating about the axis and the rotating causes the toner and the magnetic carrier 235 to be agitated and the developer 226 conveyed along the axis.

In the illustrated embodiment, the agitating screw 218 in the first spare 220 conveys the developer 226 from the mentioned end to another end. The agitating screw 218 in the second space 221 conveys the developer 226 from the other end to an end.

According to the above-mentioned structure, the developer supplying portion 214 conveys the toner provided to the end of the first space 220 to the other end while agitating with the carrier 235, and then conveys from the other end to the other end of the second space 221. The developer supplying portion 214 agitates the toner and the magnetic carrier 235 in the second space 221, and then, provides them on an outer surface of the development roller 215 while conveying in a direction of the axis.

The case 225 is formed in a box shape and mounted on the containing tank 217 of the above developer supplying portion 214 to cover the development roller 215 as well as the containing tank 217, and so on. Furthermore, an opening 225*a* is provided on an opposing part from the photo conductive drum 208 of the case 225.

The development roller 215 is formed in a cylindrical shape and provided between the second space 221 and the photo conductive drum 208 and near the above-mentioned opening 225*a*. The development roller 215 is in a direction parallel to both the photo conductive drum 208 and the containing tank 217. The development roller 215 is disposed with an interval from the photo conductive drum 208. The toner of the developer 26 is attached to the photo conductive drum 208 in a space between the development roller 215 and the photo conductive drum 208 to form a development area 231 where the toner image is obtained by developing the electrostatic latent image. In the development area 231, the development roller 215 is opposing from the photo conductive drum 208.

The development roller 215 includes a cored bar 234, a tube-like magnet roller (also referred to as a magnet body) 233 and a tube-like development sleeve 232 as a nonmagnetic tube-like body as shown in FIGS. 9 and 10. The cored bar 234 is disposed as a longitudinal direction thereof is in the direction parallel to the longitudinal direction of the photo conductive drum 208, and fixed on the above-mentioned case 225 without rotating.

The magnet roller 233 is comprised of a magnetic material, is formed in a tube-like shape, and mounts a plurality of fixed magnetic poles (not shown). The magnet roller 233 is fixed on an outer circumference of the cored bar 234 without rotating about the axis.

The fixed magnetic poles are magnets formed in a long and stick-like shape and are mounted on the magnet roller 233. The fixed magnetic pole is lengthened along the longitudinal direction of the magnet roller 33, that is to say, the development roller 215 and provided over an entire length of the magnet roller 233. The magnet roller 233 having the structure as mentioned above is contained in the development sleeve 232.

A single fixed magnetic pole is opposing from the mentioned-above agitating screw 218. The single fixed magnetic pole forms a picking-up magnetic pole to attach the developer 226 in the second space 221 of the containing tank 217 by generating a magnetic force on the outer surface of the development sleeve 232, that is to say, of the development roller 215.

An other single fixed magnetic pole is opposing from the above-mentioned photo conductive drum 208. The fixed magnetic pole forms a development magnetic pole, and generates a magnetic force on the outer surface of the development sleeve 232, that is to say, the development roller 215 to form a magnetic field between the development sleeve 232 and the photo conductive drum 208. The fixed magnetic poles are configured to send the toner of the developer 226 which is attached on the outer surface of the development sleeve 232 on the photo conductive drum 208 due to forming a magnetic brush by the magnetic field.

At least one fixed magnetic pole is provided between the above-mentioned picking-up magnetic pole and the development magnetic pole. The fixed magnetic pole generates the magnetic force on the outer surface of the development sleeve 232, that is to say, the development roller 215 to convey a preceding developer 226 to the photo conductive drum 208 and to convey a developed developer 226 from the photo conductive drum 208 into the containing tank 217.

The mentioned-above fixed magnetic poles overlap the magnetic carrier 235 of the developer 226 along magnetic field lines generated by the fixed magnetic force to form raised portions or ears on the outer surface of the development sleeve 232 after attaching the developer on the outer surface of the development sleeve 232. As mentioned above, the raised portions formed on the outer surface of the development sleeve 232 by overlapping the magnetic carrier 235 along the magnetic field lines mean standing several portions of the magnetic carrier 235 on the outer surface of the development sleeve 232. The above-mentioned toner is attached to the magnetic carrier 235, that is to say, the development sleeve 232 attaches the developer 226 on the outer surface thereof by the magnetic force of the magnetic roller 233.

The development sleeve 232 is formed in a tube-like shape as shown in FIG. 11. The development sleeve 232 contains the magnet roller 233 which is provided to be capable of rotating about the axis. The development sleeve 232 rotates to allow an inner surface thereof to oppose the fixed magnetic poles in order. The development sleeve 232 is made of a non-magnetic material, such as aluminum alloy, stainless steel (SUS), and so on. As mentioned above, the surface roughening treatment is performed on the outer surface of the development sleeve 232 by the surface treatment device 201.

Furthermore, the surface roughening treatment is performed on the outer surface of the development sleeve 232 by the surface treatment device 251 shown in FIG. 13A so that depressions 239 (shown in FIG. 17) is formed to make a change of an area of the developer 226 attached on the development sleeve 232 viewed from an outer peripheral side thereof to range from 0% to 30% in relation to a change of attached amount of the developer 226, that is to say, a picked-up amount.

Moreover, if the mentioned-above area change of the developer 226 to the picked-up amount change ranges from 0% to 30%, the above-mentioned area change of the developer 226 ranges from 0% to 3% when the picked-up amount change changes, for example 10%. In addition, the outer peripheral side of the development sleeve 232 corresponds to a position opposing from the outer surface of the development sleeve 232 along a normal direction of the outer surface of the development sleeve 232.

Figure 16:
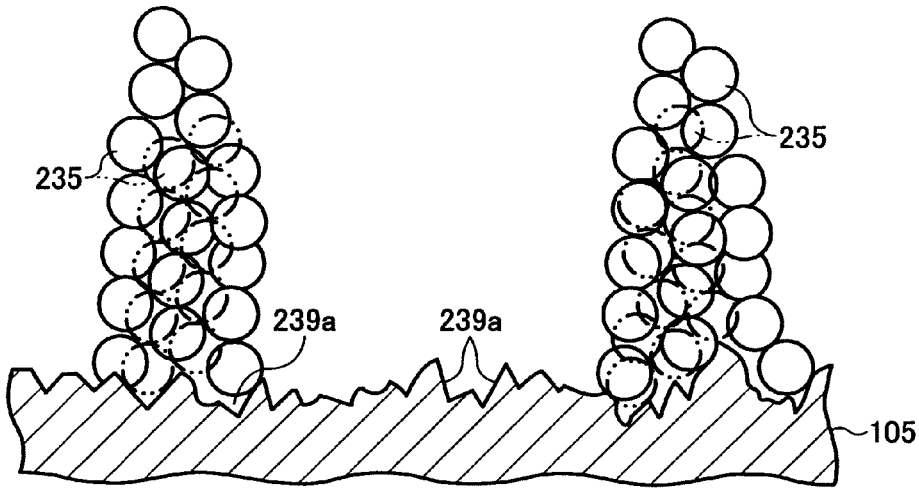
FIG. 16 PRIOR ART
FIG. 16 is a sectional view schematically showing a state in which a developer is raised on an outer surface of a development sleeve on which conventional sand blast is provided.

Therefore, the development sleeve 232 of this embodiment allow the developer 226 to raise in a form much thicker and shorter (to make an amount of the developer 226 projected from the outer surface of the development sleeve 232 small and an area of developer 226 covering the outer surface of the development sleeve 232) than conventional one shown in FIG. 16 by forming the depressions 239 (see FIG. 17) which is much smoother than the depressions 239 which is formed by a conventional sand-blast (see FIG. 16). Thereby, in the development sleeve 232 of the embodiment, the area of the developer 226 viewed from the outer peripheral side of the development sleeve 232 is prevented from reducing even if the attached amount of the developer 226 is reduced.

The fine depressions 239 formed on the outer surface of the development sleeve 232 are shallower than the grooves formed on the outer surface of the conventional development sleeve 105 and significantly smoother than the concave and convex portions 239*a* (see FIG. 16) formed by the conventional sand-blast. In other words, an interval between the adjacent depressions 239 formed on the outer surface of the development sleeve 232 of the embodiment is much more than that between the adjacent concave and convex portions 239*a* formed by the conventional sand-blast. A Ten-Point Height of Roughness (Rz) as a surface roughness of the outer surface of the development sleeve 232 ranges from 8 μm to 15 μm. In addition, the development sleeve 232 is disposed at a position where a distance between the development sleeve 232 and the photo conductive drum 208 is 0.1 mm or more and 0.4 mm or less.

The surface treatment device 251 includes a base 253, a fixing holding portion 254, a supporting electro-magnetic coil portion 255, a moving holding portion 256, an electro-magnetic coil 258 as magnetic field generating means, and a containing tank 259 as shown in FIG. 13A.

The base 253 is formed in a tabular shape and mounted on a floor of a factory, on a table, and so on. An upper surface of the base 253 is held in parallel to a horizontal direction. The base 253 is formed in a rectangular shape in plane.

The fixing holding portion 254 includes a plurality of supports 262 raised from an end of the base 253 in a longitudinal direction, a holding base 263, a cylindrical holding member 265, and a driven shaft.

The support 262 is capable of modifying a length of a projected part from the base 253. The support 262 modifies a height of the holding base 263 according to the modification of the length from the base 253.

The holding base 263 is formed in a tabular shape and mounted on a top of the support 262. The cylindrical holding member 265 is formed in a cylindrical shape and mounted on the holding base 263. The cylindrical holding member 265 is disposed as an axis thereof is in parallel to a horizontal direction. The cylindrical holding member 265 is disposed as the axis thereof is in parallel to a longitudinal direction of the base 253. The cylindrical holding member 265 contains an end 259*a* of the containing tank 259.

The driven shaft 264 is formed in a cylindrical form. The driven shaft 264 is disposed as an axis thereof is in parallel to both of the horizontal direction and the longitudinal direction of the base 253. The driven shaft 264 is provided on the cylindrical holding member 265 to be capable of rotating about the axis of the cylindrical holding member 265 by a roller bearing 266. At an end of the base 253 of the driven shaft 264, which is disposed close to a central portion, a tapered portion 267 which is positioned on the driven shaft 264 and tapers towards the central portion of the base 253 is provided. The driven shaft 264 is disposed with the same axis as that of the cylindrical holding member 265.

In the fixing holding portion 254, a height of the holding base 263 is arranged by the supports as the driven shaft 264 and the cylindrical holding member 265 have the same axis as that of the containing tank 259 and of a mentioned-below midair holding member 270. The fixing holding portion 254 causes the tapered portion 267 of the driven shaft 264 to be inserted in an end 270*a* of the midair holding member 270 so that the fixing holding portion 254 contains an end 259*a* of the containing tank 259 in the cylindrical holding member 265 and carries the end 259*a* of the containing tank 259 to support the end 270*a* of the midair holding member 270. Thereby, the fixing holding portion 254 as mentioned and structured above holds the end 259*a* of the containing tank 259 and the end 270*a* of the midair holding member 270.

The supporting electro-magnetic coil portion 255 is provided in parallel along a longitudinal direction of the fixing holding portion 254 and the base 253 and is disposed to be situated nearer the central portion of the base 253 in relation to the fixing holding portion 254. The supporting electro-magnetic coil portion 255 includes a pair of supporting portions 268. Each supporting portion 268 includes a pair of supports 269. The supports 269 are connected with each other at each end. The supports 269 are raised from the base 253. Each of the supporting portions 268 includes the pair of supports 269 to form in a V-shaped shape. The pair of supporting portions 268 is disposed with an interval from each other along the longitudinal direction of the base 253. The supporting electro-magnetic coil portion 255 supports the electro-magnetic coil 258 at an upper end of the support 269 of each of the supporting portion 268.

The moving holding portion 256 is provided in parallel along the longitudinal direction of the supporting electro-magnetic coil portion 255 and the base 253 and disposed to be situated nearer another end of the base 253 in relation to the supporting electro-magnetic coil portion 255. The moving holding portion 256 includes a linear guide (not shown), a holding base 271, an actuator 272 and a roller bearing rotational portion 273.

The linear guide includes a rail and a slider. The rail is provided on the base 253. The rail is formed in a linear shape and disposed as a longitudinal direction of the rail is in parallel to the longitudinal direction of the base 253. The slider is supported on the rail to be capable of moving along the longitudinal direction of the rail, that is to say, of the base 253.

The holding base 271 is formed in a tabular shape and mounted on the mentioned slider of the linear guide (not shown). An upper surface of the holding base 271 is disposed in parallel to the horizontal direction. The actuator 272 is mounted on the base 253 and moves and slides the mentioned holding base 271 along the longitudinal direction of the base 253.

The roller bearing rotational portion 273 includes a plurality of supports 274, a cylindrical holding member 275, the midair holding member 270, a driving motor 276 as rotating means, and a chuck cylinder for a chuck (not shown).

The plurality of supports 274 is raised from the holding base 271. The cylindrical holding member 275 is formed in a cylindrical shape and mounted on an upper end of the supports 274. The cylindrical holding member 275 is disposed as the axis thereof is in parallel to both of the horizontal direction and the longitudinal direction of the base 253. The cylindrical holding member 275 is disposed with the same axis as that of both the driven shaft 264 and the cylindrical holding member.

The midair holding member 270 is formed in a cylindrical shape and is supported on the cylindrical holding member 275 to be capable of rotating about the axis by the roller bearing 277. The midair holding member 270 is disposed as the axis thereof is the same axis as the longitudinal direction of base 253, that is to say, the axis of the cylindrical holding member 265 of the fixing holding portion 254. The midair holding member 270 is disposed in a shape to be projected from an upside of holding base 271 toward the fixing holding portion 254 as an end 270*a* of the midair holding member 270 is positioned in the containing tank 259, and as an other end 270*c* of the midair holding member 270 is positioned on the holding base 271. Moreover, the midair holding member 270 is disposed with an axis of the driven shaft 264. The midair holding member 270 passes through the development sleeve 232 where the surface roughening treatment is not yet performed. In addition, a pulley 278 is fixed on the other end 270*c* positioned on the holding base 271 of the midair holding member 270. The pulley 278 is disposed with an axis of the midair holding member 270.

Furthermore, a step 279 reducing stepwise an outer diameter of the midair holding member 270 from the other end 270*c* toward the end 270*a* is provided on a central portion 270*b* positioned in the containing tank 259 of the midair holding member 270.

The driving motor 276 is provided on the holding base 271 and a pulley 280 is mounted on an output axis of the driving motor 276. An axis of the output axis of the driving motor 276 is in parallel to the longitudinal direction of the base 253. An endless belt 281 is tacked across the above-mentioned pulley 278, 280. The driving motor 276 rotates the midair holding member 270 about an axis. The driving motor 276 rotates the development sleeve 232 about an axis which is in parallel to the longitudinal direction of the containing tank 259 by rotating the midair holding member 270 about an axis.

The chuck cylinder includes a cylinder body which is provided on the holding base 271 and a chuck shaft which is provided to be capable of sliding on the cylinder body. The chuck shaft is formed in a cylindrical shape and disposed as a longitudinal direction of the chuck shaft is in parallel to that of the base 253. The chuck shaft is contained in the midair holding member 270 and disposed with an axis of the midair holding member 270. A pair of chuck claws 282 is mounted on the chuck shaft.

The pair of chuck claws 282 is mounted on the chuck shaft in a shape to be projected from a outer surface of the chuck shaft to a circumferential side of the chuck shall. The chuck claws 282 are projected from the outer surface of the midair holding member 270 toward the circumferential side of the midair holding member 270. The chuck claws 282 are provided to be capable of modifying a length of projected part from the chuck shaft and the midair holding member 270. As the chuck shaft of chuck cylinder for the chuck contracts to approach, the pair of chuck claws 282 causes the length of the part projected from the chuck shaft and the midair holding member 270 as mentioned above to increase.

The above-mentioned cylinder causes the chuck claws 282 to be projected more to a circumferential portion of the chuck shaft by contracting the cylinder body for the chuck claws to be projected from the outer surface of the midair holding member 270. And then, the chuck cylinder pinches the development sleeve 232 between the step 279 and the chuck claws 282 to fix the chuck shaft, the midair holding member 270, and the development sleeve 232. Here, the chuck shaft is with same axis as that of the midair holding member 270, the development sleeve 232, and a mentioned-below cylindrical member 288, that is the containing tank 259.

The above-mentioned chuck cylinder and the chuck claws 282 supports the development sleeve 232 as an axis thereof is the same as that of the midair holding member 270 and the containing tank 259. That is, the chuck cylinder and the chuck claws 282 support the development sleeve 232 at a center of the containing tank 259. The above mentioned chuck cylinder and the chuck claws form a holding mechanism.

The moving holding portion 256 configured as mentioned above moves the midair holding member 270 and so on along the longitudinal direction of the base 253 by the actuator 272 and causes the chuck cylinder and the chuck claws 282 to support the development sleeve 232 at the midair holding member 270.

The electro-magnetic coil 258 includes an outer coat 283 formed in a cylindrical shape and plurality of coil portions 284 disposed in the outer coat 283, and is formed in an annular shape entirely. The outer coat 283 and the plurality of coils 284 comprise a body portion of the electro-magnetic coil 258 as magnetic field generating means.

An inner diameter of the electro-magnetic coil 258 is larger than an outer diameter of the containing tank 259. That is, a space is formed between an inner surface of the electro-magnetic coil 258 and an outer surface of the containing tank 259. In the present invention, it is preferable that a space of about from 5 mm to 15 mm is formed between the inner surface of the electro-magnetic coil 258 and the outer surface of the containing tank 259 along a radial direction thereof. In addition, an entire length of the electro-magnetic coil 258 in an axial direction is slightly shorter than that of the containing tank 259 in a direction of an axis.

The outer coat 283 is comprised of metal of nonmagnetic material which has electrically conductive such as aluminum. An axis of the outer coat, that is to say, an axis of the electro-magnetic coil 258 is supported on an upper end of the support 269 if the supporting portion 268 of the supporting electro-magnetic coil portion 255 which is mentioned above in parallel to the longitudinal direction of the base 253. In addition, the outer coat 283, that is, the electro-magnetic coil 258 is disposed with the same axis as that of the mentioned-above midair holding member 270, the driven shaft 264, and the chuck shaft.

The plurality of coil portions 284 is disposed in parallel with each other along a circumferential direction of the outer coat 283, that is the electro-magnetic coil 258. The twenty four coil portions 284 are provided. Each of the coil portions 284 include a yoke (not shown), a coil rolled in a circumference of the yoke. The yoke is comprised of a magnetic material and fixed on an inner surface of the outer coat 283 by shrinkage fitting. A space between the coil portions 284 is filled with plastics, or the like. Each of the coil portions 284 is applied by a three-phase alternating-current source 285 shown in FIG. 13A. An electrical power which has phases deviated from each other is impressed on the plurality of coil portions 284, and coils of the plurality of coil portions 284 generates magnetic fields which have phases deviated from each other. Then, the electro-magnetic coil 258 generates a magnetic field (rotational magnetic field) rotating in a rotational direction about an axis of the electro-magnetic coil 258 which is formed by conflating these magnetic fields in an inner side of the electro-magnetic coil 258.

The above-mentioned electro-magnetic coil 258 is impressed by the three-phase alternating-current source 285 to generate the rotational magnetic field in the containing tank 259, and so on. The electro-magnetic coil 258 positions a wire member 286 mentioned below in the above-mentioned rotational magnetic field and rotates (moves) the wire member 286 positioned at a circumference of the development sleeve 232 about the axis of the containing tank 259 and the development sleeve 232 by the rotational magnetic field. The electro-magnetic coils 258 hit randomly the wire member 286 on the outer surface of the development sleeve 232 by the above-mentioned rotational magnetic field.

Moreover, an inverter 287 as magnetic field modifying means is provided between the three-phase alternating-current source 285 and the electro-magnetic coil 258. The inverter 287 is capable of modifying a frequency, a current value, and a voltage value of the electrical power impressed by the three-phase alternating-current source 285 on the electro-magnetic coil 258. The inverter 287 adjusts the electrical power impressed by three-phase alternating-current source 285 on the electro-magnetic coil 258 to modify an intensity of the rotational magnetic field generated by the electro-magnetic coil 258 by modifying the frequency, the current value, and the voltage value of the electrical power impressed on the electro-magnetic coil 258.

The containing tank 259 includes the cylindrical member 288 which has an outer wall formed in a single structure (that is, the outer wall is formed by a single wall) and a pair of sealing blades 289.

The cylindrical member 288 is formed in a cylindrical shape and comprises an outer shell of the containing tank 259. Therefore, the containing tank 259 is formed in a cylindrical shape as well as the outer wall of the containing tank 259 is formed in the single structure as the cylindrical member 288 is formed in the single structure. An outer diameter of the cylindrical member 288, that is to say, of the containing tank 259 is smaller than an inner diameter of the electro-magnetic coil 258, and the outer diameter of the cylindrical member 288, that is to say, of the containing tank 259 is larger than an outer diameter of the midair holding member 270. The cylindrical member 288 is comprised of a nonmagnetic material.

The pair of sealing blades 289 is formed in an annular shape. One sealing blade 289 is mounted on the cylindrical member 288 for example by engaging with an inner circumference of an end 259*a* of the cylindrical member 288 of the containing tank 259. The sealing blade 289 lets the driven shaft 264 into an inside of thereof. Another sealing blade is mounted on the cylindrical member 288 for example by engaging with an inner circumference of another end 259*b* of the cylindrical member 288. The other sealing blade 289 lets the midair holding member 270 into an inside thereof. The sealing blade controls an outflow of the wire member into an outside of the cylindrical member 288, that is to say, the containing tank 259. The end 259*a* forms an end of the cylindrical member 288, and the other end 259*b* forms another end of the cylindrical member 288.

The containing tank 259 configured as mentioned above contains the wire member 286 (see FIG. 13B) comprised of a magnetic material and the development sleeve 232 mounted on the midair holding member 270 in the cylindrical member 288. That is, the containing tank 259 contains both of the development sleeve 232 and the wire member 286. The wire member is hit randomly on the outer surface of the development sleeve 232 for example by rotating around the outer circumference of the development sleeve 232 by the above-mentioned rotational magnetic field. The wire member 286 is hit on the outer surface of the development sleeve 232 and chip a part of the development sleeve 232 from the outer surface thereof to treat the outer surface of the development sleeve 232 by the surface roughening treatment.

The wire member 286 is comprised of a nonmagnetic material such as a stainless steel. The wire member 286 is formed in a cylindrical and short-line shape. A volume of the wire member 286 ranges from 1.0 $mm^3$ to 6.0 $mm^3$. Therefore, in the present invention, the surface roughening treatment is performed on the outer surface of the development sleeve 232 to make a change in an area of the developer 226 attached on the outer surface of the development sleeve 232 viewed from the outer peripheral side thereof to range from 0% to 30% in relation to a change of attached amount of the developer 226 on the outer surface of the development sleeve 232 by hitting randomly the wire member 286 whose volume ranges from 1.0 $mm^3$ to 6.0 $mm^3$ on the outer surface of the development sleeve 232.

Furthermore, the above-mentioned containing tank 259 is supported by braces 269 which have an end 259*a* contained in the cylindrical holding member 265 and are supported by the fixing holding portion 254, and which have an other end 259*b* raised from the base 253. The containing tank 259, that is to say, the cylindrical member 288 is disposed with the same axis as that of the driven shaft 264, the midair holding member 270, the electro-magnetic coil 258, and so on by the fixing holding portion 254 and the braces 269.

The surface treatment device 251 as mentioned above is configured to provide the surface roughening treatment on the outer surface of the development sleeve 232 as follows.

First, the supports 262 are arranged and the driven shaft 264 of the fixing holding portion 254 is positioned as an axis is same as the axis of the midair holding member 270. The midair holding member 270 is positioned at an outer portion of the cylindrical member 288 of the containing tank 259 by the actuator 272. Then, the development sleeve 232 where the surface roughening treatment is not yet performed is set on the midair holding member 270 as the midair holding member is inserted in the development sleeve 232 from a side of the end 270*a* of the midair holding member 270. The development sleeve 232 where the surface roughening treatment is not yet performed is abutted on the step 279.

Then, the chuck shaft is slid to the cylinder body of the chuck cylinder by operating the chuck cylinder. Therefore, the chuck claws 282 are projected from the outer surface of the midair holding member 270. The development sleeve 232 is pinched between the step 279 and the chuck claws 282 to be positioned (fixed) at the midair holding member 270. Accordingly, the midair holding member 270, the development sleeve 232 and the electro-magnetic coil 258 are disposed with the same axis as each other.

Thereafter, the midair holding member 270 where the development sleeve 232 is mounted is inserted in the cylindrical member 288 of the containing tank 259 by the actuator 272. The tapered portion 267 is inserted in the end 270*a* of the midair holding portion 270 as the end 270*a* of the midair holding portion 270 is positioned. That is, the end 270*a* of the midair holding member 270 is supported on the fixing holding portion 254. Then, actuator 272 is stopped.

The development sleeve 232 is rotated with the midair holding member 270 about the axis by the driving motor 276. Then, the electrical power from the three-phase alternating-current source 285 is impressed on the electro-magnetic coil 258 to generate the rotational magnetic field on the electro-magnetic coil 258. Thereby, the wire member 286 positioned at an inside of the electro-magnetic coil 258 rotates in orbit around the axis while rotating on its axis to treat the outer surface of the development sleeve 232 by the surface roughening treatment by hitting randomly on the outer surface of the development sleeve 232.

Furthermore, after the electrical power is impressed on the electro-magnetic coil 258 for a predetermined time, the surface roughening treatment of the outer surface of the development sleeve 232 is completed. Thereby, the development sleeve 232 configured as mentioned above is obtained.

The control blade 216 is disposed to face an outer peripheral portion of the photo conductive drum 208 of the development device 213. The control blade 216 is attached on the above-mentioned case 225 in a state disposed with an interval from the outer surface of the development sleeve 232. The control blade 216 is configured to remove the developer 226 exceeding a predetermined thickness on the outer surface of the development sleeve 232 from the outer surface into the containing tank 217 to set the developer 226 on the outer surface conveyed to the development area 231 to be the predetermined thickness.

The development device 213 configured as mentioned above agitates the toner and the magnetic carrier 235 in the developer supplying portion 214 for the developer 226, the agitated developer 226 is absorbed to the outer surface of the development sleeve 232 by the plurality of fixed magnetic poles. Then, the development device conveys the adsorbed developer 226 by the plurality of fixed magnetic poles toward the development area 231 when the development sleeve 232 is rotated. The development device causes the developer 226 which is in the desirable thickness by the control blade 216 to be attached on the photo conductive drum 208. Thereby, the development device 213 causes the developer 226 to be supported on the development roller 215 and to be conveyed to the development area 231, in order to develop the electrostatic latent image formed on the photo conductive drum 208 to form the toner image.

The development device 213 allows the developed developer 226 to be left toward the containing tank 217. In addition, the developed developer which is contained in the containing tank 217 is sufficiently agitated again with the other developer 226 in the second space 221 to be used for a development of the electrostatic latent image formed on the photo conductive drum 208.

The image forming apparatus 201 configured as mentioned above forms an image on the recording paper 207 as follows. First, the image forming apparatus 201 rotates the photo conductive drum 208 and charges uniformly the outer surface of the photo conductive drum 208 by the charged roller 209. The outer surface of the photo conductive drum 208 is irradiated with a laser to form the electrostatic latent image thereon. Then, after the electrostatic latent image is positioned at the development area 231, the developer 226 attached on the outer surface of the development sleeve 232 of the development device 213 is attached on the outer surface of the photo conductive drum 208, the electrostatic latent image is developed, and then the toner image is formed on the outer surface of the photo conductive drum 208.

The image forming apparatus 201 causes the recording paper 207 conveyed for example by the paper supplying roller 224 of the paper supplying unit 203 to be positioned between the photo conductive drum 208 of the process cartridges 206Y, 206M, 206C, and 206K and the conveying belt 229 of the transfer unit 204 and the toner image formed on the outer surface of the photo conductive drum 208 to be transferred on the recording paper 207. The image forming apparatus 201 fixes the toner image on the recording paper 207 at the fixing unit 205. As mentioned above, the image forming apparatus 201 forms a color image on the recording paper 207.

According to the embodiment, the surface roughening treatment is performed on the outer surface of the development sleeve 232 as a change of an area of the developer 226 attached on the development sleeve 232 viewed from an outer peripheral side thereof in relation to a change of attached amount of the developer 226, that is to say, a picked-up amount ranges from 0% to 30%. That is, the change of the area of the developer 226 viewed from the outer peripheral side thereof in relation to a change of the picked-up amount of the developer 226 is adapted to be small. That is, in the embodiment, the depressions 239 is formed smoothly by hitting the above-mentioned wire member 286 as shown in FIG. 17 compared to the concave and convex portions 239*a* formed by the conventional sand blast treatment shown in FIG. 16

In the concave and convex portions 239*a* formed by the sand blast shown in FIG. 16, the magnetic carrier 235 rides the concave and convex portions 239*a* due to a narrowness of the interval between the concave and convex portions 239*a*. Therefore, the magnetic carrier 235 is slippery on the concave and convex portions 239*a* and each raised portion has a magnetic moment by the magnetic field from the magnet roller 106, and the raised portion which has the magnetic moment in the same direction as each other is situated in a adjacent state with each other. Thereby, the raised portion is repulsive to each other to separate each other. Consequently, the magnetic carrier 235, that is to say, the developer 101 is raised in a slim and long shape (slim on the outer surface of the development sleeve 105 and long in length projected therefrom) in the concave and convex portions 239*a* formed by the sand blast treatment shown in FIG. 16

Therefore, in the development sleeve 105 shown in FIG. 16, when an amount of the picked-up developer 101 is reduced from a state shown by a solid line to a state shown by a double-dotted chain line, a width, that is to say, an area of the raised developer 226 viewed from an outer peripheral side of the above-mentioned development sleeve 105 becomes remarkably small to form a raised form in a similar figure by the solid line and the double-dotted chain line.

Figure 17:
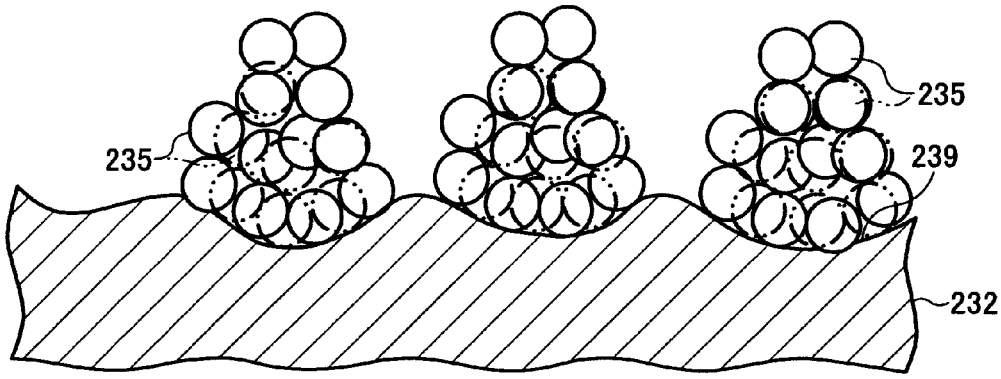
FIG. 17 is a sectional view schematically showing a state in which a developer is raised on the outer surface of the development sleeve as shown in FIG. 11.

On the contrary, as shown in FIG. 17, intervals between the depressions 239 formed by hitting the wire members 286 of the embodiment mentioned above are much larger than intervals between the depressions 239*a* shown in FIG. 16 so that the asperities of the embodiment is much smoother than the concave and convex portions 239*a* shown in FIG. 16. Thereby, in the embodiment, a raised form is formed in each depression as a root as shown in FIG. 17. That is, the raised portion is formed on each depression.

In the embodiment, the magnetic carrier 235, that is to say, the developer 226 are raised in a shape much thicker and shorter (to be thick on the outer surface of the development sleeve 232 and to shorten a length projected from the development sleeve 232) compared to a case shown in FIG. 16. Therefore, in the development sleeve 232 of the embodiment shown in FIG. 17, the amount of the developer 226 picked-up in a state shown by a double-dotted chain line from a state shown by a solid line is reduced and a width, that is to say, an area of the raised developer 226 viewed from an outer peripheral side of the above-mentioned development sleeve 232 don't become almost small even though the raised form is in a similar figure by the solid line and the double-dotted chain line.

Therefore, if the depressions 239 of the outer surface of the development sleeve 232 become worn across the ages and then the amount of the picked-up developer 226 is decreased, the development device 213 of the embodiment can control an decreased amount of the area of the developer 226 attached on the outer surface of the development sleeve 232 viewed from an outer peripheral side of the above-mentioned development sleeve 232 as shown in FIGS. 14 and 15. Therefore, a generation of an irregularity of an image across the ages can be controlled and high-quality images can be obtained over the long term.

Figure 14A:
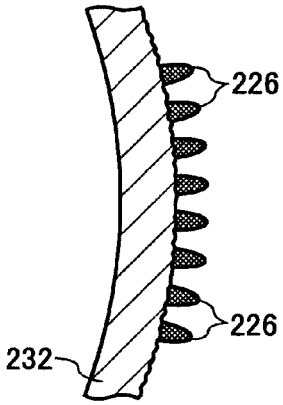
FIG. 14A is a sectional view showing a state where developer picked up on the outer surface of the development sleeve as shown in FIG. 11 is large in quantity.
Figure 14B:
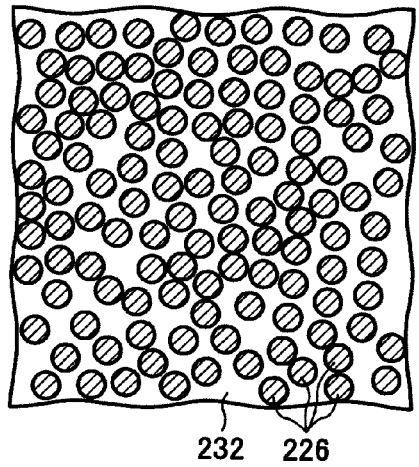
FIG. 14B is a plan view showing a state in which a part of the outer surface of the development sleeve in the state shown in FIG. 14A is expanded.
Figure 15A:
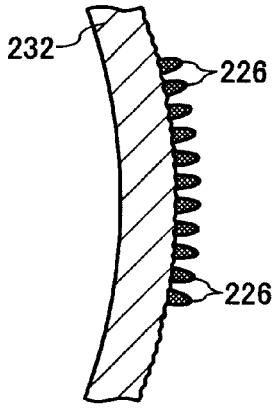
FIG. 15A is a sectional view showing a state where developer picked up on the outer surface of the development sleeve as shown in FIG. 11 is few in quantity.
Figure 15B:
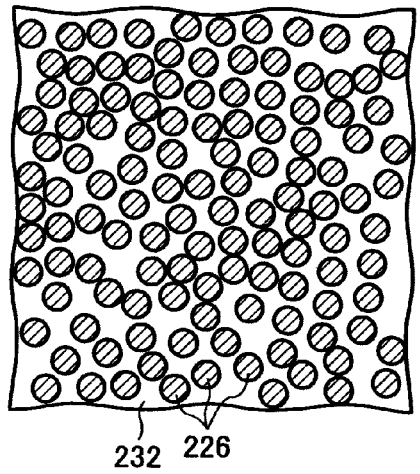
FIG. 15B is a plan view showing a state in which a part of the outer surface of the development sleeve in the state shown in FIG. 15A is expanded.

Furthermore, a beginning state of the use is shown in FIG. 14 and a state changed across the ages after developing for example 10 京枚is shown in FIG. 15. Moreover in FIG. 14A and FIG. 15A, the developer 226 is shown by a black mark, and in FIG. 14B and FIG. 15B the developers 226 are shown by parallel diagonal lines.

Figure 24:
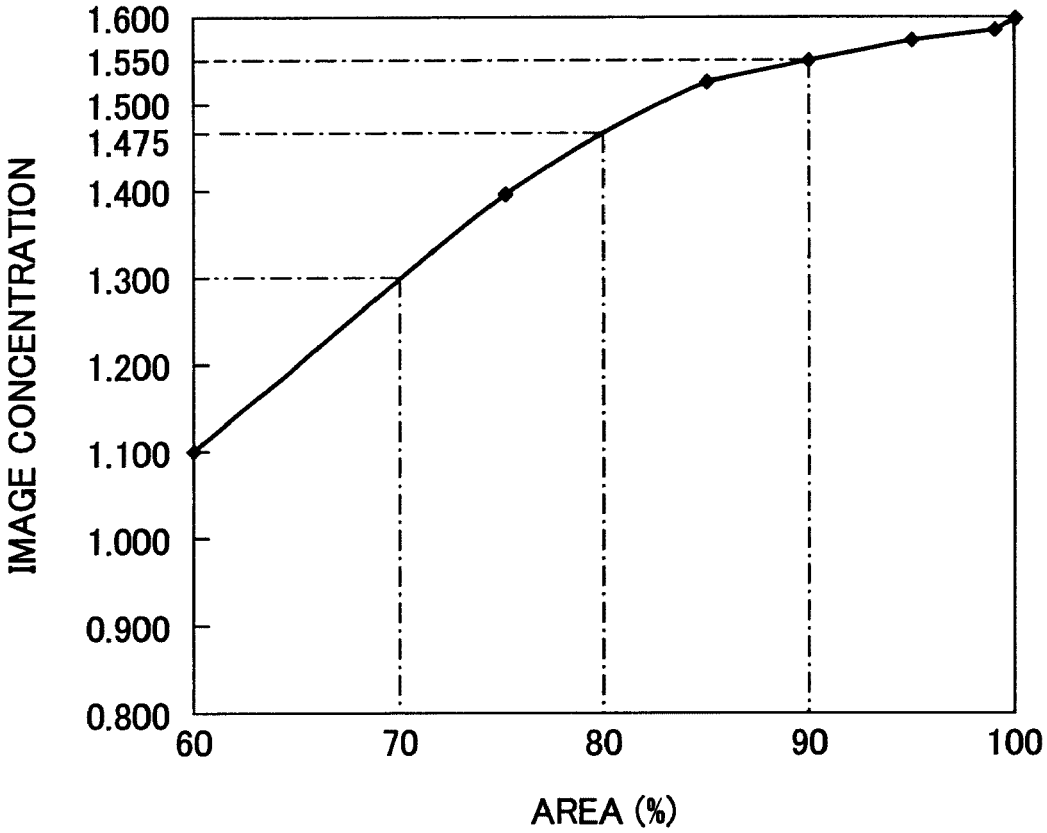
FIG. 24 is an explanatory view showing change in image density to change in an area of the developer absorbed to the development sleeve of the development device.
Figure 25A:
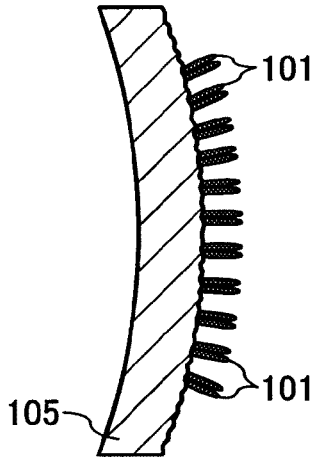
FIG. 25A PRIOR ART
FIG. 25A is a sectional view showing a state where developer picked up on the outer surface of the development sleeve on which the conventional sand blast is provided is large in quantity.
Figure 25B:
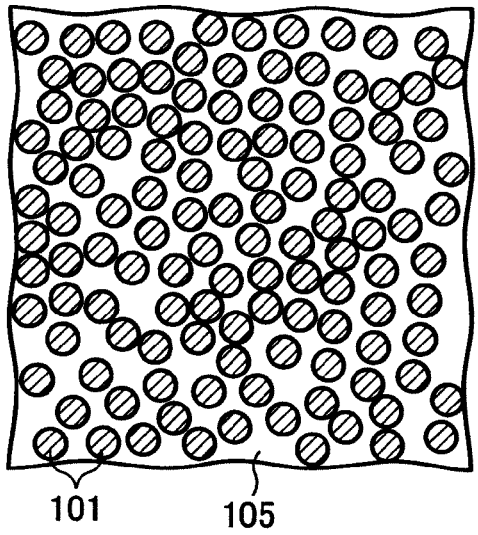
FIG. 25B PRIOR ART
FIG. 25B is a plan view showing a state in which a part of the outer surface of the development sleeve in the state shown in FIG. 25A is expanded.
Figure 26A:
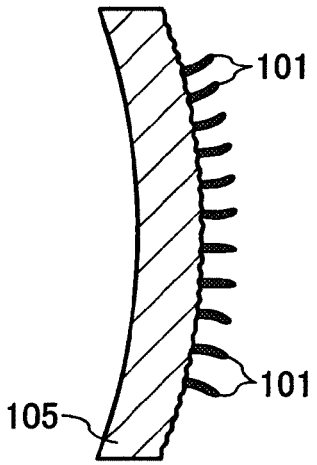
FIG. 26A PRIOR ART
FIG. 26A is a sectional view showing a state where developer picked up on the outer surface of the development sleeve on which the conventional sand blast is provided is few in quantity.
Figure 26B:
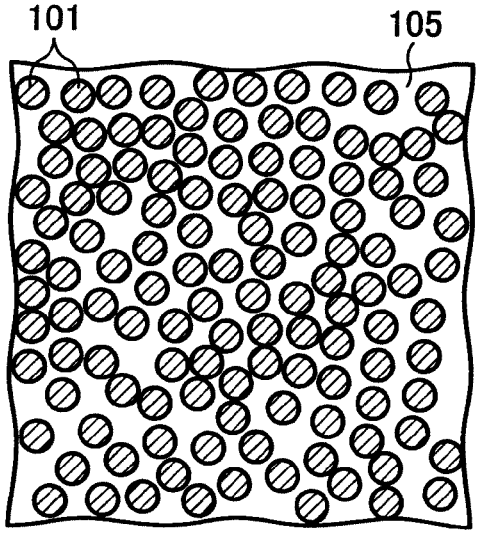
FIG. 26B PRIOR ART
FIG. 26B is a plan view showing a state in which a part of the outer surface of the development sleeve in the state shown in FIG. 26A is expanded.
Figure 27A:
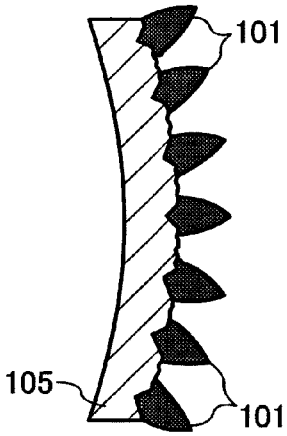
FIG. 27A PRIOR ART
FIG. 27A is a sectional view showing a state where developer picked up on the outer surface of the development sleeve having the conventional grooves is large in quantity.
Figure 27B:
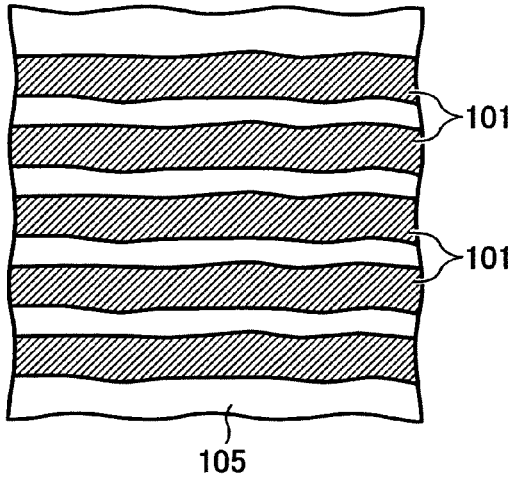
FIG. 27B PRIOR ART
FIG. 27B is a plan view showing a state in which a part of the outer surface of the development sleeve in the state shown in FIG. 27A is expanded.
Figure 28A:
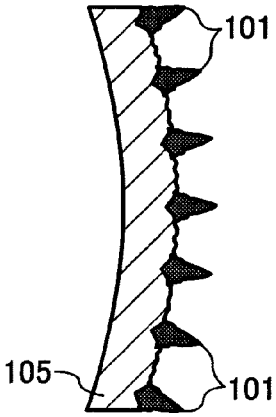
FIG. 28A PRIOR ART
FIG. 28A is a sectional view showing a state where developer picked up on the outer surface of the development sleeve having the conventional grooves is few in quantity.
Figure 28B:
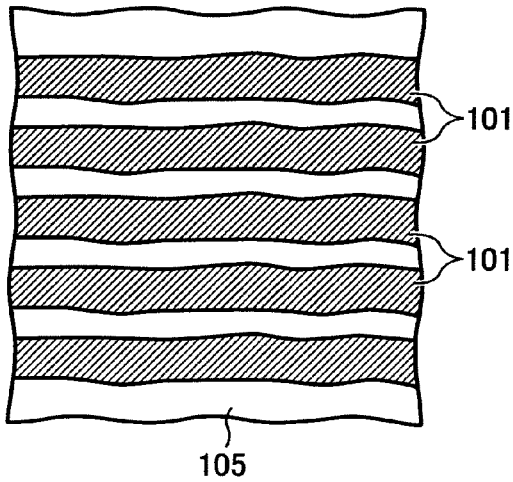
FIG. 28B PRIOR ART
FIG. 28B is a plan view showing a state in which a part of the outer surface of the development sleeve in the state shown in FIG. 28A is expanded.

That is, in the development device 213 of the embodiment, the mentioned area of the developer 226 shown in FIG. 24 is reduced only 30% from 100% to 70%. Therefore, it is found that the development device 213 of the embodiment can keep the image concentration at least 1.3 or more, according to an general relation between the mentioned area of the developer 226 shown in FIG. 24 and an image concentration. That is, the development device 213 of the embodiment allows the change of the area of the developer 226 viewed from the outer peripheral side in relation to the change of the picked-up amount of the developer 226 to be small the generation of the irregularity of an image across the ages and the decrease of the image concentration to be controlled, and then, the high-quality image can be obtained over the long term.

In the present invention, it is preferred that the surface roughening treatment is performed on the outer surface of the development sleeve 232 as the change of the area of the developer 226 attached on the development sleeve 232 viewed from an outer peripheral side thereof in relation to the change amount of attached amount of the developer 226, that is to say, a picked-up amount ranges from 0% to 20%. In this case, as seen in a result shown in FIG. 24, it is clearly found that the change of the image concentration can be kept within 0.1. Therefore, in particular when color images are formed, keeping the change of the image concentration within 0.1 causes an initial image and an image of continuous use to be formed with the same color. As mentioned above, the generation of the irregularity of an image across the ages and the decrease of the image concentration can be certainly controlled, and then, the high-quality image can be obtained over the long term.

In the present invention, it is further preferred that the surface roughening treatment is performed on the outer surface of the development sleeve 232 as the change of the area of the developer 226 attached on the development sleeve 232 viewed from an outer peripheral side thereof in relation to the change amount of attached amount of the developer 226, that is to say, a picked-up amount ranges from 0% to 10%. In this case, as seen in a result shown in FIG. 24, it is clear that the change of the image concentration can be reduced only 0.05 at a maximum. Therefore, the generation of the irregularity of an image across the ages and the decrease of the image concentration can be more certainly controlled, and then, the high-quality image can be obtained more certainly over the long term.

The surface roughening treatment is performed on the outer surface of the development sleeve 232 by hitting the wire members 286 which are much larger than abrasive grains used for the sand blast whose volume ranges from 1.0 $mm^3$ to 6.0 $mm^3$ on the outer surface of the development sleeve 232. Therefore, much smoother depressions 239 than the asperities formed by the sand blast are formed on the outer surface of the development sleeve 232 and the change of the area of the developer 226 attached on the outer surface of the development sleeve 232 can be kept within 5%, and then the high-quality image can be obtained certainly over the long term.

The wire members 286 are hit randomly on the outer surface of the development sleeve 232 so that a curvature of the axis, a deformation of the inner or outer diameter, and an elliptical shape in section of the development sleeve 232 are prevented. That is, an accuracy of a run-out of the development sleeve 232 can be kept in a high accuracy. Therefore, the generation of the irregularity of the amount of the developer 226 supplied to the photo conductive drum 208 is prevented, and the generation of the irregularity of the image concentration on the formed image is prevented.

Furthermore, as the wire members 286 are positioned in the rotational magnetic field and are hit on the outer surface of the development sleeve 232, the wire member 286 can be more randomly hit on the outer surface of the development sleeve 232. Therefore, more uniform depressions 239 can be formed on the outer surface of the development sleeve 232 and then, more uniform images can be obtained.

Moreover, as the depressions 239 can be formed on the outer surface of the development sleeve 232 by positioning the wire members 286 in the rotational magnetic field, a process step when forming the depressions 239 on the outer surface of the development sleeve 232 is prevented from increasing. Therefore, the process step for forming the depressions 239 on the outer surface of the development sleeve 232 is prevented from being complicated, and a cost for the process is prevented from elevating.

Furthermore, as the surface treatment device 251 contains the development sleeve 232 with the wire member 286 in the containing tank 259, the wire member can be more certainly hit on the outer surface of the development sleeve 232. Therefore, the outer surface of the development sleeve 232 can be treated more certainly by the surface roughening treatment.

As the developer 226 where an average diameter of the magnetic carrier 235 ranges from 20 μm to 50 μm, the developer 226 has an excellent granular property, and an excellent image which has slightly the irregularity can be obtained. It is not preferred that the average diameter of the magnetic carrier 235 is less than 20 μm as a magnetic intensity of the each of the magnetic carrier particles becomes small, a magnetic binding force of the magnetic carrier from the development roller 215 becomes small, because the magnetic carrier is easy to attach to the photo conductive drum 208. It is not preferred that the average diameter of the magnetic carrier 235 is more than 50 μm as an electric field between the magnetic carrier 235 and the electrostatic latent image on the photo conductive drum 208 becomes sparse because an uniform image can not be obtained (a quality of the image decreases).

As the Ten-Point Height of Roughness (Rz) as the surface roughness of the outer surface of the development sleeve 232 ranges from 8 μm to 15 μm, the magnetic carrier 235, that is the developer 226 can be attached on the outer surface of the development sleeve 232 without slipping, the toner can be supplied certainly to the photo conductive drum 208 and the high-quality image can be obtained. When the Ten-Point Height of Roughness (Rz) of the outer surface of the development sleeve 232 is less than 8 μm, as the magnetic carrier 235 is difficult to be held on the development sleeve 232, the magnetic carrier 235 is not raised stably on the outer surface of the development sleeve 232 and then the toner is difficult to be supplied to the photo conductive drum 208. When the Ten-Point Height of Roughness (Rz) of the outer surface of the development sleeve 232 is more than 15 μm, the magnetic carrier 235 degrades and an one dot reproducibility is reduced.

Furthermore, as the interval between the development sleeve 232 and the photo conductive drum 208 ranges from 0.1 mm to 0.4 mm, the toner can be supplied certainly to the photo conductive drum 208 from the developer 226 raised on the development sleeve 232, and the high-quality image can be obtained. It is not preferred that the interval between the development sleeve 232 and the photo conductive drum 208 is less than 0.1 mm, as the electric field between the development sleeve 232 and the photo conductive drum 208 becomes too large so that the magnetic carrier 235 moves to the photo conductive drum 208. It is not preferred that the interval between the development sleeve 232 and the photo conductive drum 208 is more than 0.4 mm, as the electric field between the development sleeve 232 and the photo conductive drum 208 becomes too small so that an amount of the toner supplied to the photo conductive drum 208 is reduced and an uniform image cannot be obtained because an edge effect of the electric field becomes large in an edge of the image as well as the development effect decreases.

Used is the developer 226 having the magnetic carrier 235 which is covered with the plastic coating membrane 237 which has a charged adjuster in a plastic component cross-linked with a thermoplastic resin and a melamine resin for a surface of the main bar 236. Therefore, as the magnetic carrier 235 where the cored bar is covered with the plastic coating membrane 237 having en elasticity, the magnetic carrier is prevented from being chipped because the plastic coating membrane has the elasticity and absorbs a shock. Therefore, the magnetic carrier has a longer lasting property than the conventional magnetic carrier.

Furthermore, the alumina particles 238 which are larger than a thickness of the plastic coating membrane 237 are dispersed in the above-mentioned plastic coating membrane 237. As mentioned above, used is the developer 226 having the magnetic carrier 235 where the alumina particles 238 is provided to be projected from an outer surface of the plastic coating membrane 237. Therefore, the alumina particles 238 prevent the plastic coating membrane 237 from being hit and a spent developer can be cleaned.

As the spent developer can be prevented, the magnetic carrier can have the longer lasting property than the conventional magnetic carrier. Therefore, the stability of the amount of the picked-up toner that is the high-quality of the images can be obtained over the long term.

As the toner prepared by the emulsion polymerization method or the suspension polymerization method is selected, there are advantageous effects that a sphericity of the toner is good and the irregularity of the concentration of a remained on the image is improved visually.

Furthermore, the process cartridges 206Y, 206M, 206C, and 206K, and the image forming apparatus 201 where the high-quality images can be obtained over the long term are provided as they have the development device 213.

The inventors of the present invention had produced various development sleeve 232 which had treated by different methods of the surface roughening treatments from each other, and formed initial test images and images after continuous uses (1017 pieces) of the development sleeve 232 to check an effect of the present invention. Results are shown in TABLE.2 as follows.

TABLE 2

| | | At Initial State | | In Continuous Use | |
|---|---|---|---|---|---|
| | Surface of Development Sleeve | Picked up Amount | Image Quality | Picked up Amount | Image Quality |
| Comparative Example 2-1 | Grooves | Many | Poor | Midling | Very Poor |
| Comparative Example 2-2 | Fine Depressions (Sand Blast) | Many | Very Excellent | Less | Very Poor |
| Invention's Product | Rough Depressions (treated by SUS Wire Member) | Many | Very Excellent | Midling | Excellent |

* Image Level (Sensory Test): Very Excellent > Excellent > Poor > Very Poor

Comparative Example 2-1

In a comparative example 2-1, the development sleeve 232 has an inner diameter of 16.5 mm and an outer diameter of 18.0 mm, and grooves which have a depth of 0.1 mm and a width of 0.2 with an interval of 0.5 mm are formed on the outer surface of the development sleeve 232.

Comparative Example 2-2

Figure 18:
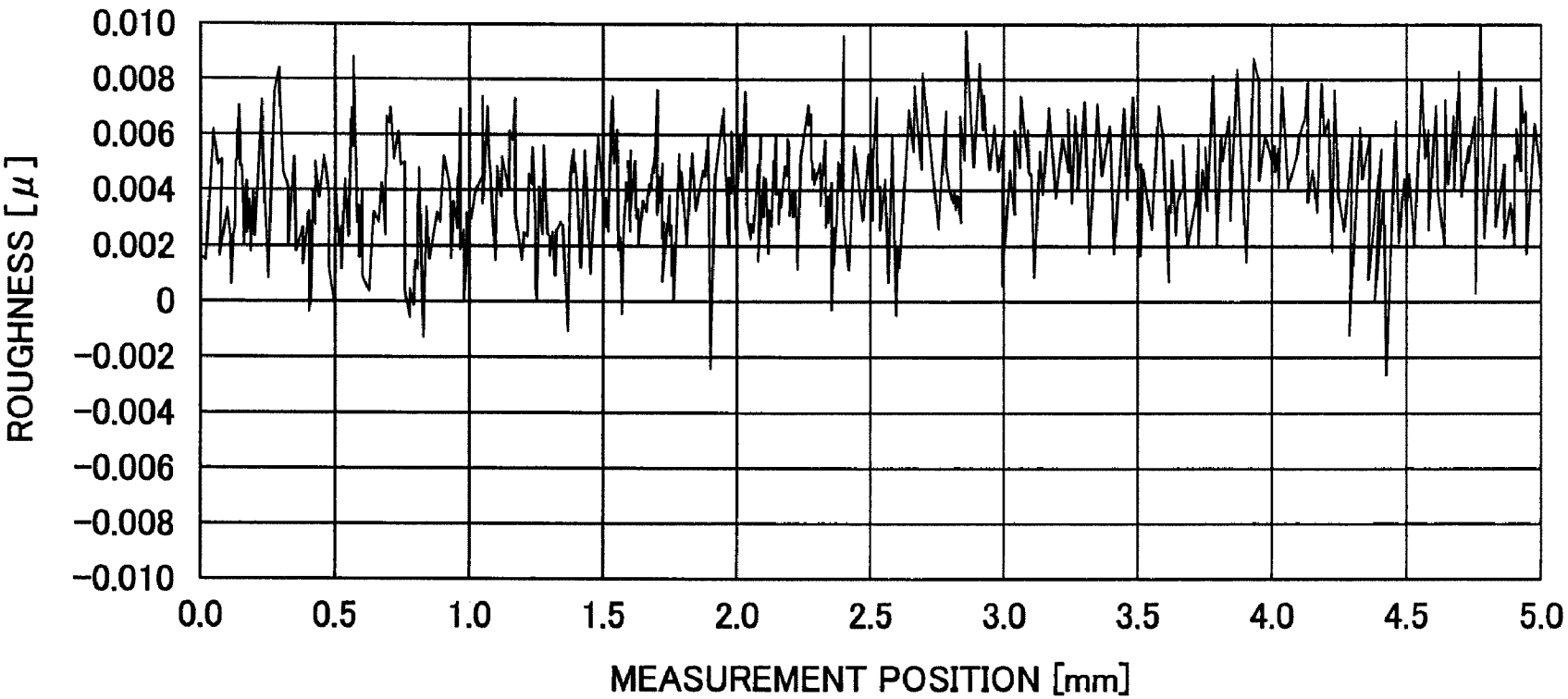
FIG. 18 is an explanatory view showing a profile curve of the outer surface of the development sleeve, to which the sand blast is provided, in a comparative example 2.

In a comparative example 2-2, the development sleeve 232 has an inner diameter of 16.5 mm and an outer diameter of 18.0 mm, and the sand blast was performed on the outer surface of the development sleeve 232. A profile curve is shown in FIG. 18.

(The Invention's Product)

In the invention's product, the development sleeve 232 has an inner diameter of 16.5 mm and an outer diameter of 18.0 mm, and the surface roughening treatment was performed on the outer surface of the development sleeve 232 by the mentioned surface treatment device 251 where the wire member 286 having an outer diameter of 0.8 mm and a length of 5 mm, that is a volume of 2.5 mm3 are hit randomly on the outer surface of the development sleeve 232. A profile curve is shown in FIG. 12.

In the above-mentioned comparative example 2-1, 2-2 and the invention's product, the interval between the development sleeve 232 and the photo conductive drum 208 is set as 0.3 mm, and the developer 226 which has the magnetic carrier 235 having the outer diameter of 235 μm is used. Moreover, in the comparative example 2-2 and the invention's product, the Ten-Point Height of Roughness (Rz) of the outer surface of the development sleeve 232 is set as 10 μm.

Figure 19:
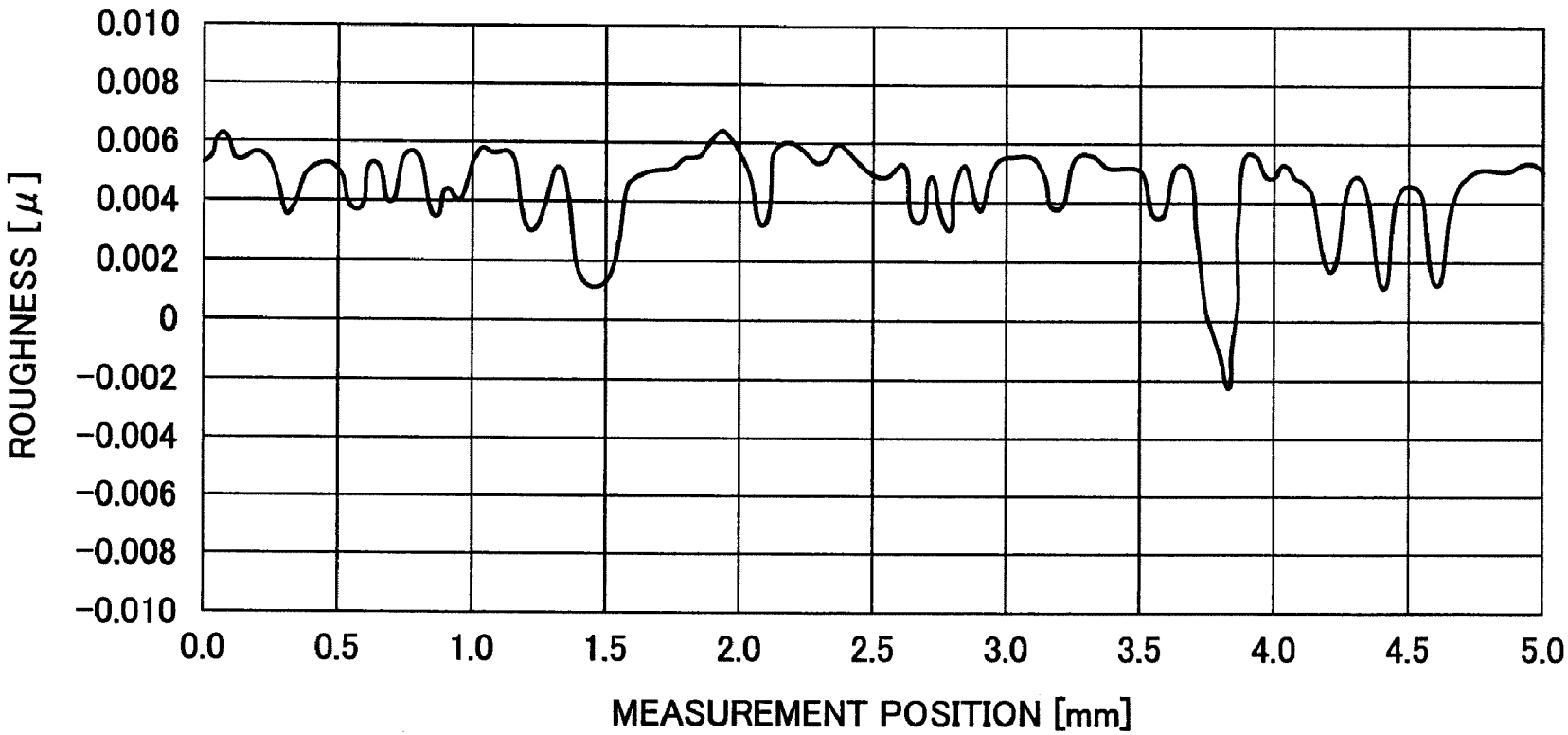
FIG. 19 is an explanatory view showing the profile curve of the outer surface of the development sleeve which is the invention's product.

According to FIGS. 18 and 19, it is found that the depressions 239 of a surface of the invention's product are smoother than that of the comparative example 2-2. In addition, an evaluation standard in TABLE 2 means 'Very Excellent' for the concave and convex portions which is very excellent, 'Excellent' for the concave and convex portions which can be used in a practice, and 'Poor' for the concave and convex portions which can be used and permitted in practical use but has less quality, and 'Very Poor' for the concave and convex portions which cannot be used in a practice and has much less quality.

According to TABLE.2, at the initial state, it is found that large amount is picked up in all cases and very excellent qualities of the images are obtained in the case of the comparative example 2-2 and the invention's product. Moreover, it is observed that the less quality of image in the comparative example 2-1 is less without a problem of the practical use.

On the contrary, after continuous uses, it is found that smaller amount is picked up than that at initial states in all cases and the images are much inferior in quality in the case of the comparative example 2-1 and 2-2 with the problem of the practical use. On the other hand, the invention's product provides the image which has an excellent quality without the problem of the practical use.

As mentioned above, as the invention's product, it is found that the surface roughening treatment which is performed on the development sleeve 232 as the change of the area of the developer 226 attached on the outer surface of the development sleeve 232 viewed from the outer peripheral side thereof in relation to the change of attached amount of the developer 226 to the development sleeve 232 ranges from 0% to 30%, by hitting randomly the wire member 286 allows high-quality images to be obtained over the long term.

Figure 20:
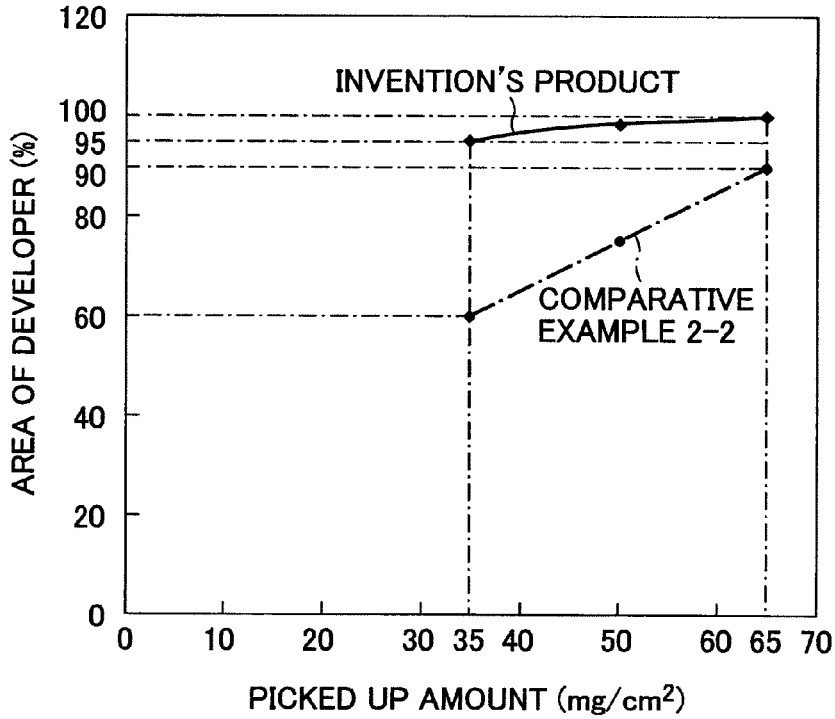
FIG. 20 is an explanatory view showing change in an area of the developer to changes in picked up amounts of the developer in the invention's product and the comparative example 2.

Furthermore, the inventors of the present invention measured a change of the area of the developer 226 viewed from the outer peripheral side of the development sleeve 232 according to variation on purpose in the above-mentioned comparative example 2-2 and the invention's product of an amount of the picked-up developer. The result is shown in FIG. 20. In addition, a horizontal axis in FIG. 20 indicates the amount of the picked-up developer 226. A vertical axis in FIG. 20 indicates the above-mentioned area of the developer 226 attached on the outer surface of the development sleeve 232 as the amount of the picked-up developer 226 of 65 mg/cm2 corresponds to 100%.

According to FIG. 20, it is found that the area of the developer 226 becomes lower by 35% as the picked-up amount decreases about 50% in the comparative example 2-2. On the other hand, it is found that even if the picked-up amount decreases about 50%, the area of the developer 226 decreases only about 5% in the invention's product. That is, it is found that the change of the above-mentioned area of the developer 226 in relation to the change of the picked-up amount, that is to say, of the attached amount of the developer 226 ranges within 20%.

Figure 21:
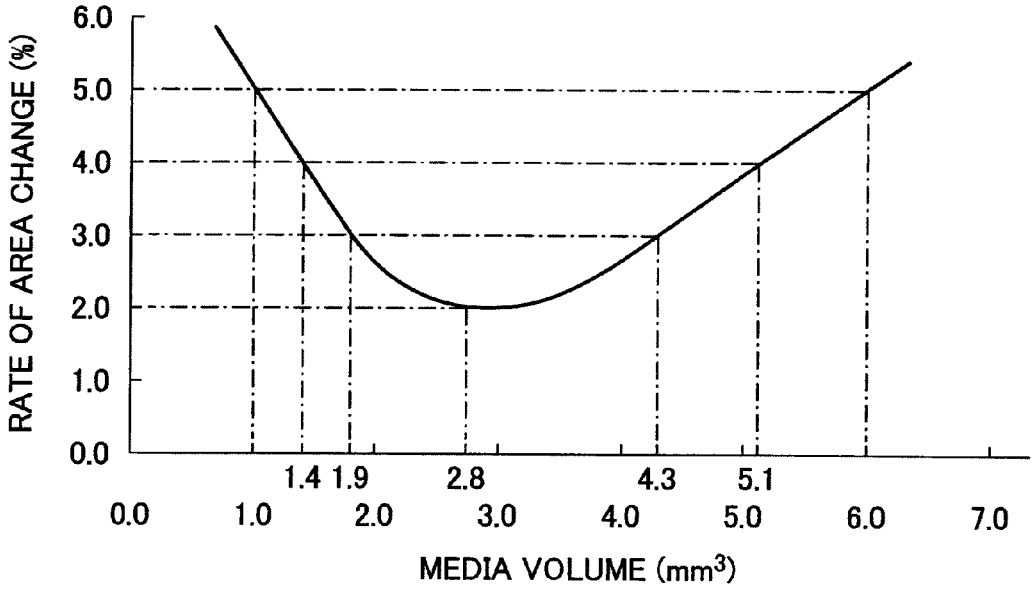
FIG. 21 is an explanatory view showing change in an area of the developer to change in a volume of the wire member in the invention's product.

Furthermore, the inventors of the present invention measured a rate of change of the above-mentioned area of the developer 226 attached on the outer surface of the development sleeve 232 according to variation of a volume of the wire member 286 in the above-mentioned invention. The result is shown in FIG. 21. A horizontal axis in FIG. 21 indicates the volume of the wire member 286, and a vertical axis in FIG. 21 indicates the rate of change of the above-mentioned area of the developer 226.

According to FIG. 21, it is found that the volume of the wire member 286 ranging from 1.0 $mm^3$ to 6.0 $mm^3$ allows the above-mentioned area change of the developer 226 to keep within 5%, and the quality of the image to be controlled against degradation with ages. In addition, according to FIG. 21, it is found that the volume of the wire member 286 ranging from 1.4 mm3 to 5.1 mm3 allows the above-mentioned area change of the developer 226 to keep within 4%, and the quality of the image to be controlled against degradation with ages.

Furthermore, according to FIG. 21, it is found that the volume of the wire member 286 ranging from 1.9 mm3 to 4.3 mm3 allows the above-mentioned area change of the developer 226 to keep within 3%, and the quality of the image to be controlled against degradation with ages. In addition, according to FIG. 21, it is found that the volume of the wire member 286 to be 2.8 mm3 allows the above-mentioned area change of the developer 226 to keep within 2%, and the quality of the image to be even controlled against degradation with ages.

Moreover, the toner which has an average diameter ranging from 3 μm to 7 μm is used in the present invention. The toner which has the average diameter of over 7 μm causes the quality of the image to be degraded, and the toner which has the average of less than 3 μm causes the toner to be removed from the magnetic carrier and the toner scattering to be easy to occur.

Moreover, the inventor of the present invention produced the various development sleeves 232 which have different roughness of the outer surfaces from each other, and formed images by the development sleeves 232. The result is shown in FIGS. 22 and 23.

Figure 22:
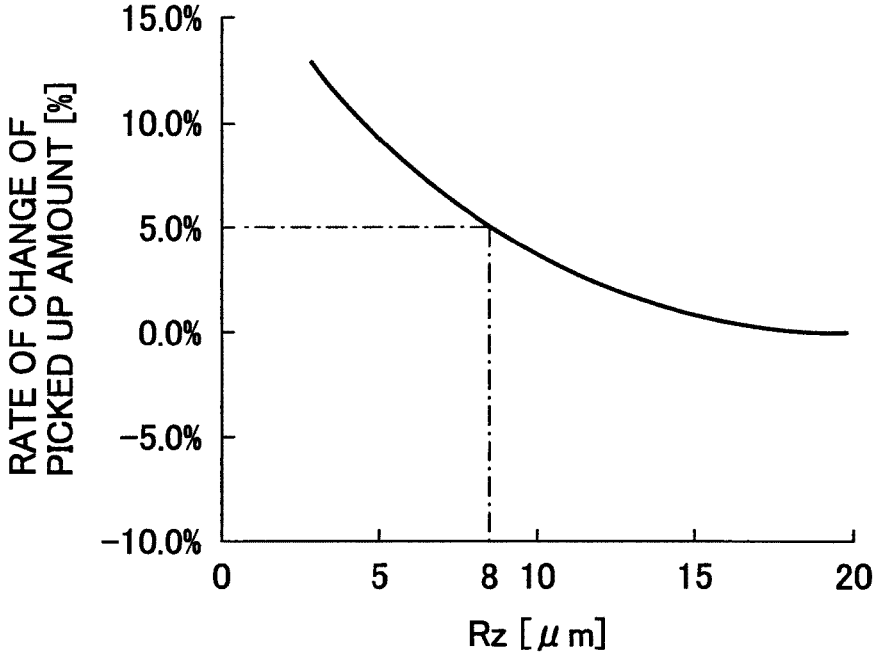
FIG. 22 is an explanatory view showing change in a picked up amount of the developer when changing the roughness of the outer surface of the development sleeve according to the present invention.
Figure 23:
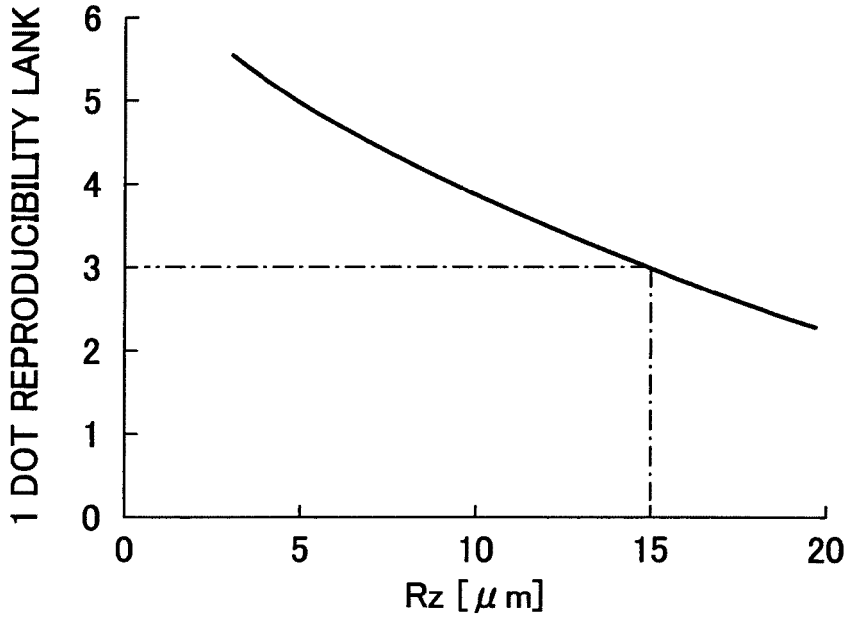
FIG. 23 is an explanatory view showing change in one (1) dot reproducibility rank when changing the roughness of the outer surface of the development sleeve according to the present invention.

A horizontal axis in FIGS. 22 and 23 indicates a surface roughness of the outer surface of the development sleeve 232. A vertical axis in FIG. 22 indicates the change of the amount of the picked-up developer 226 of the development sleeve 232. A vertical axis in FIG. 23 indicates a lank of one dot reproducibility (an indicator indicates how well one dot image can be developed).

According to FIG. 22, it is found that the surface roughness of the outer surface of the development sleeve 232 is set in more than 8 μm so that the change of the picked-up amount of the developer 226 can range within 5%. It is found that the surface roughness of the outer surface of the development sleeve 232 is set in less than 8 μm so that the change of the picked-up amount of the developer 226 can range over 5%.

According to FIG. 23, it is found that the surface roughness of the outer surface of the development sleeve 232 which is set in 15 μm or less causes the lank of the one dot reproducibility to be kept in 3 or more and the high-quality image to be obtained. It is found that the surface roughness of the outer surface of the development sleeve 232 which is set over 15 μm or more causes the lank of the one dot reproducibility to be decreased under 3 or more and the high-quality image not to be obtained.

Therefore, the surface roughness of the outer surface of the development sleeve 232 which ranges from 8 μm to 15 μm allows the change of the picked-up amount of the developer 226 to be control and the high-quality images can be obtained over the long term.

Furthermore, in the present invention, the surface treatment device 251 generates the rotational magnetic field shown in FIG. 13A. However, in the present invention, various surface treatment devices can be used instead of the surface treatment devices generating the rotational magnetic field. In fact, in the present invention, the surface roughening treatment may be performed by hitting wire member the above-mentioned volume thereof on the outer surface of the development sleeve 232.

In the above-mentioned embodiment, each of the process cartridges 206Y, 206N, 206C, and 206K includes the cartridge case 211, the charged roller 206, the photo conductive drum 208, the cleaning blade 212, and the development device 21. However, in the present invention, each of the process cartridges 206Y, 206N, 206C, and 206K is required to include at least the development device 21, and is not required to include the cartridge case 211, the charged roller 206, the photo conductive drum 208, and the cleaning blade 212. Moreover, in the above-mentioned embodiment, the image forming apparatus 201 includes the process cartridges 206Y, 206N, 206C, and 206K which are mounted detachably on the main body 202. However, in the present invention, the image forming apparatus is required to include the development device, but it is not required to include the process cartridges 206Y, 206N, 206C, and 206K.

A third embodiment of the present invention is described as follows. It is preferable that the development sleeve 232 according to the third embodiment of the present invention is formed in an outer diameter of about from 17 mm to 18 mm. It is preferable that the development sleeve 232 has a length in an axis ranging from 300 mm to 350 mm. The surface roughness of the outer surface of the development sleeve 232 becomes gradually large from the central portion toward the both ends of the development sleeve 232 in the direction of the axis.

Figure 29:
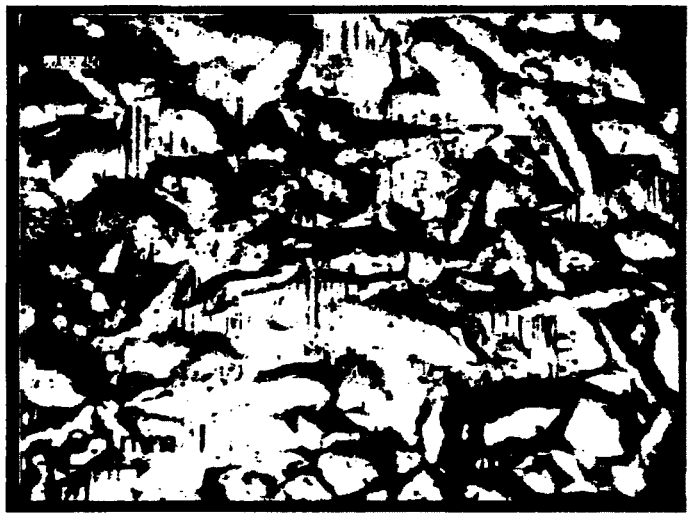
FIG. 29 is an explanatory view showing an enlarged outer surface of the development sleeve as shown in FIG. 11.
Figure 30:
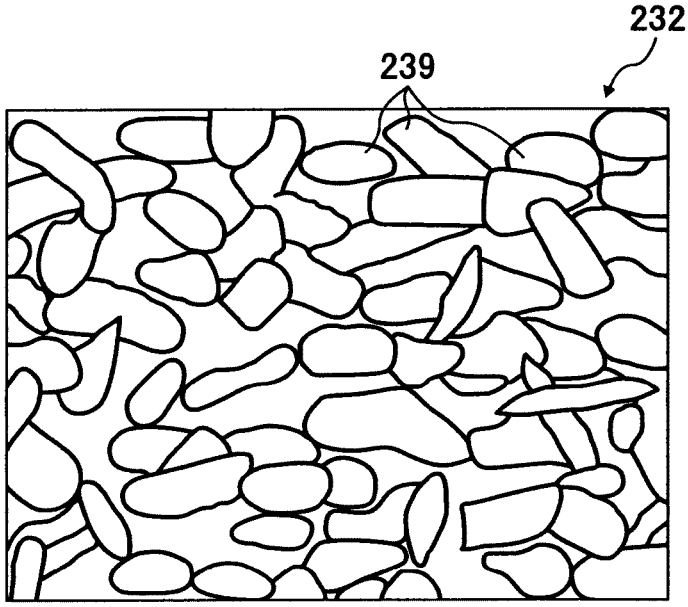
FIG. 30 is an explanatory view schematically showing the outer surface of the development sleeve as shown in FIG. 29.

Moreover, a plurality of depressions 239 which are formed in an elliptical shape in plane is mounted on the outer surface of the development sleeve 232 as shown in FIGS. 29 and 30. The plurality of depressions 239 are randomly disposed on the outer surface of the development sleeve 232. Of course, the depressions 239 contain depressions 239 where a longitudinal direction thereof is formed along the direction of the axis of the development sleeve 232 and depressions where the longitudinal direction thereof is formed along a circumferential direction of the development sleeve 232. The depressions 239 where the longitudinal direction thereof is formed along the direction of the axis of the development sleeve 232 are more than the depressions 239 where the longitudinal direction thereof is formed along a circumferential direction of the development sleeve 232. In addition, a length in a longitudinal direction of the depressions 239 ranges from 0.05 to 0.3, and a length in a width direction ranges from 0.02 mm to 0.1 mm. In addition, in FIGS. 29 and 30, a horizontal direction in the figures corresponds to the axis direction of the development sleeve 232.

Figure 31:
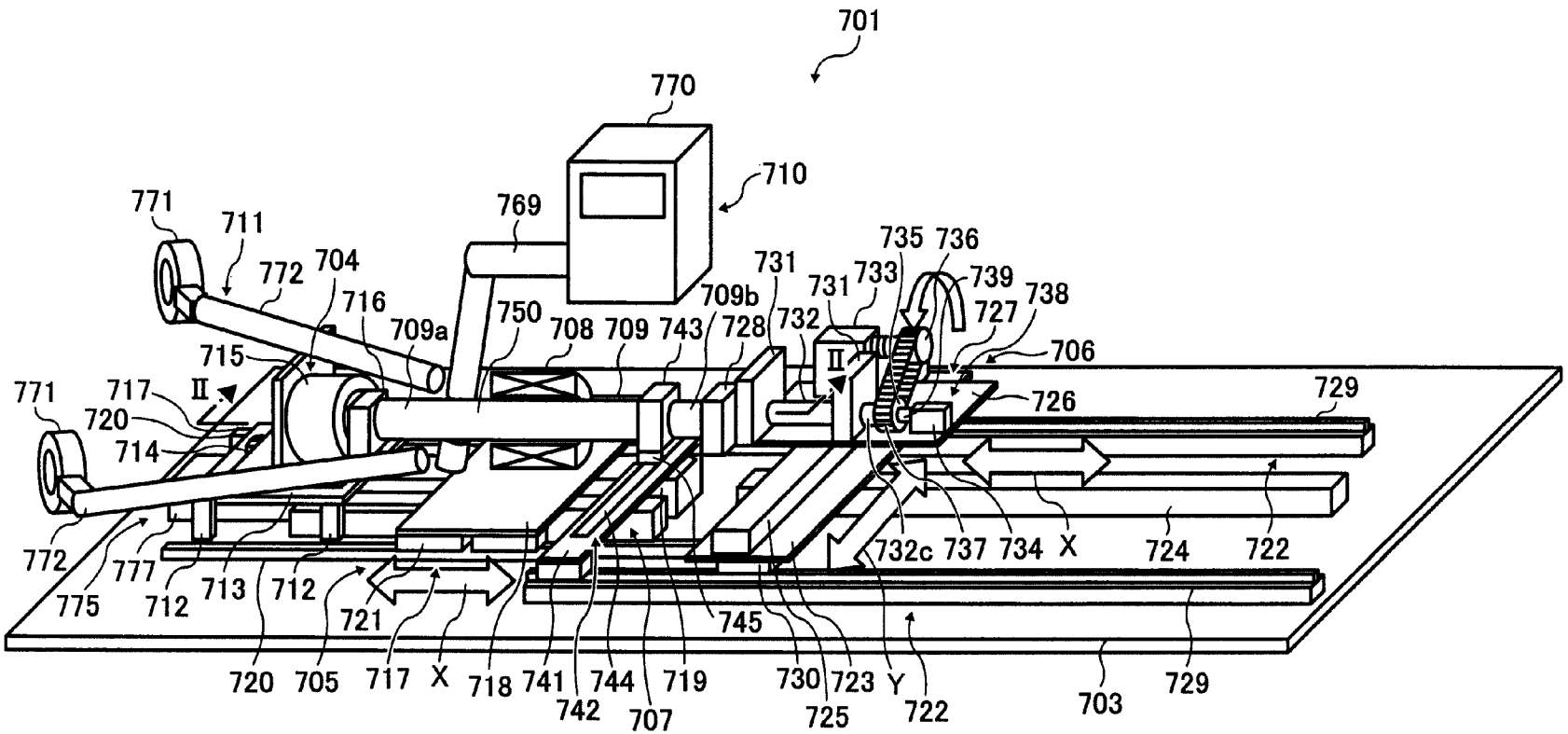
FIG. 31 is a perspective view showing a schematic structure of the surface treatment device to provide the roughing treatment on the outer surface of the development sleeve as shown in FIG. 11.
Figure 32:
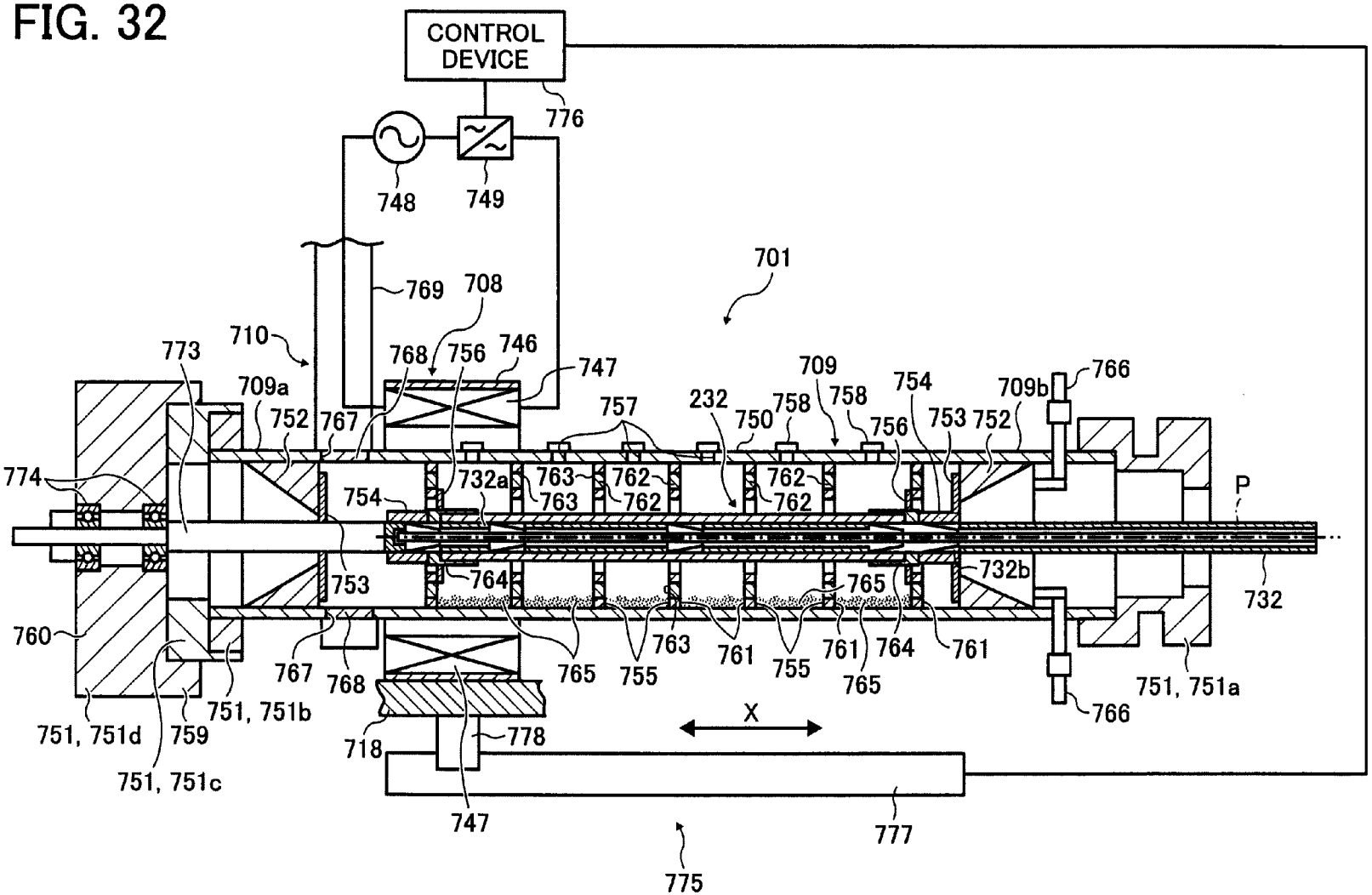
FIG. 32 is a sectional view taken along line II-II in FIG. 31.

The surface roughening treatment is performed on the outer surface of the above-mentioned development sleeve 232 by the surface treatment device 701 shown in FIGS. 31 and 32.

The surface treatment device 701 includes a base 703, a fixing holding portion 704, a moving electro-magnetic coil portion 705 as moving means, a moving holding portion 706, a moving chuck portion 707, a electro-magnetic coil 708 as magnetic field generating means, and a containing tank 709, a collection portion 710, a cooling portion 711, a linear encoder 775 as detection means, and a control device 776 as control means (see FIG. 32) as shown in FIG. 31.

The base 703 is formed in a tabular shape and mounted on a floor of a factory, on a table, and so on. An upper surface of the base 703 is held in parallel to a horizontal direction. The base 703 is formed in a rectangular shape in plane.

The fixing holding portion 704 includes a plurality of supports 712 raised from an end of the base 703 in a longitudinal direction (hereinafter, shown by an arrow X), a holding base 713, a standing mounted bracket 714, a cylindrical holding member 715, and a holding chuck 716.

The holding base 713 is formed in a tabular shape and mounted on a top of the support 712. The standing mounted bracket 714 is formed in a tabular shape and raised from the holding base 713. The cylindrical holding member 715 is formed in a cylindrical shape and mounted on the standing mounted bracket 714 and the holding base 713. The cylindrical holding member 715 is disposed as an axis thereof is in parallel to both of a horizontal direction and the arrow X, and as to be situated nearer the central portion of the base 703 in relation to the standing mounted bracket 714. The cylindrical holding member 715 contains inside mentioned-bellow flange members 751*b*, 751*c*, 751*d* (that is, an end 709*a*) which are mounted on a mentioned-bellow the end 709*a* of the containing tank 709.

The holding chuck 716 is disposed near the above-mentioned cylindrical holding member 715, that is the holding base 713, and mounted on the above-mentioned base 703. The holding chuck 716 chucks the containing tank 709 which has the end 709*a* contained in the cylindrical holding member 715 to hold the end 709*a* of the containing tank 709. The fixing holding portion 704 configured as mentioned above holds the end 709*a* of the containing tank 709

The moving electro-magnetic coil portion 705 includes a pair of a linear guide 717, the electro-magnetic coil holding base 718, and a driving electro-magnetic coil actuator 719. The linear guide 717 includes a rail 720 and a slider 721. The rail 720 is mounted on the base 703. The rail 720 is formed in a linear shape and disposed as a longitudinal direction of the rail is in parallel to the longitudinal direction of the base 253, that is the arrow X. The slider 721 is supported on the rail 720 to be capable of moving along the longitudinal direction of the rail 720, that is to say, of the base 253. The pair of linear guides 717 is disposed with an interval therebetween as the rail 720 moves along a width direction (hereinafter, shown by an arrow Y) of the base 703. In addition, the arrow X, the arrow Y, and are in a direction perpendicular to each other, and both ends are in parallel to the horizontal direction.

The electro-magnetic coil moving base 718 is formed in a tabular shape and mounted on the above-mentioned slider 721. The upper portion of the upper surface of the electro-magnetic coil holding base 718 is disposed in a parallel to the horizontal direction. The electro-magnetic coil 708 is mounted on the outer surface of the electro-magnetic coil holding base 718. The moving electro-magnetic coil actuator 719 is mounted on the base 703, and moves to slide the above-mentioned electro-magnetic coil holding base 718 along the arrow X. The above-mentioned electro-magnetic coil moving portion 705 moves to slide the electro-magnetic coil holding base 718, that is to say, the electro-magnetic coil 708 along the arrow Y by the moving electro-magnetic coil actuator 719. Moreover, a moving velocity of the electro-magnetic coil 708 by the electro-magnetic coil moving portion 705 can be modified ranging within from 0 mm/s to 300 mm/s. In addition, a moving range of the electro-magnetic coil 708 of the electro-magnetic coil moving portion 705 is about 600 mm.

The moving holding portion 706 includes a pair of linear guides 722, a holding base 723, a first actuator 724, a second actuator 725, a moving base 726, a roller bearing rotational base 727 and a holding chuck 728.

The linear guides 722 include a rail 729 and slider 730. The rail 729 is provided on the base 703. The rail 729 is formed in a linear shape and disposed as a longitudinal direction of the rail is in parallel to a longitudinal direction of the base 703. The slider 730 is supported on the rail 729 to be capable of moving along the longitudinal direction of the rail 729, that is to say, of the arrow X. The rail 729 is disposed on the pair of linear guides 722 with an interval in a direction of the arrow Y, that is to say, a width direction of the base 703 from each other.

The holding base 723 is formed in a tabular shape and mounted on the above-mentioned slider 730. The upper surface of the holding base 723 is disposed in parallel to the horizontal direction. The first actuator 724 is mounted on the base 703 and moves to slide the above-mentioned holding base 723 along the arrow X.

The second actuator 725 is mounted on the holding base 723 and moves to slide the moving base 726 along the arrow Y. The moving base 726 is formed in a tabular shape and an upper surface of the moving base 726 is disposed in parallel to the horizontal direction.

The roller bearing rotational portion 727 includes a pair of roller bearings 731, a midair holding member 732 as an axis, a driving motor 733 as rotating means, and a chuck cylinder 734. The pair of roller bearings 731 are disposed along the arrow X with an interval from each other and mounted on the moving base 726. The midair holding member 732 is comprised of magnetic materials, formed in a cylindrical shape, and supported to be capable of rotating about the axis by the above-mentioned roller bearings. The midair holding member 732 is disposed in parallel to the above-mentioned arrow X, that is to say, the axis of the cylindrical holding member 715 of the fixing holding portion 704. The midair holding member 732 is disposed in a form to be projected from an upside of the moving base 726 toward the fixing holding portion 704 as an end 732*a* of the midair holding member 270 is positioned in the containing tank 709, and as an other end 732*c* of the midair holding member 270 is positioned on an upside of the moving base 726. The midair holding member 732 passes through the cylindrical development sleeve 232 as shown in FIG. 9. In addition, a pulley 735 is fixed on the other end 732*c* positioned on the moving base 726 of the midair holding member 732. The pulley 735 is disposed with an axis of the midair holding member 732.

The driving motor 733 is mounted on the moving base 726 and a pulley 736 is mounted on an output axis of the driving motor 733. An axis of the output axis of the driving motor 733 is in parallel to the arrow X. An endless timing belt 737 is tacked across the above-mentioned pulley 735, 736. The driving motor 733 rotates the midair holding member 732 about an axis. The driving motor 733 rotates the development sleeve 232 about the axis of the midair holding member 732 which is in parallel to the longitudinal direction of the containing tank 259, that is the axis of the development sleeve 232 by rotating the midair holding member 732 about an axis.

The chuck cylinder includes a cylinder body 738 which is provided on the moving base 726 and a chuck shaft 739 which is provided to be capable of sliding on the cylinder body 738. The chuck shaft 739 is formed in a cylindrical shape and disposed as a longitudinal direction of the chuck shaft is in parallel to the arrow X. The chuck shaft 739 is contained in the midair holding member 732 and disposed with an axis of the midair holding member 732. A plurality of chuck claws pair 740 is mounted on the chuck shaft 739.

The pair of chuck claws 740 is mounted on the chuck shaft 739 in a shape to be projected from a outer surface of the chuck shaft 739 toward a circumferential side of the chuck shaft 739. The chuck claws 740 are capable of being projected from the outer surface of the midair holding member 732 toward the circumferential side of the midair holding member 732. The chuck claws 740 are provided to be capable of modifying a length of projected part from the chuck shaft 739 and the midair holding member 732. As the chuck shaft of chuck cylinder for the chuck contracts to approach, a plurality of pairs of chuck claws 740 is disposed along the longitudinal direction of the above-mentioned chuck shaft 739, that is to say, the arrow X with intervals from each other. The pair of chuck claws 740 causes the length of the part projected from the above-mentioned chuck shaft 739 and the midair holding member 732 to increase when the chuck shaft 739 of the chuck cylinder 734 contracts to be close to the cylinder body 738.

The above-mentioned chuck cylinder 734 causes the chuck claws 740 to be projected more to a circumferential side of the chuck shaft 739 as the chuck shaft 739 contracts the cylinder body 738, thereby fixing the chuck shaft 739, the midair holding member 732, and the development sleeve 232 by compressing the chuck claws 740 onto an inner circumference of the development sleeve 232 mounted on an outer circumference of the midair holding member 732. Here, the chuck shaft 739 is with same axis as that of the midair holding member 732, the development sleeve 232, and a mentioned-below cylindrical member 750, that is the containing tank 709.

In other words, the above-mentioned chuck cylinder fixes the chuck shaft 739, the midair holding member 732, and the development sleeve 232 by compressing the chuck claws 740 onto an inner circumference of the development sleeve 232 mounted on an outer circumference of the midair holding member 732.

The above-mentioned chuck cylinder 734 and the chuck claws 740 support the development sleeve 232 as an axis thereof is the same as that of the midair holding member 732 and the containing tank 709. That is, the chuck cylinder 734 and the chuck claws 740 support the development sleeve 232 at a center of the containing tank 709. The above-mentioned chuck cylinder 734 and the midair holding member 732 740 are adapted to form the holding mechanism.

The holding chuck 728 is disposed on the above-mentioned moving base 726. The holding chuck 728 chucks a mentioned-below flange members 751*a* which is mounted on an end 709*b* of the containing tank 709 to hold the end 709*b* of the containing tank 709. The holding chuck 728 controls to rotate the containing tank 709 about the axis thereof.

The moving holding portion 706 configured as mentioned above moves the holding chuck 728 and the midair holding member 732 along the arrows X and Y being at right angles to each other by the actuators 724, 725. That is, the moving holding portion 706 moves the containing tank 709 held by the holding chuck 706 along the arrows X and Y.

The moving chuck portion 707 includes the holding base 741, the linear guide 742, and the holding chuck 743. The holding base 741 is fixed on an end of the rail 729 of the linear guide 722 which is close to the fixing holding portion 704. The holding base 741 is formed in a tabular shape and has an upper surface which is disposed in parallel to the horizontal direction.

The linear guide 742 includes a rail 744 and a slider 745. The rail 744 is mounted on the holding base 741. The rail 744 is formed in a linear shape and disposed as a longitudinal direction of the rail 744 is in parallel to the arrow Y, that is to say, a width direction of the base 703. The slider 745 is supported on the rail 744 to be capable of moving along the arrow Y, that is to say, the longitudinal direction of the rail 744.

The holding chuck 743 is mounted on the slider 745. The holding chuck 743 is positioned between the above-mentioned holding chuck 716 and 728. The holding chuck 743 chucks a part which is close to another end 729*b* of the containing tank 709 to hold the containing tank 709. The holding chuck 743 holds the containing tank 709 so that the above-mentioned moving chuck portion 707 allows the containing tank 709 to be positioned. In addition, the holding chuck 743 holds the containing tank 709 so that the moving chuck portion 707 holds the containing tank 709 to prevent the containing tank 709 from separating from the roller bearing rotational portion 727, that is to say, the surface treatment device 701 in cooperation with the above-mentioned holding chuck 728 when the containing tank 709 moves along thereof.

The electro-magnetic coil 708 includes an outer coat 746 formed in a cylindrical shape and plurality of coil portions 747 disposed in the outer coat 746, and is formed in an annular shape entirely, as shown in FIG. 32. An inner diameter of the electro-magnetic coil 708 is larger than an outer diameter of the containing tank 709. That is, a space is formed between an inner circumferential surface of the electro-magnetic coil 708 and an outer surface of the containing tank 709. In addition, an entire length of the electro-magnetic coil 708 in an axis direction is enough shorter than an entire length of the containing tank 709 in an axis direction. Moreover, it is preferable that the entire length of the electro-magnetic coil 708 in an axis direction is ⅔ of the entire length of the containing tank 709 in an axis direction or shorter. In an illustrated embodiment, the inner diameter of the electro-magnetic coil 708 is 90 mm and the length of the electro-magnetic coil in the axis direction is 85 mm.

The outer coat 746 is mounted on the above-mentioned electro-magnetic coil holding base 718 as an axis of the outer coat 746, that is to say, of the electro-magnetic coil itself is in parallel to the arrow X. The electro-magnetic coil is disposed with the same axis as the axis of the midair holding member 732, the chuck shaft 739, and the containing tank 709. The plurality of coil portions 747 is disposed in parallel to each other along a circumference direction of the outer coat 746, that is to say, the electro-magnetic coil 708. The coil portion 747 of each of the coil portions is impressed by a three-phase alternating-current source 748 shown in FIG. 32. An electrical power which has phases deviated from each other is impressed on the plurality of coil portions 747, and the plurality of coil portions 747 generates magnetic fields which have phases deviated from each other. Then, the electro-magnetic coil 708 generates a magnetic field (rotational magnetic field) rotating in a rotational direction about an axis of the electro-magnetic coil 708 which is formed by conflating these magnetic fields in an inner side of the electro-magnetic coil 708.

The above-mentioned electro-magnetic coil 708 is impressed by the three-phase alternating-current source 748 to generate the rotational magnetic field and to be moved by the electro-magnetic coil moving portion 705 along an longitudinal direction thereof, that is to say, the longitudinal direction of the containing tank 709. Then, the electro-magnetic coil 708 positions the wire member 765 contained in the containing tank 709 in the outer circumference of the development sleeve 232 by the above-mentioned rotational magnetic field and rotates (moves) the wire member 765 about the axis of the containing tank 709 and the development sleeve 232. And then, the electro-magnetic coil 708 hits the wire member 765 moved by the above-mentioned rotational magnetic field on the outer surface of the development sleeve 232.

Moreover, an inverter 749 as magnetic field modifying means is provided between the three-phase alternating-current source 748 and the electro-magnetic coil 708. That is, the surface treatment device 701 includes the inverter 749 as magnetic field modifying means. The inverter 749 is capable of modifying a frequency, a current value, and a voltage value of the electrical power impressed by the three-phase alternating-current source 748 on the electro-magnetic coil 708. The inverter 749 adjusts the electrical power impressed by three-phase alternating-current source 748 on the electro-magnetic coil 708 to modify an intensity of the rotational magnetic field generated by the electro-magnetic coil 708 by modifying the frequency, the current value, and the voltage value of the electrical power impressed on the electro-magnetic coil 708.

The containing tank 709 includes the cylindrical member 750 which has an outer wall formed in a single structure (that is, the outer wall is formed by a single wall), a plurality of flange members 751, a lopped waste sealing holders 752, a pair of lopped waste sealing blades 753, a pair of position members 754, the plurality of partition members 755 as partition means, and a pair of sealing blades 756 as shown in FIG. 32.

The cylindrical member 750 is formed in a cylindrical form and comprises an outer shell of the containing tank 709. Thereby, the containing tank 709 is formed in a single structure so that the outer wall of the cylindrical member 750 is formed in a single structure as well as in a cylindrical shape. It is preferable that an outer diameter of the cylindrical member 750, that is to say, of the containing tank 709 ranges about from 40 mm to 80 mm. Moreover, it is preferable that a wall thickness of the cylindrical member 750 ranges about from 0.5 mm to 2.0 mm. It is preferable that a length of the cylindrical member 750 in an axis direction ranges about from 600 mm to 800 mm. The cylindrical member 750 is configured by non magnetic materials.

A plurality of grain supplying holes 757 is provided on the cylindrical member 750. The grain supplying hole 757 passes through the cylindrical member 750 to communicate with an inside and an outside of the cylindrical member 750. A sealing cap 758 is mounted on the grain supplying hole 757. The grain supplying hole 757 lets the wire member 765 into an inside thereof, and take the wire member 765 in and out of the cylindrical member 750, that is to say, the containing tank 709. In addition, the sealing cap 758 covers the grain supplying hole 757 and controls the wire member 765 to flow out of an outside of the cylindrical member 750, that is to say the containing tank 709.

The plurality of flange members 751 is formed in an annular shape or a cylindrical shape. Most of the plurality of flanges 751 except one of them (it is three at the illustrated embodiment) is mounted on the end 709*a* of the cylindrical member 750, and a flange member 751 (hereinafter, shown by 751*a*) is mounted on the other end 709*b* of the cylindrical member 750.

A flange member 751 (hereinafter, shown by 751*b*) of the plurality of flange members 751 mounted on the end 709*a* of the cylindrical member 750 is formed in an annular shape and engaged with an outer circumference of the cylindrical member 750. Another one flange member 751 (hereinafter, shown by 751*c*) is formed in an annular shape and engaged with an outer circumference of the above-mentioned flange member 751*b*. The other flange members 751 (hereinafter, shown by 751*d*) include an annular ring portion 759 together with a cylindrical portion 760. The ring portion 759 is formed in a raised shape from an outer edge of the cylindrical portion 760. The flange member 751*d* has the ring portion engaged with an outer circumference of the flange member 751*c*.

A driven shaft 773 is supported on the above-mentioned flange member 751*d* to be capable of rotating by a roller bearing 774. The driven shaft 773 is formed in a cylindrical shape and disposed with the same axis as the axis of the cylindrical member 750 of the containing tank 709. The midair holding member 732 is compressed on an end surface of the driven shaft 773. The driven shaft 773 rotates with the midair holding member 732 and supports an end 732*a* as a free end of the midair holding member 732.

The above-mentioned flange member 751*a* is formed in an annular shape and engaged with an outer edge of the other end 709*b* of the cylindrical member 750. The flange member 751*a* lets the midair holding member 732 inside thereof. In addition, The end 709*a* of the cylindrical member 750 forms an end of the containing tank 709 and the other end 709*b* of the cylindrical member 750 forms the other end of the containing tank 709.

Each of the pair of lopped waste sealing holders 752 is formed in an annular shape. One lopped waste sealing holder 752 is engaged with an inner circumference of the end 709*a* of the cylindrical member 750, and another lopped waste sealing holder 752 is engaged with an inner circumference of the other end 709*b* of the cylindrical member 750. The other lopped waste sealing holder 752 lets the midair holding member 732 inside thereof.

Each of the pair of lopped waste sealing blades 753 is formed in a mesh shape. One lopped waste sealing blade 753 is formed in a disc-like shape and disposed on an inner circumference of the end 709*a* of the cylindrical member 750 as well as mounted on the one lopped waste sealing holder 752 mentioned above. In addition, the one lopped waste sealing blade 753 lets the driven shaft 773 inside thereof. The other lopped waste sealing blade 753 is formed in an annular shape and disposed on the inner circumference of the other end 709*b* of the cylindrical member 750 as well as mounted on the other lopped waste sealing holder 752 mentioned above. The other lopped waste sealing blade 753 lets the midair holding member 732 inside thereof. The lopped waste sealing blade 753 allows the mentioned-bellow wire member 765 to be hit on the outer surface of the development sleeve 232 thereby controlling lopped waste formed to be lopped from the development sleeve 232 to be escaped into an outside of the cylindrical member 750, that is to say, the containing tank 709.

The pair of position members 754 is formed in a cylindrical shape. A position member 754 is engaged with an outer circumference of the end 732*a* which is a free end of the midair holding member 732. Another position member 754 is engaged with an outer circumference of a central portion 732*b* of the midair holding member 732 which is positioned in the cylindrical member 750 and is close to the other end 709*b*. The pair of position members 754 pinches the development sleeve 232 therebetween, and positions the development sleeve on the midair holding member 732. In addition, the end 732*a* forms an end which is close to the fixing holding portion 704 of the midair holding member 732 is away from the moving holding portion 706. The central portion 732*b* forms an end which is away from the fixing holding portion of the midair holding member 732 and is close to the moving holding portion 706 in the containing tank 709.

The partition member 755 includes the body portion 761 formed in an annular shape, and a mesh portion 762. The body portion 761, that is to say, the partition member 755 is engaged with an inner circumference of the cylindrical member 750 to be mounted on the cylindrical member 750 as well as to let the midair holding member 732 inside thereof. The body portion 761, that is to say, the plurality of partition members 755 is disposed between the pair of lopped waste sealing blade 753. In addition, the body portion 761, that is to say, the plurality of partitions 755 is disposed in parallel with intervals from each other along an axis P, that is to say, a longitudinal direction of the cylindrical member 750. In the illustrated embodiment, the 7 partition members 755 are used.

A penetrating hole 763 is provided on the body portion 761. The mesh portion 762 is mounted on the body portion 761 formed to cover the penetrating hole 763. The mesh portion 762 is formed in a mesh shape to allow gas and lopped waste to pass through and to control the wire member 765 to pass.

The above-mentioned plurality of partition members 755 partitions a space in the cylindrical member 750, that is to say, in the containing tank 709 along an axis of the cylindrical member 750, that is to say, of the containing tank 709, that is the axis P of the development sleeve 232. In addition, the axis P forms both of the axis of the containing tank 709 and that of the midair holding member 732 as well as forms the longitudinal direction of the containing tank 709. That is, the axis P and the longitudinal direction of the containing tank 709 are in parallel to each other. Moreover, both of the above-mentioned body portion 761 and the mesh portion 762, that is to say, the partition members 755 are configured by nonmagnetic materials.

The pair of sealing blade 756 is formed in an annular shape. Moreover, the sealing blade 756 is formed in a mesh shape and allows gas and waste to pass through as well as to control the wire member 765 to pass. Mother sealing blade 756 is mounted on each partition member 755 which is closest to the end 709*a*. The sealing blade 756 let a mentioned-below cap 764 mounted on both end of the development sleeve 232 inside of the sealing blade 756. The sealing blade 756 controls the wire member 765 positioned between the partition members 755 to pass, and controls the flow-out of the wire member 765 to an outside of the cylindrical member 750, that is to say, the containing tank 709.

The containing tank 709 configured as mentioned above contains the wire member 765 comprised of magnetic materials between the plurality of partition members 755 as well as contains the development sleeve 232 mounted on the midair holding member 732 in the cylindrical member 750. That is, the containing tank 709 contains both of the development sleeve 232 and the wire member 765. In addition, the wire members 765 are hit on the outer surface of the development sleeve 232 while rotating around the outer circumference of the development sleeve 232 by the above-mentioned rotational magnetic field. The wire member 765 hits on the outer surface of the development sleeve 232 so as to cut off a part of the development sleeve 232 therefrom thereby roughening the outer surface of the development sleeve 232.

Figure 33:
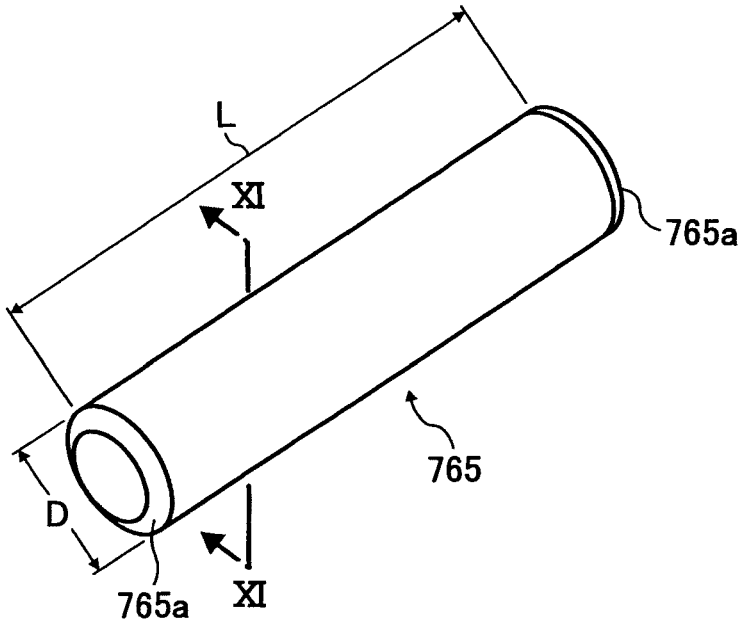
FIG. 33 is a perspective view of the wire member used in the surface treatment device as shown in FIG. 31.

The wire member 765 is comprised of magnetic materials such as for example, austenite stainless steel or martensite stainless steel. The wire member 765 is formed in a short-line and cylindrical shape as shown in FIG. 33. The wire member has an outer diameter ranging from 0.5 mm to 1.2 mm. The wire member 765 is formed in a shape where L/D ranges from 4 to 10 as L and D correspond to an entire length and an outer diameter, respectively.

Figure 34:
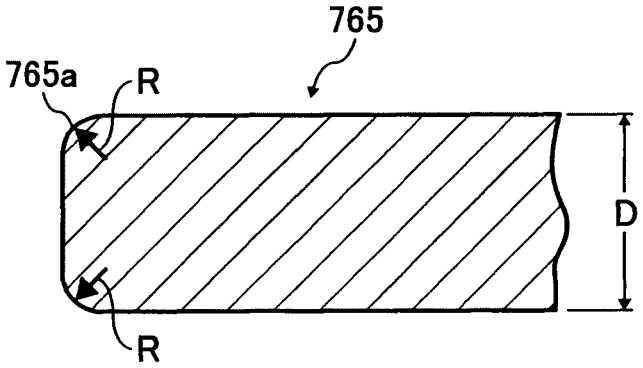
FIG. 34 is a sectional view taken along line XI-XI in FIG. 33.

Furthermore, outer edge portions of both end of the wire member 765 is chamfered in circular arc shape in section throughout the entire circumference as shown in FIGS. 33 and 34. A curvature radius R of the outer edge portion 765*a* is formed ranging from 0.05 mm to 0.2 mm.

Figure 35:
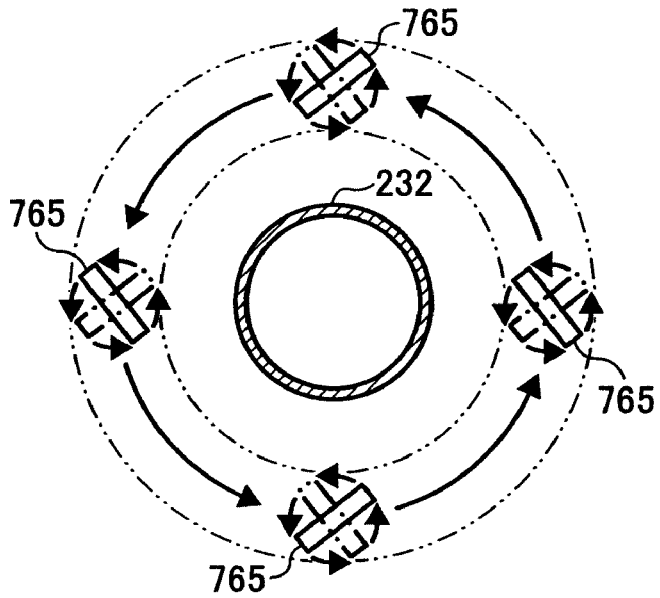
FIG. 35 is an explanatory view showing the development sleeve in the surface treatment device as shown in FIG. 31 and the wire member to orbit the outer periphery of the development sleeve, while the wire member itself rotates.

The above mentioned wire member 765 is rotated (orbited) in radial direction of the above-mentioned containing tank 709 and the development sleeve 232 while rotated (rotated on its axis) about a center of the longitudinal direction of the above-mentioned rotational magnetic field thereby as shown in FIG. 35.

The collection portion 710 includes a gas entering tube 766, a gas exhausting hole 767, a mesh member 768, a gas exhausting duct 769, and dust collection device 770 (see FIG. 31) as shown in FIG. 32. The gas entering tube 766 is provided to be close to an end of the of the cylindrical member 750, that is to say, of the containing tank 709 (the moving holding portion 706) from another lopped waste sealing holder 752 and opens into the cylindrical member 750, that is to say, the containing tank 709. Gas from pressurized gas supplying source (not shown), and so on is supplied to the gas entering tube 766. The gas entering tube 766 leads the pressurized gas into the cylindrical member 750, that is to say, the containing tank 709.

The gas exhausting hole 767 penetrates into the cylindrical member 750 to communicate with in and out of the containing tank 709 and is provided to be nearer in relation to an end of the cylindrical member 750, that is to say, of the containing tank 709 which is away from the moving holding portion 706 from the other lopped waste sealing holder 752. The mesh member 768 is mounted on the cylindrical member 750 formed to cover the gas exhausting hole 767. The mesh member 768 allows the lopped waste and gas to pass through and controls the wire member 765 to pass. The mesh member 768 controls the flow-out of the wire member 765 into the outside of the cylindrical member 750, that is to say, the containing tank 709.

The gas exhausting duct 769 is a duct work as well as is mounted adjacently the gas exhausting hole 767. The gas exhausting duct 769 surrounds the outer edge of the gas exhausting hole 767. The gas exhausting hole and the gas exhausting duct 769 leads the gas which is supplied from the gas entering tube 766 into the cylindrical member 750, that is to say, the containing tank 709 to an outside of the cylindrical member 750, that is to say, the containing tank 709.

The dust collection device 770 is connected to the gas exhausting duct 769 and sucks the gas in the gas exhausting duct 769. The dust collection device 770 sucks the gas in the cylindrical member 750, that is to say the containing tank 709 with the above-mentioned lopped waste by sucking gas in the gas exhausting duct 769. The dust collection device 770 collects the waste. The above-mentioned collection portion 710 supplies the gas into the cylindrical member 750, that is to say, the containing tank 709 through the gas entering tube 766 to lead the lopped waste to the outside of the cylindrical member 750, that is to say, the containing tank 709 through the gas exhausting hole 767 and the gas exhausting duct 769 by the gas and the dust collection device 770. And then, the collection portion 710 collects the lopped waste in the dust collection device 770.

The cooling portion 711 includes a cooling fan 771 and a cooling duct 772 as shown in FIG. 31. The cooling fan 771 supplies the pressurized gas to the cooling duct 772. The cooling duct 772 is a duct. The cooling duct 772 leads the pressurized gas supplied from the cooling fan 771 to the electro-magnetic coil 708. The cooling duct 772 whips the pressurized gas supplied from the cooling fan 771 onto the electro-magnetic coil 708. The cooling portion 711 cools the electro-magnetic coil 708 by whipping the pressurized gas on the electro-magnetic coil 708.

The linear encoder 775 includes the body portion 777 and a probe 778 provided to be capable of moving on the body portion 777 as shown in FIG. 32. The body portion 777 is lengthened in a linear shape and mounted on the base 703. The body portion 777 is disposed in parallel to the rail 720 between the pair of rails 720. An entire length of the body portion 777 is longer than that of the above-mentioned containing tank 709. The body portion 777 is disposed at a position as both end of the longitudinal direction of the body portion 777 is projected from the above-mentioned containing tank 709 toward an outside thereof along the longitudinal direction of the containing tank 709.

The probe 778 is provided to be capable of moving along the longitudinal direction of the body portion 777, that is to say, of the containing tank 709. The probe 778 is mounted on the electro-magnetic coil holding base 718. That is, the probe 778 is mounted on the electro-magnetic coil 708 via the electro-magnetic coil holding base 718.

The above-mentioned linear encoder 775 detects a position of the probe 778 in relation to the body portion 777, that is to say, the containing tank 709, and outputs the detected result toward the control device 776. Thereby, the linear encoder 775 detects the relative position to the containing tank 709 of the electro-magnetic coil, that is to say, the development sleeve 232 and outputs the detected result toward the control device 776.

The control device 776 is a computer which has a well-known RAM, ROM, CPU, and so on. The control device 776 is connected to the electro-magnetic coil moving portion 705, the moving holding portion 706, the moving chuck portion 707, the electro-magnetic coil 708, the inverter 749, the collection portion 710, the cooling portion 711, the linear encoder 775, and so on, and controls them to control all parts in the surface treatment device 701.

The control device 776 memorizes an intensity of the rotational magnetic field of the electro-magnetic coil according to the relative position to the development sleeve 232 of the electro-magnetic coil 708 detected by the linear encoder 775. That is, the control device 776 memorizes the electric power which is impressed on the electro-magnetic coil by the inverter 749 according to the relative position to the development sleeve 232 of the electro-magnetic coil 708. In addition, the control device 776 memorizes the above mentioned electric power for each product number of the development sleeve 232.

In the illustrated embodiment, the control device 776 memorizes previously a pattern which enlarges gradually the electric power impressed on the electro-magnetic coil 708 by the inverter 749 as the electro-magnetic coil 708 moves from the central portion toward both ends in the longitudinal direction of the development sleeve 232. Then, the control device 776 modifies the intensity of the rotational magnetic field generated by the electro-magnetic coil 708 to the inverter 749 according to the pattern of the pre-memorized electric power mentioned above. Thereby, in the illustrated embodiment, the control device 776 modifies the intensity of the magnetic field generated by the electro-magnetic coil 708 to the inverter 749 as the rotational magnetic field during processing both end of the development sleeve 232 becomes larger than the rotational magnetic field during processing the central portion of the development sleeve 232. As mentioned above, the control device 776 modifies the intensity of the rotational magnetic field generated by the electro-magnetic coil 708 to the inverter 749 according to the relative position to the containing tank 709, that is to say, the development sleeve 232 of the electro-magnetic coil 708 detected by the linear encoder 775.

Furthermore, connected are some kinds of input devices such as a keyboard, some kind of a display device such as 'display' to the control device 776.

Next, a process to manufacture the development sleeve 232 by treating (roughened surface) the outer surface of the development sleeve 232 by use of the surface treatment device 701 having the above-mentioned structure is explained below.

A part number or the like of the development sleeve 232 is first input from the input device into the control device 776. Cylindrical caps 764 are fitted on an outer periphery of each of opposite ends of the development sleeve 232 in the longitudinal (axial) direction. The other positioning member 754 is fitted on an outer periphery of the hollow holding member 732. The hollow holding member 732 is passed in the development sleeve 232 to the opposite ends of which the caps are attached. Thereafter, the one positioning member 754 is fitted on the outer periphery of the hollow holding member 732. The chuck shaft 739 of the chuck cylinder 734 is retracted to fix the development sleeve to the hollow holding member 732. At this time, the hollow holding member 732 and the development sleeve 232 become concentric. Thus, the development sleeve 232 is fixed to the hollow holding member 732.

The development sleeve 232 and the hollow holding member 732 are contained in the containing tank 709 and the wire member 765 is supplied into the cylindrical member 750 of the containing tank 709. Consequently, a plurality of wire members 765 and the development sleeve 232 are contained in the containing tank 709. In addition, the containing tank 709 is chucked by the holding chucks 728 and 743. The development sleeve 232 and the containing tank 709 are attached to the moving holding portion 706. At this time, the cylindrical member 750 of the containing tank 709, the hollow holding member 732 and the development sleeve 232 become concentric.

The above-mentioned work is carried out while adjusting a position of the moving base 726 by the actuators 724 and 725. The above-mentioned work is carried out while adjusting a position of the holding base 741. One end portion 709*a* of the containing tank 709 is held to the fixing holding portion 704 by allowing the one end portion of the containing tank 709 to chuck by the holding chuck 716.

While supplying gas into the containing tank 709 through the gas entering tube 766 of the collection portion 710 and absorbing the gas in the containing tank 709 by the dust collection device 770, gas pressed by cooling portion 711 is sprayed to the electro-magnetic coil 708. The development sleeve 232 is rotated about the axis P together with the hollow holding member 732 by the driving motor 733. Thereafter, by applying a power from a three-phase alternating electric source 748 to the electro-magnetic coil 708, a rotational magnetic field occurs in the electro-magnetic coil 708. At this time, each of the wire members 765 positioned inside the electro-magnetic coil 708 is rotated and orbited about the axis P (rotation and movement), thereby the wore members 765 hit to the outer surface of the development sleeve 232 to roughen the outer surface of the development sleeve 232.

When the moving portion 705 to move the electro-magnetic coil 708 adequately moves the electro-magnetic coil 708 along the axis P, the wire members 765 entered the electro-magnetic coil 708 are moved by the rotational magnetic field (rotation thereof and orbit about the axis), while the wire members 765 discharged from the inner side of the electro-magnetic coil 708 are stopped. Because each of the partition members 755 partitions a space of the containing tank 709, the wire members 765 are prevented from moving over the partition member 755, while the wire members 765 out of the inner side of the electro-magnetic coil 708 are out of the rotational electro-magnetic field. Furthermore, when the moving portion 705 reciprocates the predetermined rotational electro-magnetic coil 708 along arrow X, the surface-roughness of the development sleeve 232 is completed.

Furthermore, the electro-magnetic coil 708 generates a strength rotational magnetic field as going from the central portion to the opposite ends of the development sleeve 232. As the rotational magnetic field strengthens, the wire members acutely move. Consequently, as the rotational magnetic field strengths, the wire members 765 are hit to a work or the development sleeve to roughen the outer surface of the development sleeve.

When the roughing process of the outer surface of the development sleeve 232 is completed, the application of the power to the electro-magnetic coil 708 is stopped and the driving motor is stopped. In addition, the collection portion 710 and the cooling portion 711 are stopped. The holding of the containing tank 709 by the holding chuck 716 of the fixing holding portion 704 is released, and the containing tank 709 remains held by the holding chuck 743 of the moving chuck portion 707 and the holding chuck 728 of the moving holding portion 706, the first actuator 724 separates the moving base 726 from the fixing holding portion 704 along arrow X.

As a result, the containing tank 709 is separated from the fixing holding portion 704. The development sleeve 232 in which the roughing process of the outer surface is completed is taken out of the containing tank 709 and a new development sleeve is contained in the containing tank 709. In this way, by roughening the outer surface of the development sleeve 232, the development sleeve 232 in which the outer surface gradually roughs as going from the central portion to the opposite ends of the development sleeve is formed, as shown in FIG. 11.

Figure 36:
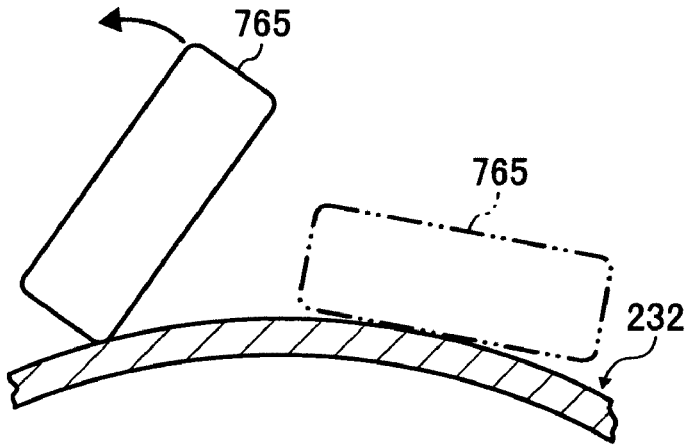
FIG. 36 is an explanatory view showing a state where the wire member as shown in FIG. 35 hits to the outer surface of the development sleeve.

Moreover, by the above-mentioned rotational magnetic field, each of the wire members 765 rotates about a central portion in a longitudinal direction thereof in such a manner that the longitudinal direction is disposed along a radial direction of each of the containing tank 709 and the development sleeve 232 and orbits about the outer periphery of the development sleeve 232, as shown in FIG. 35. Therefore, as shown by solid line in FIG. 36, an outer edge portion 765*a* of each of the wire members 765 hits to the outer surface of the development sleeve 232. Consequently, a plurality of generally elliptical depressions 239 are randomly formed on the outer surface of the development sleeve 232, as shown in FIGS. 29 and 30.

Of the generally elliptical depressions 239 formed on the outer surface of the development sleeve 232, the depressions along an axial direction of the development sleeve 232 are more than that along a peripheral direction of the development sleeve 232 in number. Here, as viewed in FIGS. 29 and 30, the right and left direction corresponds to the axial direction of the development sleeve 232.

According to this embodiment, the elliptical depressions 239 very larger than the concave portions formed by the conventional sand blast process are formed on the outer surface of the development sleeve 232. For example, a major axis is within a range of 0.05 mm or more to 0.3 mm or less, a minor axis of each depression is within a range of 0.02 mm or more to 0.1 mm or less. Therefore, the depressions 239 have a less wear even if a long period elapses, whereby preventing the reduction of the conveyed amount of the developer 226.

Because the development sleeve has the outer surface provided with the randomly formed elliptical depressions 239, the developer 226 is pooled in the depressions 239 in such a manner that places where the developer is pooled are randomly disposed on the outer surface. Accordingly, variations of the formed image are prevented from occurring on the photo conductive drum.

The depressions 239 in which the major axis of each of which is disposed along the axial direction of the development sleeve 232 are more than the depressions in which the major axis of each of which is disposed along the peripheral direction of the development sleeve 232 in number, places of the picked developer 226 are arranged along the axial direction of the development sleeve 232. Therefore, even if the development sleeve 232 rotates, the picked up developer 226 is configured to be difficult to remove from the outer surface of the developer sleeve 232. Accordingly, the elliptical depressions 239 have advantageous effects that the picked up amount of the developer 226 can be securely maintained in addition to the same advantageous effect as in the conventional V-shaped grooves.

In addition, because the wire members 765 are randomly hit to the outer surface of the development sleeve to form the elliptical depressions 239, the axis of the development sleeve 232 can be prevented from being curved, the inner and outer diameters of the development sleeve can be prevented from being changed, and the sectional shape of the development sleeve can be prevented from being formed in an elliptical shape. That is to say, it is possible to maintain the wobble accuracy of the development to a degree of high accuracy.

Moreover, the randomly disposed concave and convex portions are formed in the development sleeve 232. Accordingly, the generation of variations in an amount of the developer 226 supplied to the photo conductive drum 208 can be eliminated, thereby the variation in the density of the formed image can be prevented.

Because the wire members 765 disposed in the rotational magnetic field are hit to the outer surface of the development sleeve 232, the wire members 765 can be more randomly hit to the outer surface of the development sleeve. Consequently, more uniform concave and convex portions can be formed on the outer surface of the development sleeve 232 to obtain a more uniform image.

By positioning the wire members 765 in the rotational magnetic field, because the concave and convex portions can be formed on the outer surface of the development sleeve, the number of processes in forming the concave and convex portions on the outer surface of the development sleeve can be prevented from increasing, and hence complicated processes to form the concave and convex portions and a high cost for working the concave and convex portions can be prevented.

In addition, by positioning the wire members 765 in the rotational magnetic field, because the concave and convex portions can be formed on the outer surface of the development sleeve, it is possible to rotate each of the wire members about the central portion of the wire member in the longitudinal direction and orbit about the periphery of the development sleeve 232 in such a manner that the longitudinal direction of the wire member is disposed along the radial direction of the rotational magnetic field.

Therefore, the outer edge portions of the opposite ends of each of the wire members 765 in the longitudinal direction hit to the development sleeve 232 to form the depressions 239. In this case, the depressions disposed along the axial (longitudinal) direction of the development sleeve are more than that disposed along the peripheral direction of the development sleeve in number. Therefore, the elliptical depressions 239 formed on the outer surface of the development have advantageous effects that the picked up amount of the developer 226 can be securely maintained in addition to the same advantageous effect as in the conventional V-shaped grooves.

Because the wire members 765 can be hit to the outer surface of the development sleeve 232 by the rotational magnetic field randomly, the depressions 239 formed on the outer surface are randomly disposed securely. Accordingly, variations in an image formed by the development sleeve 232 can be prevented from occurring.

Because the development sleeve 232 is contained in the containing tank 709 together with the wire members 765, the wire members can be hit to the outer surface of the development sleeve 232 securely. Consequently, it is possible to provide the roughing treatment on the outer surface of the development sleeve 232 securely.

Because the wire members 765 are hit to the rotating development sleeve 232 in the containing tank 709, the wire members 765 are hit to the outer surface of the development sleeve 232 in a more randomly disposed state. Accordingly, the depressions 239 can uniformly be formed while maintaining a more high accuracy to obtain an image having less variation.

According to the above-mentioned image forming apparatus 201, because the magnetic carrier includes particles each having an average diameter of 20 μm or more and the developer includes particles each having an average diameter of 35 μm or less are used, a good granular degree can be accomplished, it is possible to obtain an improved image having less variation. If the average diameter of the particle of the magnetic carrier 235 is lesser than 20 μm, because one particle of the magnetic carrier 235 has a less magnetic force, there is an undesirable problem that the magnetic carrier 235 is easy to be separated from the development roller 215 and to be attached to the photo conductive drum 208 because of a less magnetic holding force between the development roller and the magnetic carrier. If the average diameter of the particle of the magnetic carrier 235 is more than 35 μm, because an electric field between the magnetic carrier 235 and the electrostatic latent image on the photo conductive drum 208 is in roughness, the there is an desirable problem that a uniform image cannot be obtained, whereby generating deterioration of the image.

Because the image forming apparatus 201 includes the development device 213 as mentioned above and the process cartridges 206Y, 206M, 206C and 206K, a high quality image can be maintained throughout a long period.

Because the outer diameter D of each of the wire members 765 is 0.5 mm or more and 1.2 mm or less, even if a long period elapses, the concave and convex portions formed on the outer surface of the development sleeve 232 as a work do not wear. It is possible to prevent the reduction of the picked up amount of the developer 226 by the development sleeve 232 and thinness of the image, throughout a long period.

Consequently, it is possible to provide the wire members 765 and the surface treatment device 701 which are capable of providing the roughing treatment on the outer surface of the development sleeve 232 to reduce the lowering of the conveyed amount of the developer 226 due to the secular variation of the development sleeve 232 and prevent the generation of the variations in the image.

Because the ratio (L/D) of the entire length L and the outer diameter D in the wire member 765 is 4 or more and 10 or less, the outer edge portion of each of the opposite ends of the wire member in the longitudinal direction securely hits to the development sleeve 232, the entire length of the wire member 765 is sufficient to form the concave and convex portions each having sufficient size and depth on the outer surface of the development sleeve 232. Therefore, it is possible to form the concave and convex portions on the outer surface of the development sleeve 232 securely, and maintain a sufficient picked up amount of the developer 226 in the development sleeve 232.

Furthermore, the circular-arc chamfering in section is provided on the outer edge portion 765*a* of each of the opposite ends of the wire member 765 in the longitudinal direction. Therefore, smooth concave and convex portions can be formed on the outer surface of the development sleeve 232 to prevent the secular variation of the developer 226 of the development sleeve, in particular, the magnetic carrier 235 or the like.

Because the curvature radius R of the sectional shape of the outer edge portion 765*a* formed on each of the opposite ends of the wire member 765 is 0.05 mm or more and 0.2 mm or less, it is possible to form the smooth concave and convex portions on the outer surface of the development sleeve 232.

Because the wire member 765 is made of stainless steel of austenite system or martensite system, it is possible to accomplish easy access to the wire member 765 to reduce a cost for the wire member.

The control device 776 can change the strength of the rotational magnetic field generated by the electro-magnetic coil 708 based on a relative position of the electro-magnetic coil 708 to the development sleeve 232 in the containing tank 709. Therefore, if the rotational magnetic field is intensive, active movement of each of the wire members is obtained. At this time, because a high kinetic energy to hit each of the wire members hits to the outer surface of the development sleeve 232 is formed, the development sleeve 232 has the more roughened outer surface.

Thereby, the roughness of any position of the outer surface of the development sleeve 232 in the longitudinal or axial direction can be changed. Accordingly, a picked up amount of the developer by any position of the development sleeve can be increased or decreased. In addition, it is possible to roughen a surface of a less picked up amount of developer on the outer surface of the development sleeve to increase the picked up amount of the surface and prevent the variation of the image formed by the image forming apparatus 201 including the development sleeve. In this way, it is possible to provide the roughing treatment on the outer surface of the development sleeve 232 to prevent the image variation from occurring.

Because the control device 776 changes the strength of the rotational magnetic field depending on a predetermined pattern, it is possible to provide the roughing treatment on the outer surface of the development sleeve 232 in the usually constant pattern.

When the control device 776 controls the electro-magnetic coil 708 to strengthen the rotational magnetic field in working the opposite ends of the development sleeve compared to the rotational magnetic field in working the central portion of the development sleeve, the surfaces on the opposite ends having a less picked up amount of developer is formed to be rougher than that on the central portion having a much picked up amount of developer to increase the picked up amount of developer on the opposite ends. Consequently, it is possible to securely prevent the variation in the image formed by the image forming apparatus 201 including the development sleeve 232 from occurring. In this way, it is possible to provide the roughing treatment on the outer surface of the development sleeve 232 to prevent the generation of the image variation.

The movement of the electro-magnetic coil 708 causes the processing of the development sleeve to execute and the wire members 765 to move out of the rotational magnetic field acutely. Therefore, the strength of the magnetic field acting to the wire members 765 is acutely reduced so that a magnetic domain aligned in the wire members 765 is misaligned to be a less magnetization intensity, whereby having advantageous effects that residual magnetization of the wire members 765 is removed simultaneously with the processing of the development sleeve 232.

As a result, it is not necessary to have a degaussing device to demagnetize the residual magnetization of the wire members 765 separate from the surface treatment device 701. Accordingly, the demagnetization of the wire members 765 can be easily accomplished. As a result, it is possible to execute continuing processing of the development sleeve throughout a long time to improve processing efficiency of the surface treatment. Accordingly, a surface treatment device 701 suitable to be used for a mass-produced device to mass-produce the development sleeve 232 can be obtained.

Because the development sleeve is disposed in the central portion of the containing tank 709, the wire members 765 can be hit to the outer surface of the development 232 uniformly to process the outer surface of the development sleeve uniformly.

The movement or orbital motion of the wire members 765 about the outer periphery of the development sleeve 232 allows the wire members 765 to hit to the outer surface of the development sleeve so that the processing of the development sleeve 232 can be securely accomplished.

Because the development sleeve 232 is rotated, the wire members 765 can be hit to the outer surface of the development sleeve uniformly to process the outer surface of the development sleeve 232 further uniformly.

Because the electro-magnetic coil 708 has a length shorter than that of the containing tank 709, it is possible the surface treatment device to form a rotational magnetic field stronger than that of an electro-magnetic coil having the generally same length as the containing tank 709 and reduce loss of the rotational magnetic field generated in the containing tank 709. Accordingly, high processing efficiency of the development sleeve 232 can be accomplished and power consumption can be reduced.

Also, because the electro-magnetic coil 708 has a length shorter than that of the containing tank 709, it is possible to support opposite ends of the containing tank 709. Thereby, the containing tank can be prevented from moving with the movement of the wire members 765 or the like, the wire members can be hit to the outer surface of the development sleeve 232 further uniformly, and the outer surface of the development sleeve 232 can be further uniformly processed.

Because the containing tank 709 has a cylindrical shape, motion in a peripheral direction of each wire member 765 when the rotational magnetic field is applied to the wire member is not blocked by the containing tank 709. As a result, stable processing of the development sleeve can be accomplished.

The space of the containing tank 709 is partitioned by the partition member 755. This results in limitation of a movable area (rotation of itself and orbital motion) of each of the wire members 765 by the partition member 755 to improve processing efficiency of the development sleeve.

Also, because the movement of the wire member 765 over the partition member 755 can be limited, the wire member 765 and the rotational magnetic field can be securely relatively moved, and each of the wire members 765 can secularly be demagnetized.

Because the partition member 755 is made of a non-magnetic material, it is not magnetized, and therefore the motion of the wire member is not blocked by the partition member 755. In addition, it is prevented that cut dust or the like is magnetized and adhered to the partition member 755. Consequently, the stable processing of the development sleeve can be accomplished.

Because the plurality of partition members are provided, it is possible to divide a range roughening the outer surface of the development sleeve 232. Therefore, the above-mentioned movable area of each of the wire members 765 can securely be limited by the partition members 755, and hence the processing of the development sleeve can be efficiently accomplished.

Here, because the movement of the wire member 765 over the partition members 755 can be limited, each of the wire members 765 can secularly be demagnetized.

Because an outer wall of the containing tank 709 made of a cylindrical member has a single wall structure, it is possible to set to have a short distance between the electro-magnetic coil 708 and the development sleeve 232 and hence the rotational magnetic field generated by the electro-magnetic coil 708 can be efficiently employed for the processing of the development sleeve.

The sealing blades 756 prevent each of the wire members 765 from flowing out of the containing tank 709 to accomplish improved workability and productivity when processing. Such effects are further enhanced by continuously processing the development sleeve. The surface treatment device 701 is capable of performing the surface treatment of the development sleeve 232 which is mass-produced efficiently and safely.

As already mentioned with respect to the above-mentioned image forming apparatus 201, referring to FIGS. 8 and 9, each of the process cartridges 206Y, 206M, 206C, and 206K includes the cartridge case 211, the charged roller 209, the photo conductive drum 208, the cleaning blade 212 and the development device 213. However, each of the process cartridges 206Y, 206M, 206C, and 206K may include at least the development device 213, may not include the cartridge case 211, the charged roller 209, the photo conductive drum 208, and the cleaning blade 212. Moreover, in the above-mentioned embodiments, the image forming apparatus 201 is configured to include the process cartridges 206Y, 206M, 206C and 206K attached removably to the main body 202. However, the image forming apparatus 201 may include the development device 213, may not include the process cartridges 206Y, 206M, 206C and 206K.

In the above-mentioned embodiments, the outer diameter of the development sleeve 232, the size of each of the wire members 765, and the outer diameter of the cylindrical member 750 of the containing tank 709 may be optionally changed. It is desire to adequately select the shape of the opposite ends of the development sleeve 232 in consideration of the curvature radius, the size and the shape of the chamfering, the desired roughness of the outer surface, the working time and conditions, the number of reciprocating movement of the electro-magnetic coil 708, durability of the wire members 765 or the like. It is preferable that the total amount of the wire members 765 contained in the containing tank 709 is adequately set in consideration of the desired roughness of the outer surface, the working time and conditions, the number of reciprocating movement of the electro-magnetic coil 708, durability of the wire members 765 or the like.

Figure 37:
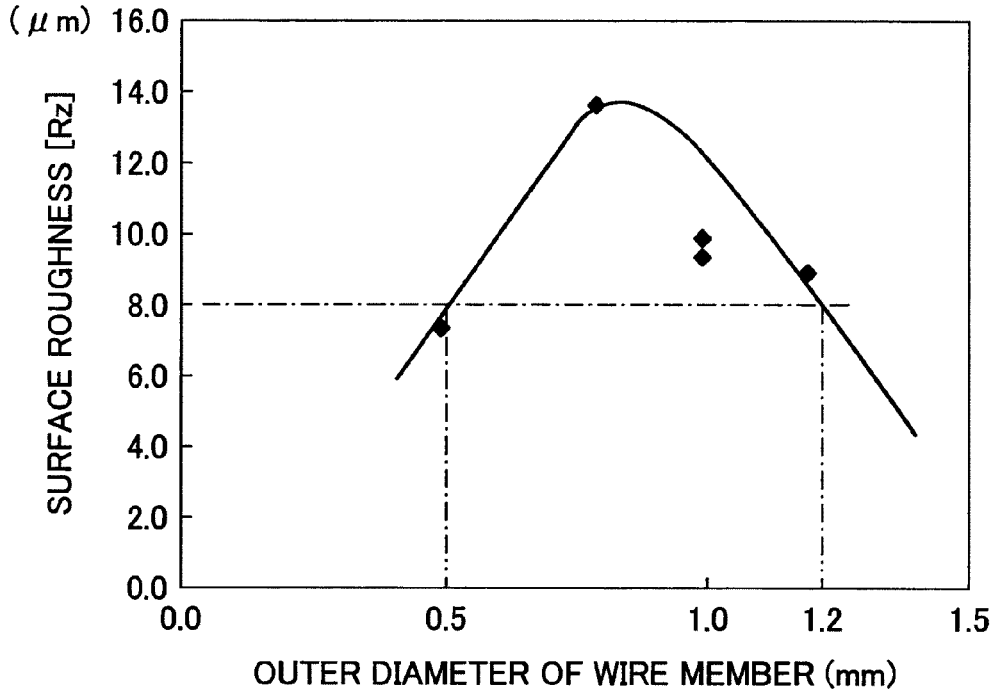
FIG. 37 is an explanatory view showing change in a surface roughness of the outer surface of the development sleeve when changing an outer diameter of the wire member.

Next, the inventors have measured changes of the roughness of the outer surface of the development sleeve 232 when the outer diameter D of each of the wire members 765 is changed. The results are shown in FIG. 37. In FIG. 37, a horizontal axis shows the outer diameter D of the wire member and a vertical axis shows the roughness of the outer surface of the development sleeve 232. Here, when the roughness of the outer surface of the development sleeve 232 is 8 μm or more, it is shown that the development sleeve 232 can convey a predetermined amount of developer 226.

From FIG. 37, it has been demonstrated that the predetermined amount of developer could be conveyed by the wire member 765 having the outer diameter of 0.5 mm or more and 1.2 mm or less. In addition, it has been demonstrated from FIG. 37 that the roughness of the outer surface of the development sleeve can be set to have 10 μm by setting the outer diameter D of the wire member 765 to be 0.6 mm or more and 1.1 mm or less to allow the predetermined amount of developer 226 to convey securely. Moreover, it has been demonstrated from FIG. 37 that the roughness of the outer surface of the development sleeve can be set to have 12 μm by setting the outer diameter D of the wire member 765 to be 0.7 mm or more and 1.0 mm or less to allow the predetermined amount of developer 226 to convey securely. Furthermore, it has been demonstrated from FIG. 37 that the roughness of the outer surface of the development sleeve can be set to have 14 μm by setting the outer diameter D of the wire member 765 to be 0.8 mm to allow the predetermined amount of developer 226 to further securely convey.

Figure 38:
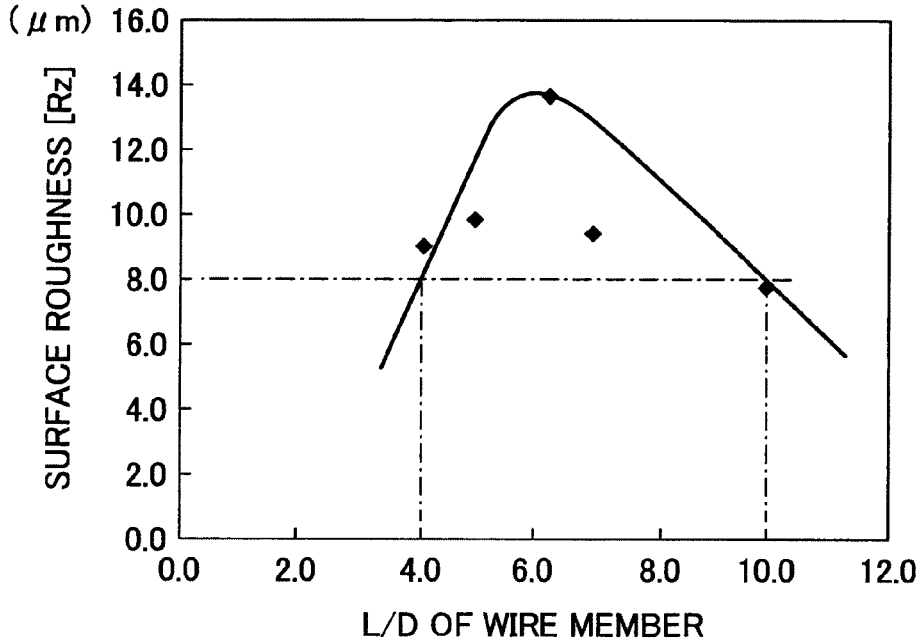
FIG. 38 is an explanatory view showing change in a surface roughness of the outer surface of the development sleeve when changing a ratio L/D of the wire member.

The inventors also have measured changes in the roughness of the outer surface of the development sleeve 232 when the ratio D/L of the diameter and the length in each of the wire members 765 is changed. The results are shown in FIG. 38. In FIG. 38, a horizontal axis shows the D/L of the wire member and a vertical axis shows the roughness of the outer surface of the development sleeve 232.

It has been demonstrated from FIG. 38 that the picked up amount of the developer 226 could be secured by setting the ratio D/L of the wire member 765 to be 4 or more and 10 or less. Meanwhile, if the ratio of the wire member 765 is less than 4, a rotational moment of rotation of the wire member itself is not sufficient, and hence energy of the wire member hitting to the outer surface is less so that a formed concave portion by the wire member has a less depth. Also, if the ratio D/L of the wire member 765 is more than 10, there is a case that the central portion of the wire member often hits to the outer surface as shown by two dot chain line in FIG. 32 so that the formed concave portion has a less depth. It has also been demonstrated from FIG. 38 that the roughness of the outer surface of the development sleeve can be set to have 10 μm by setting the ratio D/L of the wire member 765 to be 4.5 or more and 9.0 or less to allow a sufficient picked up amount of the developer to secure and a predetermined amount of developer to convey securely. In addition, it has been demonstrated from FIG. 38 that the roughness of the outer surface of the development sleeve can be set to have 12 μm by setting the ratio D/L of the wire member 765 to be 5.0 or more and 7.0 or less to allow the picked up amount of the developer securely and the predetermined amount of developer 226 to convey securely.

Figure 39:
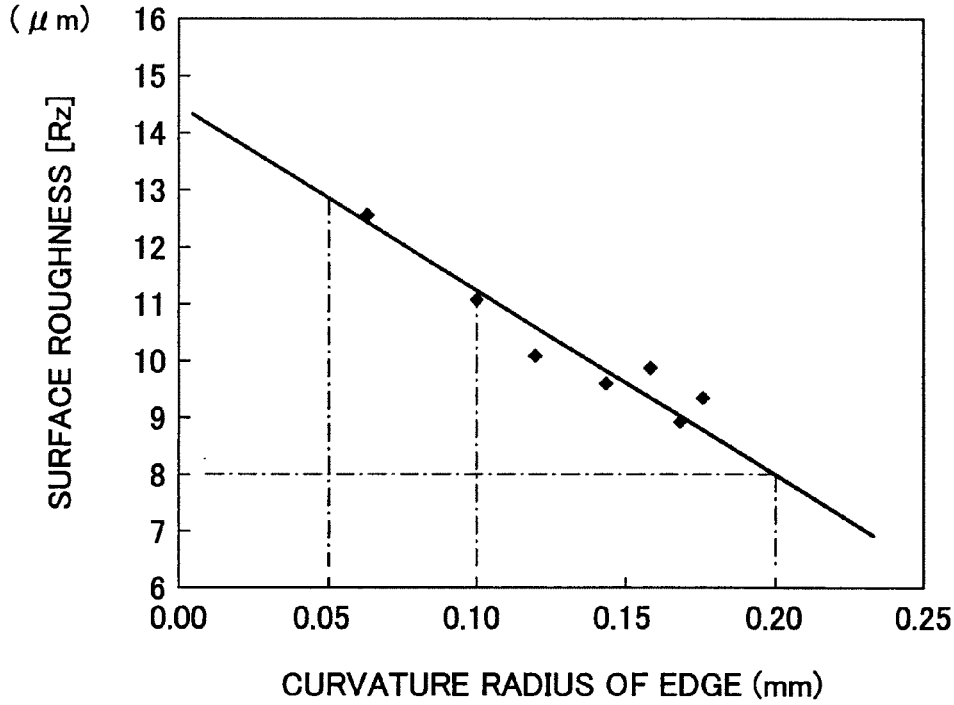
FIG. 39 is an explanatory view showing change in a surface roughness of the outer surface of the development sleeve when changing a curvature radius of each of outer peripheral edge portions of the wire member.

Furthermore, the inventors have measured changes in the roughness of the outer surface of the development sleeve 232 when the curvature radius R of each of the outer edges of each of the wire members 765 is changed. The results are shown in FIG. 39. In FIG. 39, a horizontal axis shows the curvature radius R of each outer edge of the wire member and a vertical axis shows the roughness of the outer surface of the development sleeve 232.

It has been demonstrated from FIG. 39 that the predetermined amount of developer 226 can be securely conveyed by setting the curvature radius R of each outer edge of the wire member 765 to be 0.05 mm or more and 0.2 mm or less. It has also been demonstrated from FIG. 39 that each outer edge is not suitable because it largely wears if the curvature radius R is less than 0.05 mm. Furthermore, it has been demonstrated from FIG. 39 that the wear of the wire member, in particular, each outer edge can be reduced to accomplish a long life duration of the wire member 765 and convey the predetermined amount of developer by setting the curvature radius R of each outer edge of the wire member 765 to be 0.10 mm or more and 0.2 mm or less.

Next, the inventors have manufactured a plurality of development sleeves 232 each of which has a different roughening method, and effects of the present invention have been confirmed by forming a test image in an initial state of each of the development sleeves and a test image after each of the development sleeves is continuously used (after ten papers are printed). The results are shown in the following table 3.

TABLE 3

| | Reduction of Picked up Amount | Variation Image | Total |
|---|---|---|---|
| Invention's Product | Good | Good | Good |
| Comparative Example 3-1 | Poor | Good | Middling |
| Comparative Example 3-2 | Good | Poor | Middling |
| Comparative Example 3-3 | Good | Middling | Middling |

Comparative Example 3-1

Figure 48:
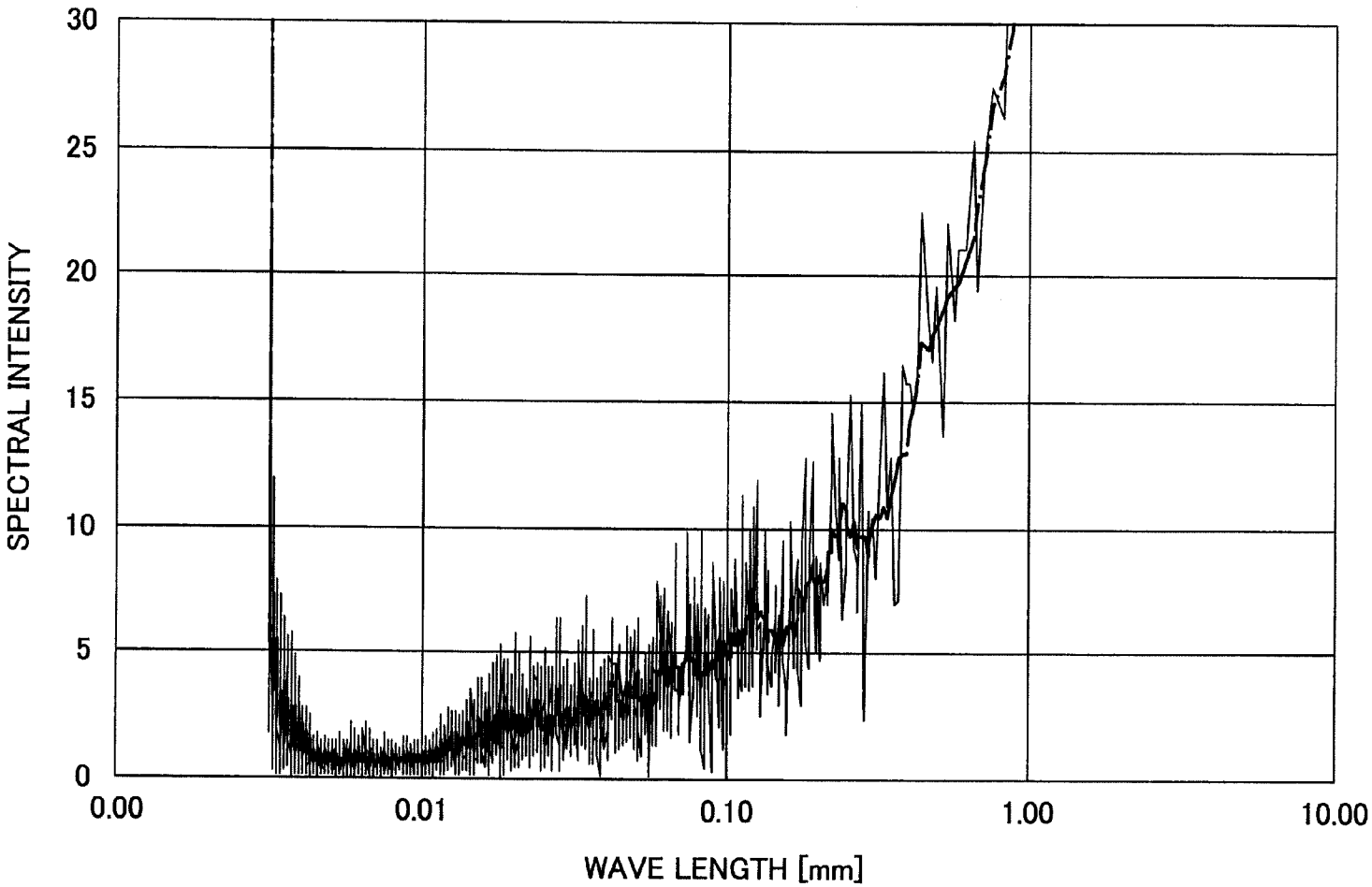
FIG. 48 is an explanatory view showing results in which Fourier analysis is provided on a profile curve of the outer surface in the comparative example 2-1.

In the comparative example 3-1, the sand blast was applied to the outer surface of each of the development sleeves. The results in which Fourier analysis was given to a profile curve of the outer surface are shown in FIG. 48.

Comparative Example 3-2

Figure 43:
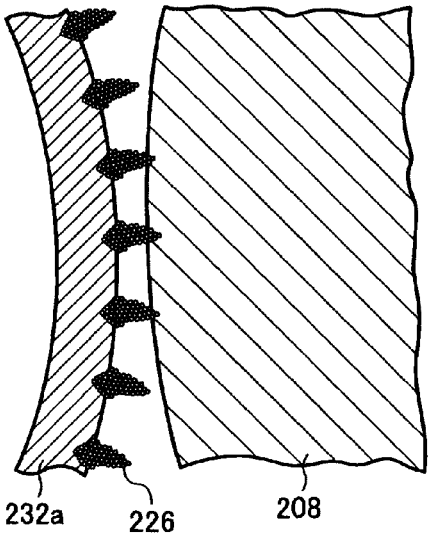
FIG. 43 is a sectional view showing a state where the developer is raised on the outer surface in the comparative example 2-2.

In the comparative example 3-2, grooves were provided on the outer surface of the development sleeve 232*a* (the sectional shape is shown in FIG. 43).

Figure 46:
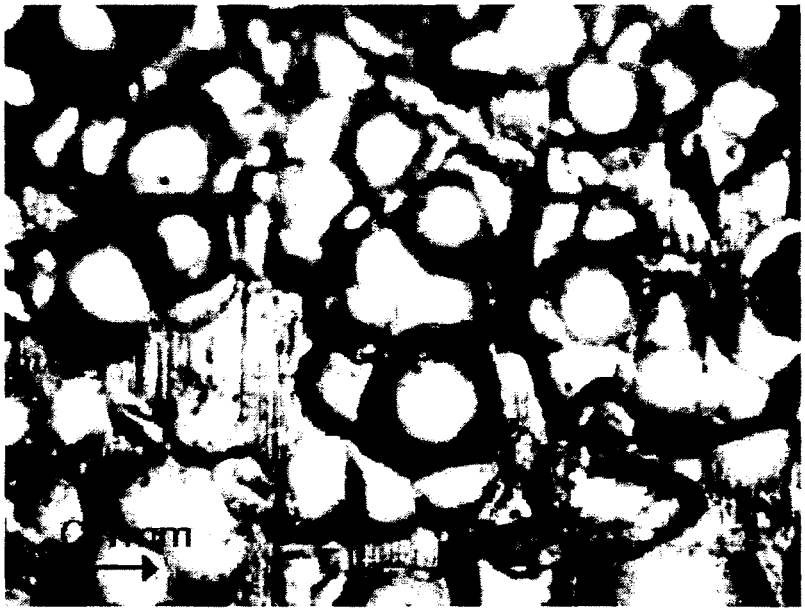
FIG. 46 is an explanatory view showing an enlarged outer surface in the comparative example 2-3.
Figure 47:
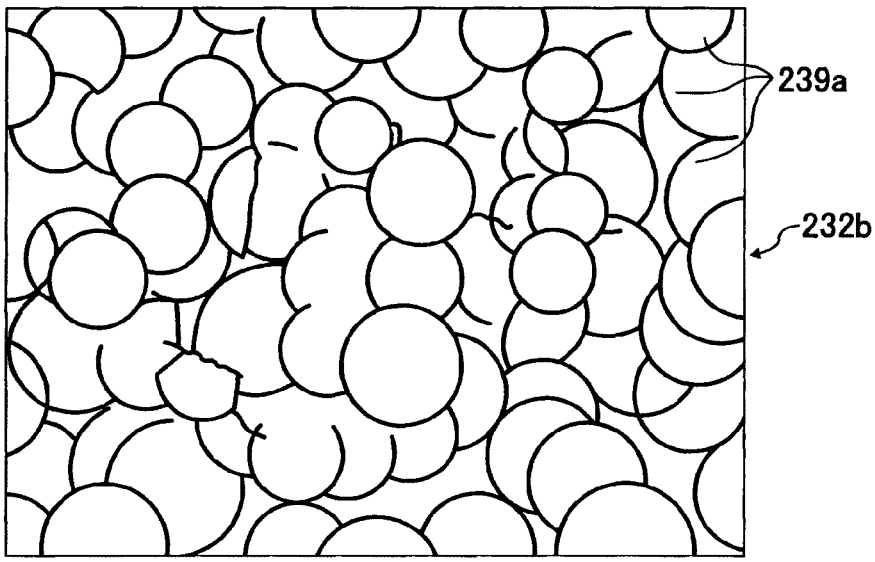
FIG. 47 is an explanatory view schematically showing an outer surface in the comparative example 3 as shown in FIG. 46.

In the comparative example 3-3, depressions or concave and convex portions were formed on the outer surface of the development sleeve 232*b* by blowing glass beads to the outer surface of the development sleeve (the enlarged actual depressions are shown in FIG. 46, FIG. 47 is a schematic view of the depressions, and the results in which Fourier analysis was given to a profile curve of the outer surface are shown in FIG. 47).

(Product According to the Present Invention)

Figure 40:
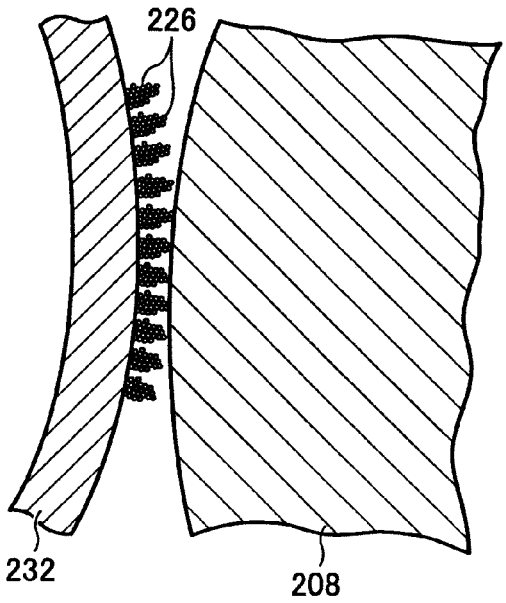
FIG. 40 is sectional view showing a state where the developer is raised on the outer surface of the invention's product.

In the invention's product, the roughing treatment was provided on the outer surface by use of the surface treatment device configured to randomly hit the wire members 765 having the above-mentioned structure to the outer surface of the development sleeve 232. Here, the cross-sectional surfaces of the development sleeve and the photo conductive drum are shown in FIG. 40, the enlarged actual concave and convex portions on the outer surface are shown in FIG. 29, the schematic structure thereof is shown in FIG. 30, and the results in which Fourier analysis was given to the profile curve are shown in FIG. 50.

Figure 49:
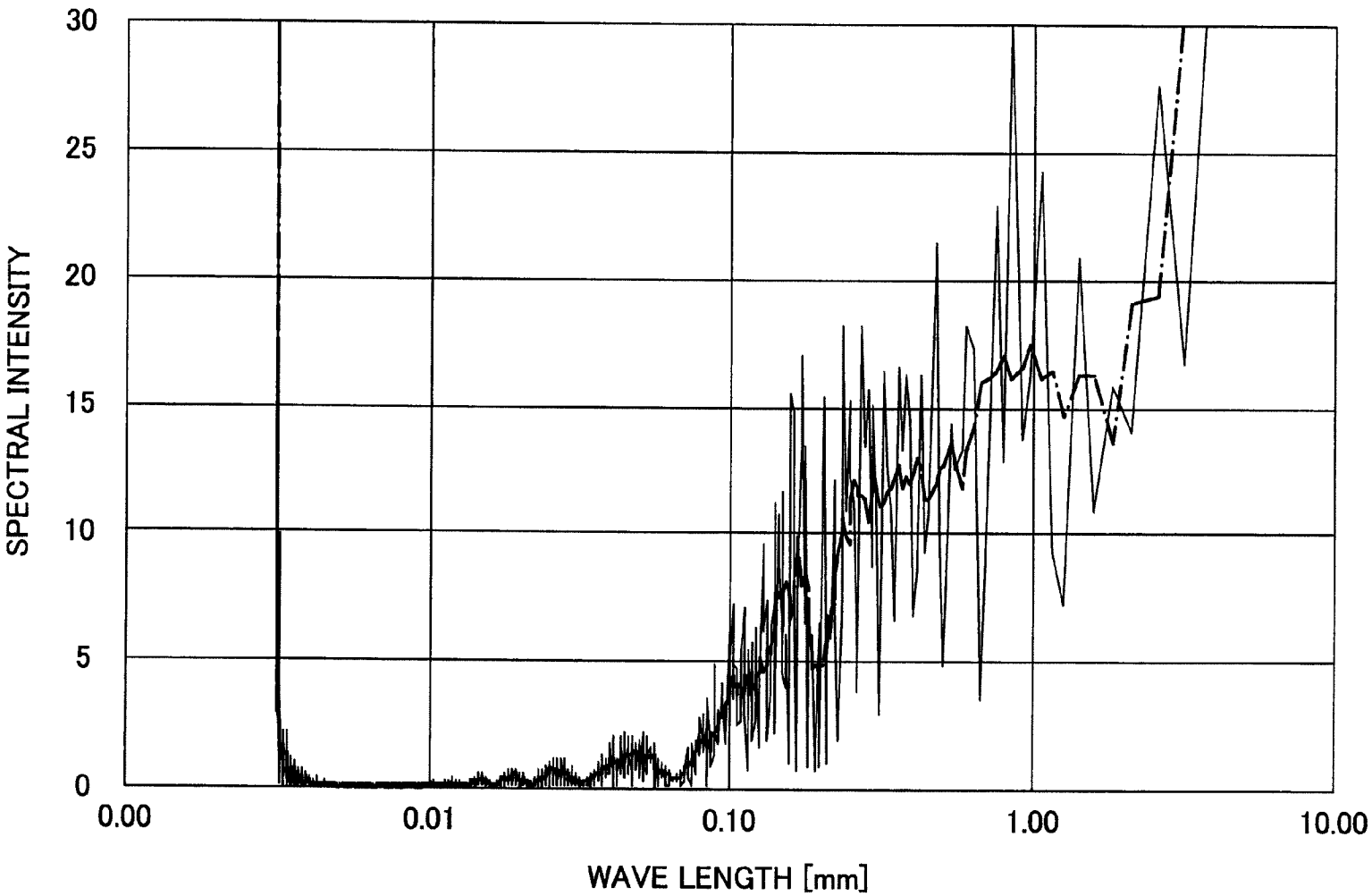
FIG. 49 is an explanatory view showing results in which Fourier analysis is provided on a profile curve of the outer surface in the comparative example 2-3 shown in FIG. 46.
Figure 50:
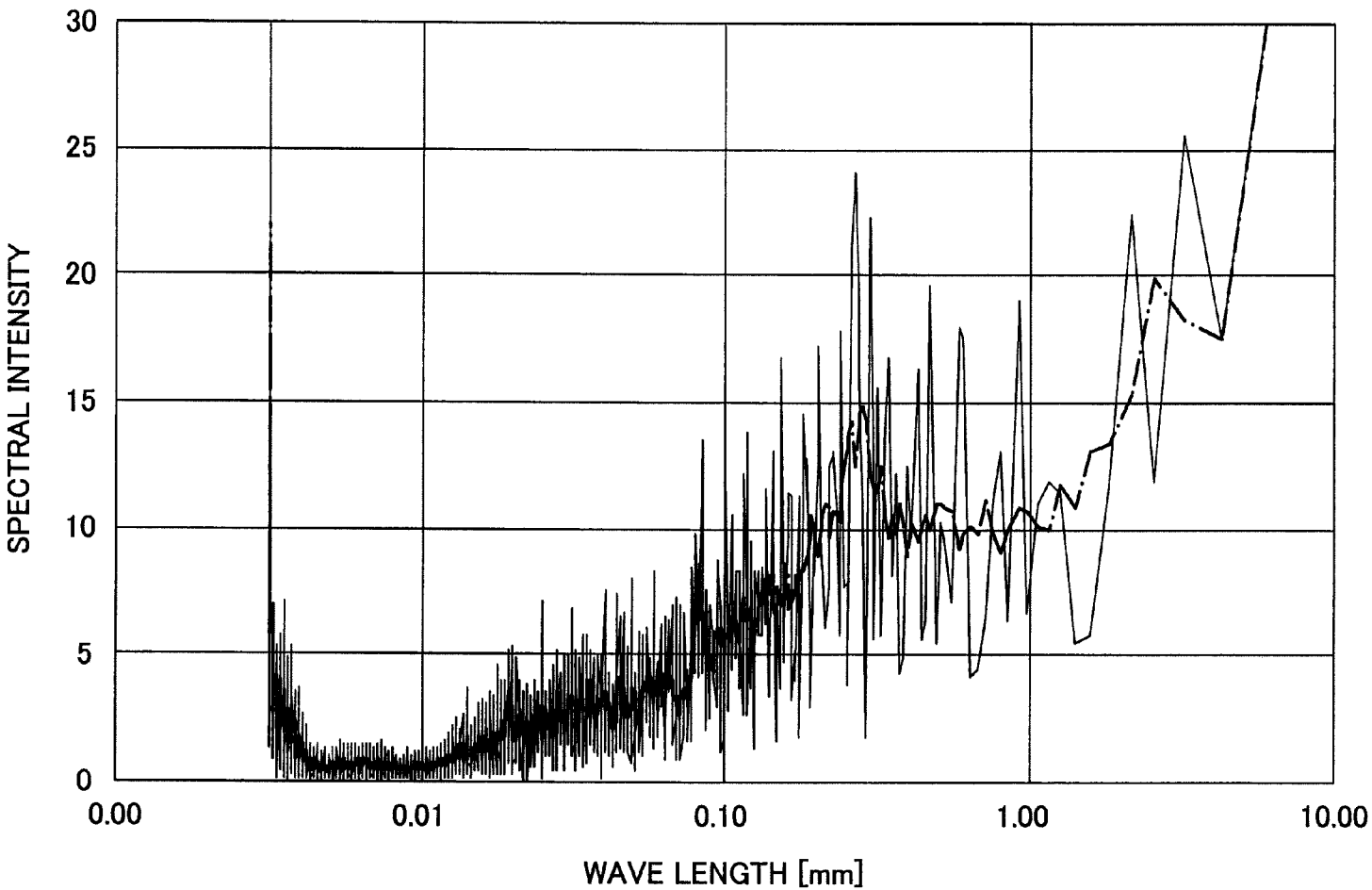
FIG. 50 is an explanatory view showing results in which Fourier analysis is provided on a profile curve of the outer surface in the invention's product.

A horizontal axis in each of FIGS. 48 to 50 shows a wave length of the profile curve of the outer surface or concave and convex portions formed on the outer surface, and a vertical axis in each of FIGS. 48 to 50 shows an absolute value of a vibration amplitude of each wave length in the profile curve of the outer surface. A solid line in each of FIGS. 48 to 50 shows a value obtained by Fourier analysis, a chain line in each of FIGS. 48 to 50 shows an average of values obtained by Fourier analysis.

In evaluation standards shown in the Table 3, products which are better and enough for practical use are shown as "Good", products which are poor, but enough for practical use are shown as "Middling", and products which are very poor and useless are shown as "Poor".

It has been demonstrated from FIGS. 29 and 30 that about forty depressions 239 each major axis of which is disposed along the axial direction of the development sleeve 232 were provided and about twenty two depressions 239 each major axis of which is disposed along the peripheral direction of the development sleeve 232 were provided. In this way, it has been clear that depressions 239 each having the major axis disposed along the axial direction of the development sleeve 232 were more than the depressions each having the major axis disposed along the peripheral direction of the development sleeve in number, of the elliptical depressions 239 formed on the outer surface of the development sleeve 232 formed by the processing to roughen the outer surface of the development sleeve by the surface treatment device using the cylindrical post-like wire members 765.

In the comparative example 3-1, it was clear that the picked up amount of the developer 226 was gradually reduced as the number of printed papers increases. Furthermore, it was recognized in the invention's product that the reduction of the picked up amount of the developer 226 was less even if the number of printed papers increases.

Therefore, as shown in the Table 3, it was clear in the comparative example 3-1 that the reduction of the picked up amount of the developer 226 was significant and useless. Also, in the comparative example 3-1, because the random concave and convex portions are formed on the outer surface, it was clear that variations do not occur in the test images, and the products were good and enough for practical use as far as the variations in the image.

In the comparative example 3-2, because the depth of each of the V-shaped groves is larger than each of particles of the magnetic carrier, the V-shaped grooves are difficult to wear. Therefore, it was clear in the comparative example 3-2 that the reduction of the picked up amount of the developer 226 is little and very good and enough for practical use.

Figure 44A:
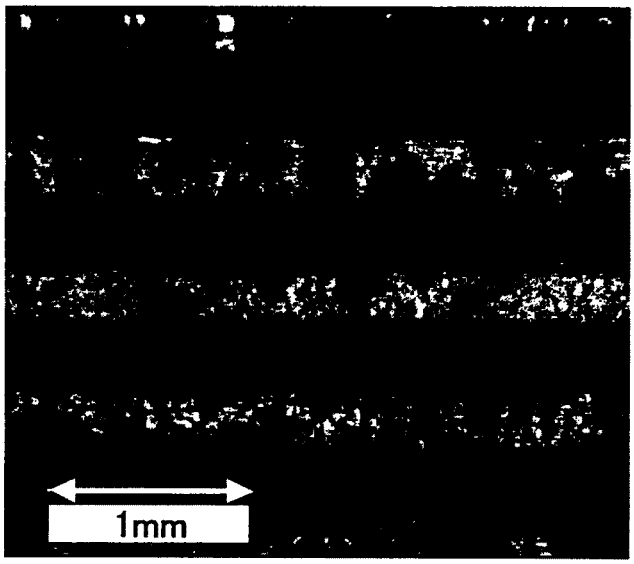
FIG. 44A is an explanatory view showing the image when the picked up amount of the developer in the comparative example 2-2 is 35 mg/cm2.
Figure 44B:
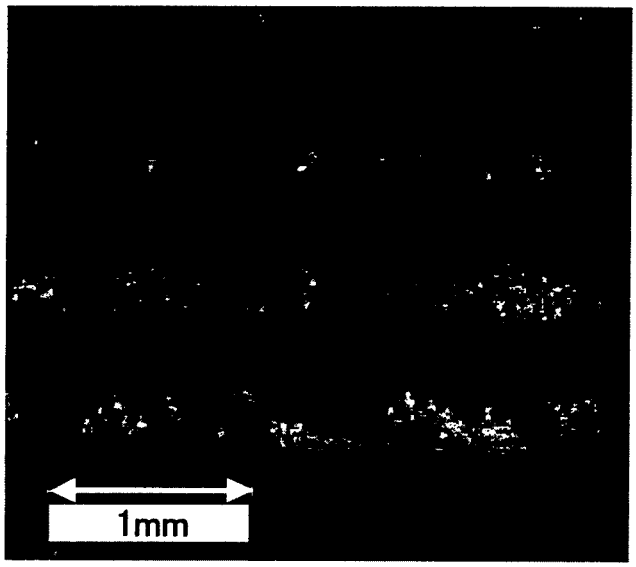
FIG. 44B is an explanatory view showing the image when the picked up amount of the developer in the comparative example 2 is 50 mg/cm2.
Figure 45A:
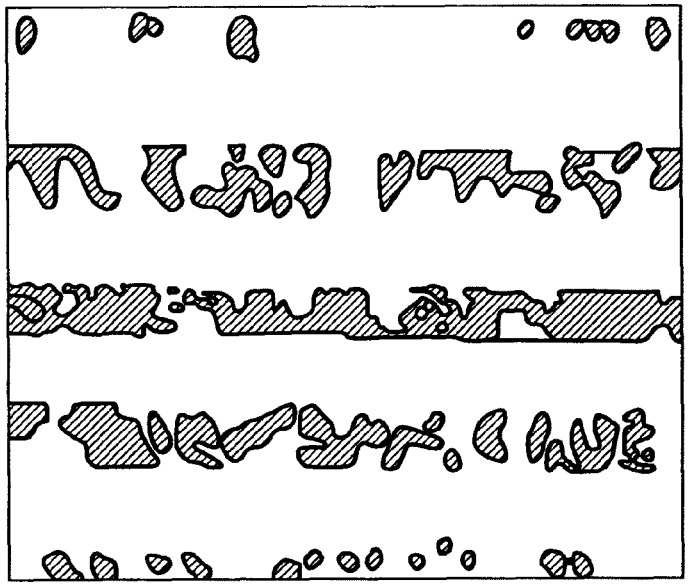
FIG. 45A is an explanatory view schematically showing the image as shown in FIG. 44A.
Figure 45B:
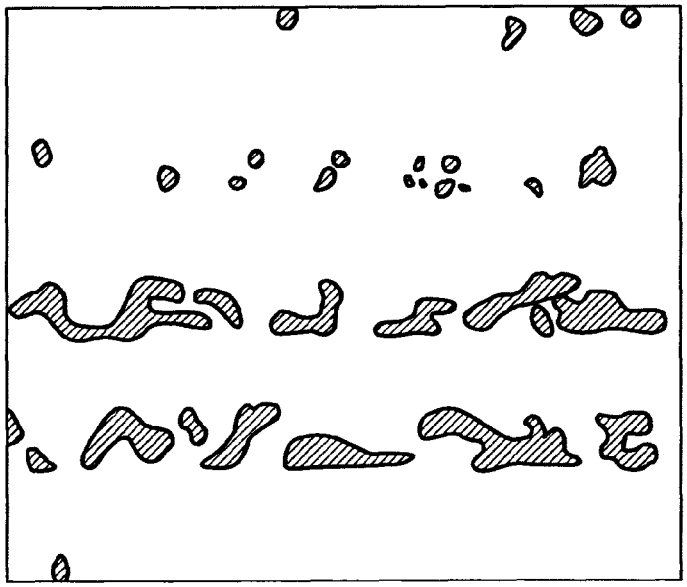
FIG. 45B is an explanatory view schematically showing the image as shown in FIG. 44B.

In addition, in the comparative example 3-2, test images in cases that the picked up amounts of the developer are 35 mg/cm2 and 50 mg/cm2 were generated. The actually formed images are shown in FIGS. 44 A and 44B, and the schematic images are shown in FIGS. 45A and 45B. Here, FIGS. 44A and 45A illustrate a case where the picked up amount of the developer is 35 mg/cm2, FIGS. 44B and 45B illustrate a case where the picked up amount of the developer is 50 mg/cm2. In addition, white places in FIG. 44 are shown by parallel diagonal lines in FIGS. 45A and 45B.

Figure 41A:
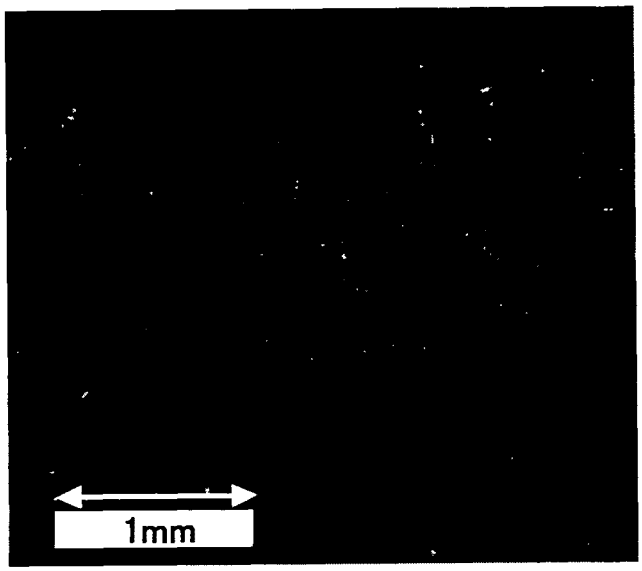
FIG. 41A is an explanatory view showing an image when a picked up amount of the developer by the invention's product is 35 mg/cm2.
Figure 41B:
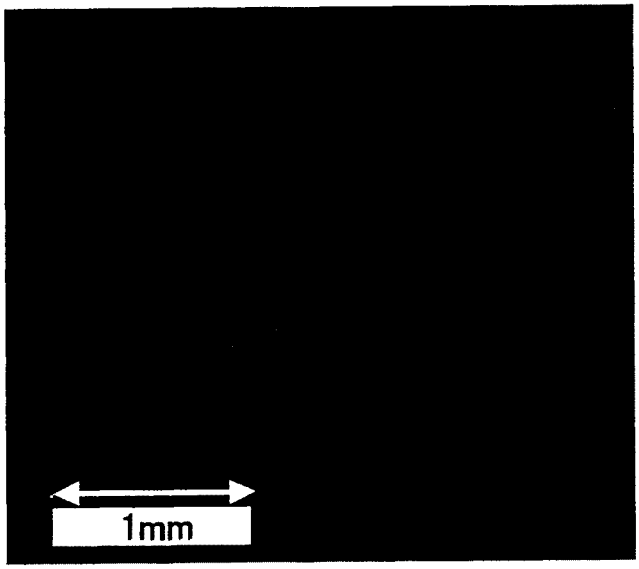
FIG. 41B is an explanatory view showing an image when a picked up amount of the developer by the invention's product is 50 mg/cm2.
Figure 42A:
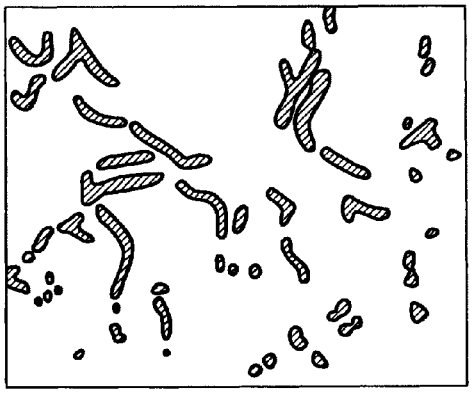
FIG. 42A is an explanatory view schematically showing the image as shown in FIG. 41A.
Figure 42B:
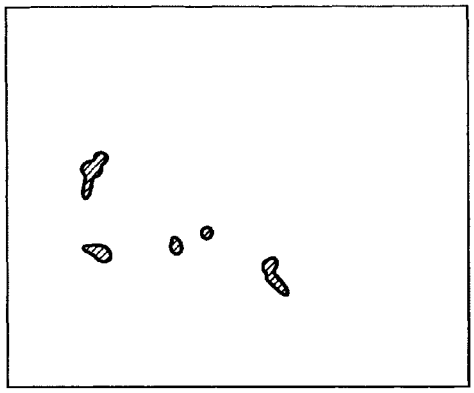
FIG. 42B is an explanatory view schematically showing the image as shown in FIG. 41B.

On the contrary, actually formed images of test images in cases where the picked up amounts of the developer 226 of the invention's product are 35 mg/cm2 and 50 mg/cm2 are shown in FIGS. 41A and 41B, schematic images thereof are shown in FIGS. 42A and 42B. Meanwhile, FIGS. 41A and 42A illustrate a case where the picked up amount of the developer is 35 mg/cm2, and FIGS. 41B and 42B illustrate a case where the picked up amount of the developer is 50 mg/cm2. Here, white places in FIG. 41 are shown by parallel diagonal lines in FIG. 42.

It has been demonstrated from FIGS. 41, 42, 44 and 45 that the invention's product had no variation in the formed image, on the contrary, significant variation was generated in the formed image in the comparative example 3-2. This results in that the variation is difficult to generate the variation, because of narrow intervals between the ears of the developer formed on the smoothly formed concave and convex portions on the outer surface and of the concave and convex portions which are smoothly and randomly formed on the outer surface (see FIG. 40).

On the contrary, in the comparative example 3-2, because the developer 226 is mainly disposed in the V-shaped grooves formed on the outer surface, the interval between the adjacent raised portions or ears of the developer 226 is wide, and the V-shaped grooves linearly extend, the developer is difficult to be supplied from the development sleeve 232 to the photo conductive drum.

The enlarged outer surface is shown in FIGS. 46 and 47. Moreover, in the comparative example 3-3 showing the results in which Fourier analysis is given to the profile curve, in FIG. 49, because the concave and convex portions 239*a* are generally circular, the concave and convex portions have regularity. Therefore, it has been demonstrated in the comparative example 3-3 that variation was easy to occur in an image, and the variation was enough for practical use, but poor. It has also been demonstrated in the comparative example 3-3 that because the outer surface had the large and smooth concave and convex portions 239*a*, the reduction of the picked up amount of the developer 226 was little, very good and enough for practical use.

It was clear in the comparative example 3-1 that the relatively small concave and convex portions having wave lengths of about 0.01 mm to 0.1 mm were formed on the outer surface, as shown in FIG. 48. It was clear in the comparative example 3-3 that the relatively large concave and convex portions having wave lengths of about 0.1 mm to 1.0 mm were formed on the outer surface, as shown in FIG. 49. On the contrary, it was clear in the invention's product that the relatively small depressions having the wave lengths of about 0.01 mm to 0.1 mm and the relatively large depressions having the wave lengths of about 0.1 mm to 1.0 mm were evenly formed on the outer surface, as shown in FIG. 50. Accordingly, it was demonstrated in the invention's product that variation was difficult to occur in an image.

In this way, it was clear in the invention's product that the reduction of the picked up amount of the developer was little, excellent and enough for practical use, and the test image had no variation.

In the above-mentioned embodiments, the control device 776 controls the electro-magnetic coil 708 to gradually strengthen the rotational magnetic field generated by the electro-magnetic coil as the electro-magnetic coil goes to the opposite ends of the development sleeve 232. Alternatively, the control device 776 may control the electro-magnetic coil 708 to stepwise strengthen the rotational magnetic field generated by the electro-magnetic coil as the electro-magnetic coil goes to the opposite ends of the development sleeve 232 and to be stronger the rotational magnetic field to process the opposite ends of the development sleeve than that to process the central portion of the development sleeve or the rotational magnetic fields to be constant generally.

Also, in the present invention, a rotational magnetic field to process any portion of the development sleeve 232 may be set to be stronger than that of other portion of the development sleeve 232, without strengthening the rotational magnetic field to process the opposite ends of the development sleeve 232 than that to process the central portion of the development sleeve.

The position of the electro-magnetic coil 708 may be detected use of various sensors, without being limited to the linear encoder 775.

Furthermore, in the present invention, the control device 776 differentiates a position of the electro-magnetic coil 708 detected by the linear encoder 775 with respect to a time to obtain a movement speed of the electro-magnetic coil and may change the movement speed of the electro-magnetic coil 708 without changing the rotational magnetic field during the processing of the development sleeve 232.

In this case, the control device 776 is configured to store the movement speed of the electro-magnetic coil 708 depending on a relative position of the electro-magnetic coil 708 to the development sleeve 232, which is detected by the linear encoder 775. That is to say, the control device 776 controls the electro-magnetic coil moving portion 705 to store the movement speed of the electro-magnetic coil 708 depending on the relative position of the electro-magnetic coil 708 to the development sleeve 232. In addition, the control device 776 stores the movement speed of the electro-magnetic coil every a part number of the development sleeve 232.

The control device 776 is configured to previously store a pattern to slow gradually the movement speed of the electro-magnetic coil 708 by the electro-magnetic coil moving portion 705 as the electro-magnetic coil 708 goes from the central portion of the development sleeve 232 to the opposite ends thereof.

The control device 776 controls the electro-magnetic coil moving portion 705 to change the movement speed of the electro-magnetic coil 708 according to the previously stored pattern of the movement speed. In this way, the control device 776 controls the electro-magnetic moving portion 705 to change the movement speed of the electro-magnetic coil so that the movement speed of the electro-magnetic coil when processing the opposite ends of the development sleeve 232 is slower than that when processing the central portion of the development sleeve 232. As mentioned above, the control device 776 is configured to control the electro-magnetic coil moving portion 705 so as to change the movement speed of the electro-magnetic coil 708 based on the relative position of the lector-magnetic coil 708 to the development sleeve 232 or containing tank 709 detected by the linear encoder 775.

In this way, the above-mentioned inverter 749 may not be provided when the control device controls the electro-magnetic coil moving portion 705 to change the movement speed of the electro-magnetic coil 708.

When the control device controls the electro-magnetic coil moving portion 705 to change the movement speed of the electro-magnetic coil 708 and the electro-magnetic coil moves at a high speed, the number of hitting the wire members 765 to the development sleeve is reduced so that the outer surface of the development sleeve 232 has less roughness. On the other hand, when the electro-magnetic coil moves at a low speed, the number of hitting the wire members 765 to the development sleeve is increased so that the outer surface of the development sleeve 232 has large roughness. Thereby, the roughness of the outer surface of the development sleeve 232 in any position in the longitudinal direction thereof can be changed optionally.

Because the control device controls to change the movement speed of the electro-magnetic coil depending on the predetermined pattern, it is possible to form the roughness of the development sleeve 232 in a constantly certain pattern.

In addition, because the control device 776 controls to be slower the movement speed of the electro-magnetic coil when processing the opposite ends of the development sleeve than that when processing the central portion of the development sleeve, it is possible to be rougher the opposite ends having less picked up amount of the developer than the central portion having more picked up amount of the developer. Therefore, the picked up amount of the developer can be increased by roughening the opposite ends having less picked up amount of the developer, thereby it is possible to securely prevent the variation from generating in the image formed by the image forming apparatus 201 having the development sleeve 232. Thus, it is possible to provide the surface treatment on the outer surface of the development sleeve 232 securely to prevent the generation of the variation in the image.

Moreover, in the present invention, the control device 776 stepwise slows the movement speed of the electro-magnetic coil 708 as the electro-magnetic coil 708 goes to the opposite ends of the development sleeve 232 and may be set to be slower the movement speed of the electro-magnetic coil 708 when processing the opposite ends than that when processing the central portion of the development sleeve 232.

Moreover, in the present invention, a movement speed of the electro-magnetic coil when processing any portion of the development sleeve may be set to be faster than a movement speed of the electro-magnetic coil 708 when processing other portion of the development sleeve 232, without slowing the movement speed of the electro-magnetic coil 708 when processing the opposite ends of the development sleeve 232 than that when processing the central portion of the development sleeve 232.

Moreover, in the present invention, an outer diameter of the hollow holding member 732 positioning at the opposite ends of the development sleeve 232 in the longitudinal direction thereof and an outer diameter of the hollow holding member 732 positioning at the central portion of the development sleeve 232 in the longitudinal direction thereof may be set to be different. For example, the outer diameter of the hollow holding member 732 positioning at the opposite ends of the development sleeve 232 in the longitudinal direction thereof may be set to be larger than that of the hollow holding member 732 positioning at the central portion of the development sleeve 232 in the longitudinal direction thereof.

In this case, the rotational magnetic field at the opposite ends of the development sleeve 232 is stronger than that at the central portion of the development sleeve 232. The picked up amount of the developer 232 can be increased by roughening the opposite ends having less picked up amount of the developer and the generation of the variation in the image formed by the image forming apparatus 201 including the development sleeve 232 can be prevented. Therefore, it is possible to provide the roughing treatment on the outer surface of the development sleeve securely.

Furthermore, in the present invention, the outer diameter of the hollow holding member 732 to hold the opposite ends of the development sleeve 232 is different from that of the hollow holding member 732 to hold the central portion of the development sleeve 232, as mentioned above. That is to say, the outer diameter of the hollow holding member 732 to hold the opposite ends of the development sleeve 232 may be set to be lesser than that of the hollow holding member 732 to hold the central portion of the development sleeve 232. With such a structure, it is possible to securely provide the roughing treatment on the outer surface of the development 232 to prevent the generation of the variation in the image.

In the above-mentioned embodiments, the partition members 755 are provided. However, the partition members 755 may not be provided if the wire members 765 are removed out of the rotational magnetic field by the movement of the electro-magnetic coil 708 without the wire members being absorbed to the rotational magnetic field due to a mass of the wire member and a strength of the rotational magnetic field generated by the electro-magnetic field 708. In addition, in the present invention, the sealing plate 756 may be provided on at least one end of the cylindrical member 750 of the containing tank 709. Moreover, in the present invention, a roughing treatment of an outer surface of each of development sleeves having various shapes such as a plated shape or the like can be executed.

Next, a fourth embodiment of the present invention is explained.

The outer surface of the development sleeve 232 in the fourth embodiment is roughened by the surface treatment device shown in FIG. 31 so that fine depressions 239 are formed, as shown in FIG. 17. In other words, the outer surface of the development sleeve 232 in this embodiment has the depressions significantly smoother than the concave and convex portions 239*a* (see FIG. 16) formed by the conventional sand blast to form raised portions of the developer thicker and shorter (a projected amount of each of the raised portions from the outer surface is small and an area of each of the raised portions is large) than that in the conventional concave and convex portions 239*a* as shown in FIG. 16. With such a structure, in the development sleeve 232 in this embodiment, the area of the developer as viewed from an outer periphery of the development sleeve is difficult to reduce.

Furthermore, an outer diameter of the development sleeve 232 is preferably within a range of 17 mm to 18 mm. A length of the development sleeve 232 in a direction of the axis P (shown by dashed line in FIG. 9) of the development sleeve 232 is preferably within a range of 300 mm to 350 mm. The roughness of the outer surface of the development sleeve 232 is set to be gradually large or rough as going from the central portion to the opposite ends of the development sleeve 232 in the longitudinal direction thereof.

The surface treatment device 701 is configured to provide the roughing treatment on the outer surface of the development sleeve 232 as a work.

Each of the wire members 765 is made of a magnetic material and has a columnar shape. Here, in the illustrated embodiment, the wire member 765 has an outer diameter of a range of 0.5 mm to 1.4 mm and a length of a range of 3.0 mm to 14.0 mm.

In this embodiment, the roughness on the outer surfaces at the opposite ends of the development sleeve and the roughness on the central portion of the development sleeve are different each other. Therefore, it is possible to adjust the roughness of the outer surface of the development sleeve 232 to uniform the picked up amount of the developer along the longitudinal direction of the development sleeve 232.

In this way, the picked up amount of the developer at any position of the development sleeve 232 can be increased or reduced. Therefore, it is possible to increase the picked up amount of the developer at a position having less picked up amount of the developer by roughening the outer surface of the development sleeve at the position having less picked up amount of the developer to prevent the variation from occurring in the image formed by the image forming apparatus including the development sleeve 232. Accordingly, it is possible to provide the roughing treatment on the outer surface of the development sleeve 232 to prevent the generation of the variation in the image.

Moreover, because each of the outer surfaces of the opposite ends having the less picked up amount of the developer roughens, the picked up amount of the developer of the opposite ends can be increased. Consequently, it is possible to prevent the generation of the variation in the image formed by the image forming apparatus 201 including the development sleeve 232.

Furthermore, because the roughness of the outer surface of the development sleeve 232 gradually varies axially of the development sleeve 232, the picked up amount of the developer along the longitudinal direction of the development sleeve does not rapidly vary. Therefore, the generation of the variation in the image formed by the image forming apparatus 201 including the development sleeve 232 can be prevented.

The significantly larger wire member 765 than each of the particles used for the sand blast is hit to the outer surface of the development sleeve 232 to provide the roughing treatment on the outer surface of the development sleeve 232. That is to say, in this embodiment, the uniform and smooth depressions 239 are formed by hitting the above-mentioned wire members on the outer surface as shown in FIG. 17, compared to the concave and convex portions 239*a* formed by the sand blast which is conventionally used, as shown in FIG. 16.

In the concave and convex portions 239*a* formed on the conventional development sleeve 105 by the sand blast as shown in FIG. 16, because an interval between the adjacent concave and convex portions 239*a* is narrow, the magnetic carrier 435 is placed in a state riding on the fine concave and convex portions 239*a*. Therefore, the magnetic carrier 235 easily slips on the concave and convex portions 239*a*, one raise portion or ear of the developer has a magnetic moment formed by a magnetic field of the magnet roller and the ears having the magnetic moment in the same direction are disposed adjacently each other. Therefore, the ears are reactive to separate from each other. Consequently, in the concave and convex portions 239*a* formed by the sand blast as shown in FIG. 16, the magnetic carrier 235 or developer 226*a* is configured to raise thinly and lengthwise (each raised portion extends thinly on the outer periphery of the development sleeve 105 and has a long projected amount from the development sleeve 105).

Therefore, in the development sleeve 105 as shown in FIG. 16, when an amount of the picked up developer 226*a* from a sate shown by solid line to a state shown by two-dot chain line is reduced, a width or area of the raised developer 226*a* as viewed from the outer periphery of the development sleeve 105 becomes significantly less so that raised shapes shown by the solid and two-dot chain lines are similar to each other.

On the contrary, because an interval between the adjacent depressions formed by hitting the wire members 765 on the outer surface of the development sleeve as shown in this embodiment is significantly larger than the intervals between the adjacent concave and convex portions as shown in FIG. 16, the depressions 239 in this embodiment are significantly smoother than the concave and convex portions 239*a* shown in FIG. 16. Accordingly, in this embodiment, a raised portion or ear on one depression which is as a root. In other words, the raised portion is formed on the one depression.

Consequently, in this embodiment, the magnetic carrier 235 or developer 226 is configured to rise thickly and shortly (each raised portion extends thickly on the outer periphery of the development sleeve 232 and has a short projected amount from the development sleeve 232). Therefore, in the development sleeve 232 in this embodiment as shown in FIG. 17, even if an amount of the picked up developer 226 from a sate shown by solid line to a state shown by two-dot chain line is reduced and raised shapes shown by the solid and two-dot chain lines are similar to each other, a width or area of the raised developer 226 as viewed from the outer periphery of the development sleeve 105 is little.

Therefore, in the development device 213 in this embodiment, even if the depressions 239 on the outer surface of the development sleeve 232 wear due to secular variation and the picked up amount of the developer is reduced, the reduced amount of an area of the developer absorbed on the outer surface as viewed from the outer periphery of the development sleeve 232 can be limited. As a result, the variation in the image due to the secular variation is not generated, thereby enabling obtaining a high-quality image throughout a long period.

Because the development sleeve 232 and the wire members 765 are contained in the containing tank 709, the wire members can securely be hit to the outer surface of the development sleeve 232 to enable providing the roughing treatment on the outer surface of the development sleeve securely.

Because the rotational magnetic field when processing the opposite ends of the development sleeve is stronger than that when processing the central portion of the development sleeve, the opposite ends having the less picked up amount of the developer is set to be rougher than the central portion having the more picked up amount of the developer. Therefore, the picked up amount of the developer at the opposite ends can be increased by roughening the opposite ends having the less picked up amount of the developer, enabling preventing the generation of the variation in the image formed by the image forming apparatus 701 including the development sleeve 232.

Furthermore, because the development device 213 has the development roller 215, the variation in the image can securely be prevented from occurring.

In addition, because each of the process cartridges 206Y, 206M, 206C, and 206K and the image forming apparatus 201 has the development device 213, the variation in the image can securely be prevented from occurring.

In the above-mentioned embodiments, the control device 776 strengthens gradually the rotational magnetic field generated by the electro-magnetic coil 708 as going to the opposite ends of the development sleeve 232 and is configured to provide the roughing treatment on the outer surface of the development sleeve 232. However, in the present invention, the control device 776 strengthens stepwise the rotational magnetic field generated by the electro-magnetic coil 708 as going to the opposite ends of the development sleeve 232 and the rotational magnetic field when processing the opposite ends of the development sleeve may be set to be stronger than that when processing the central portion of the development sleeve 232.

In addition, in the present invention, a rotational magnetic field when processing any portion of the development sleeve 232 may be set to be stronger than that when processing other portion of the development sleeve, without being stronger the rotational magnetic field when processing the opposite ends of the development sleeve than that when processing the central portion of the development sleeve. In conclusion, the roughness of the outer surface of the development sleeve 232 may be changed along the longitudinal direction of the development sleeve.

Figure 51:
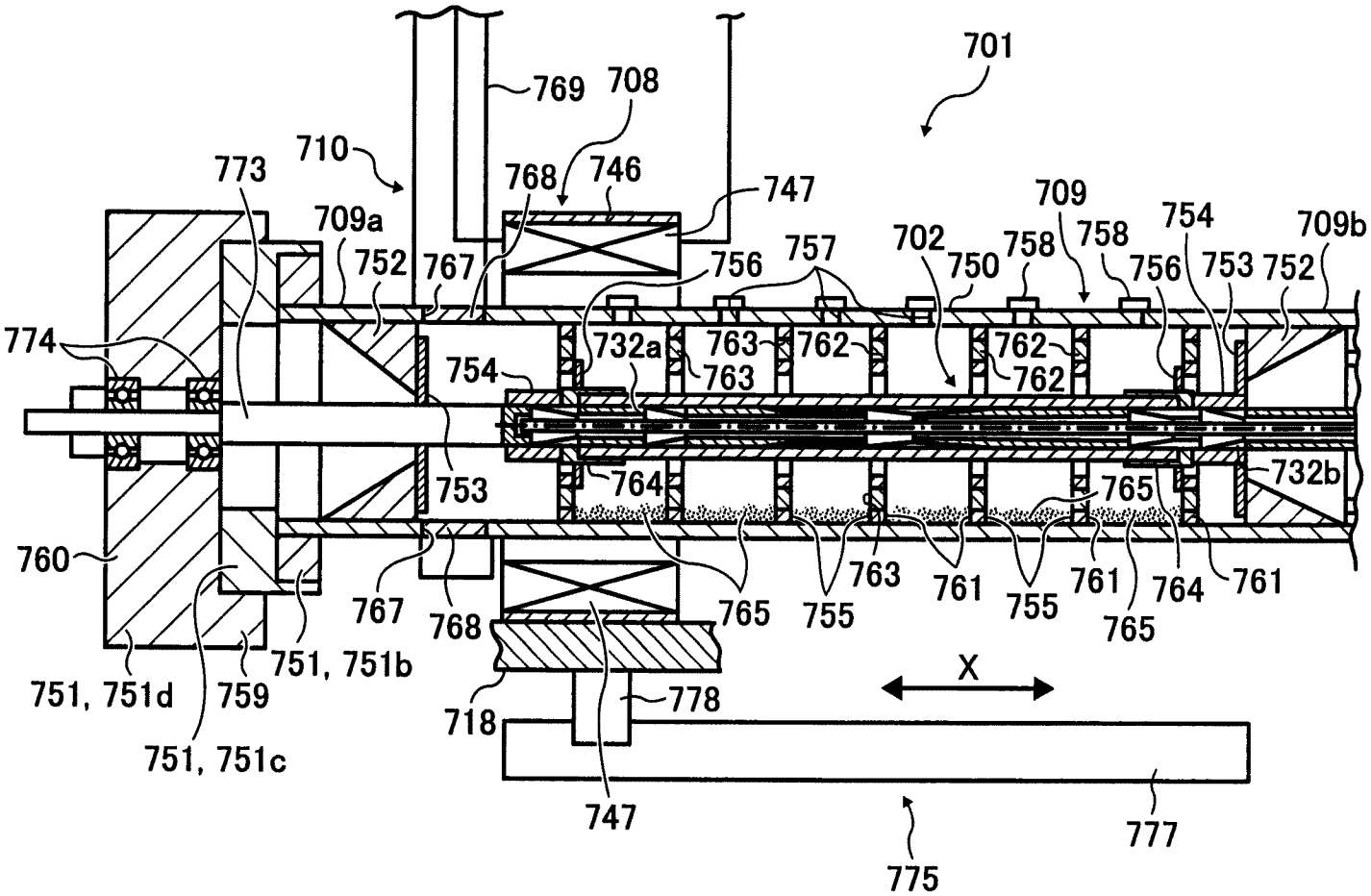
FIG. 51 is a sectional view showing a modification of the surface treatment device as shown in FIG. 31.

Meanwhile, in the case shown in FIG. 51, it is preferably to uniform the movement speed of the electro-magnetic coil 708 and an electric power applied to the electro-magnetic coil 708. In addition, in the case shown in FIG. 51, the electro-magnetic coil 708 my be set to have the generally same length as that of the containing tank 709 so that the electro-magnetic coil 708 is not moved relative to the containing tank 709.

Next, a fifth embodiment of the present invention is explained.

An image forming apparatus 701 in the fifth embodiment is configured to provide roughing treatment on an outer surface of a cylindrical supplying member as shown in FIG. 32, for example, the development sleeve 232 (shown in FIG. 11) of the development roller 215 used for an image forming apparatus such as a copying machine, facsimile, printer or the like and manufacture the development sleeve 232. An outer diameter of the development sleeve 232 is preferably a range of about 17 mm to 18 mm. A length of the development sleeve 232 along an axis P (as shown by chain line in FIG. 32) is preferably a range of about 300 mm to 350 mm. A roughness of the outer surface of the development sleeve 232 is set to be large gradually as going from a central portion of the development sleeve in an axial direction thereof to opposite ends of the development sleeve 232 in the axial direction. In this embodiment, each of wire members 265 used for the roughing treatment of the outer surface has a column-like shape and an outer diameter of about 0.5 mm to 1.4 mm and an entire length of about 3.0 mm to 14.0 mm.

In this embodiment, partition members 755 are provided. However, similarly to the previously mentioned embodiments, the partition members 755 may not be provided if the wire members 765 are removed out of the rotational magnetic field by the movement of the electro-magnetic coil 708 without the wire members being absorbed to the rotational magnetic field due to a mass of the wire member and a strength of the rotational magnetic field generated by the electro-magnetic field 708. Furthermore, in this embodiment, the sealing plate 756 may be provided on at least one end of the cylindrical member 750 of the containing tank 709. Also, in this embodiment, a roughing treatment of an outer surface of a supplying member having various shapes, for example, a plate-like shape, other than the cylindrical shape can be executed.

Moreover, in this embodiment, the strength of the rotational magnetic field, the movement speed of the electro-magnetic coil 708 and the outer diameter of the hollow holding member 732 are changed to adequately change the roughness of the outer surface of the development sleeve 232. However, the strength of the rotational magnetic field, the movement speed of the electro-magnetic coil 708 and the outer diameter of the hollow holding member 732 may be changed to uniform the roughness of the outer surface of the development sleeve 232 along the longitudinal direction of the development sleeve.

Next, a sixth embodiment of the present invention is explained.

Each of the wire members 765 in the sixth embodiment comprises a column-like single wire 765*b* (see FIG. 33) made of a magnetic material such as stainless steel of austenite system or martensite system or the like. The wire member 765 has an outer diameter of 0.5 mm or more and 1.2 mm or less. If an entire length of the wire member is L and an outer diameter of the wire member is D, the wire member 765 has a ration L/D of 4 or more and 10 or less.

In addition, a circular-arc chamfering process in section is provided on an outer peripheral edge portion 765*a* of each of opposite ends of the wire member 765, as shown in FIGS. 33 and 34. A curvature radius R of the outer peripheral edge portion 765*a* is a range of 0.05 mm or more and 0.2 mm or less. The wire member 765 as mentioned above is rotated about a central portion in a longitudinal direction thereof by the rotational magnetic field and orbited about the development sleeve 232 in a peripheral direction thereof in the containing tank 709, as shown in FIG. 35. Here, a light and left direction in FIGS. 29 and 30 corresponds to an axial direction of the development sleeve 232.

In this embodiment, because the wire member 765 has the column-like shape and is significant larger than a sand particle used for the sand blast or the like, when it hits to the outer surface of the development sleeve 232, a depression significantly smoother than that formed by the sand particle is formed on the outer surface of the development sleeve 232. Therefore, the depressions formed on the outer surface of the development sleeve 232 are easily not worn even if a long period elapses, and hence the picked up amount of the developer is difficult to be reduced.

Because the wire members 765 are hit to the outer surface of the development sleeve 232 randomly, the axis, the inner and outer diameters and the sectional shape of the development sleeve 232 can be prevented from being curved, changed and formed in an elliptical shape, respectively. That is to say, the development sleeve 232 is prevented from being wobbled and maintained to a high accuracy. Furthermore, the randomly disposed depressions are formed on the outer surface of the development sleeve 232. Therefore, it is possible to prevent the generation of variation in an amount of the developer 226 supplied to the photo conductive drum 108, and hence to prevent density variation in a formed image from occurring.

Because the outer diameter D of the wire member 765 is 0.5 mm or more and 1.2 mm or less, the depressions formed on the outer surface of the development sleeve 232 are difficult to wear throughout a long period, the development sleeve 232 can be prevented from the lowering of the picked up amount of the developer due to secular variation. Accordingly, it is possible to prevent an image from thinning.

Consequently, it is possible to block the reduction of a conveyed amount of the developer 226 by the secular variation of the development sleeve 232 and provide the wire members 765 and the surface treatment device 701 which are capable of giving the roughing treatment to the outer surface of the development sleeve to prevent the generation of the variation in the image.

Because the ratio L/D of the entire length L and the outer diameter D of the wire member 765 is 4 or more and 10 or less, the outer peripheral edge portions 765*a* of the opposite ends of the wire member in the longitudinal direction are hit to the development sleeve 232 secularly, and the entire length of the wire member is sufficient to form the depression having a sufficient deep to contain the developer therein, on the outer surface of the development sleeve. Therefore, it is possible to secularly form the depressions capable of containing the developer of a sufficient amount on the outer surface of the development sleeve 232.

A circular-arc chamfering process in section is provided on the outer peripheral edge portion 765*a* of each of the opposite ends of the wire member 765 in the longitudinal direction. Therefore, the smooth depressions can be formed on the outer surface of the development sleeve, and hence the developer 226 or magnetic carrier 235 on the development sleeve 232 can be presented from the secular variation.

Because the curvature radius R of each of the outer peripheral edge portions 765*a* of the wire member 765 is a range of 0.05 mm or more and 0.2 mm or less, the smooth depressions can be formed on the outer surface of the development sleeve 232.

Because each of the wire members 765 is made of a magnetic material such as stainless steel of austenite system or martensite system or the like, the wire member is easily available and inexpensive.

In addition, because the wire members 765 are disposed in the rotational magnetic field and hit to the outer surface of the development sleeve 232, the wire members are increasingly randomly hit to the outer surface of the development sleeve. Accordingly, more uniform depressions can be formed on the outer surface of the development sleeve 232 to obtain a more uniform image.

Moreover, because the wire members are disposed in the rotational magnetic field and hit to the outer surface of the development sleeve 232 to form the depressions on the outer surface, a process necessary to form the depressions on the outer surface of the development sleeve can be prevented from increasing. Therefore, the process to form the depressions on the outer surface of the development sleeve is simplified and inexpensive.

Furthermore, because the wire member 765 can be disposed in the rotational magnetic field to form the depressions on the outer surface of the development sleeve, the wire member is rotated about the central portion of the wire member 765 in the longitudinal direction and orbited about the outer periphery of the development sleeve 232 in the state where the longitudinal direction of the wire member 765 is disposed along a diametrical direction of the rotational magnetic field. Therefore, the outer peripheral edge portions 765*a* of the opposite ends of the wire member 765 are hit to the outer surface of the development sleeve to form the depressions on the outer surface. At this time, concave portions of the depressions formed on the outer surface along the longitudinal direction thereof are much in number than that of the depressions formed on the outer surface along the peripheral direction thereof. Therefore, the depressions formed on the outer surface of the development sleeve have the same advantageous effects as that of the conventional V-shaped grooves, and further the sufficient picked up amount of the developer can be maintained.

Because the wire members are randomly hit to the outer surface of the development sleeve 232 by the rotational magnetic field, the randomly arranged depressions can be securely formed on the outer surface of the development sleeve 232. Consequently, it is possible to present the variation in the image from occurring.

In addition, because the wire members 765 together with the development sleeve 232 are contained in the containing tank 709, the wire members can be securely hit to the outer surface of the development sleeve 232. Accordingly, the roughing treatment can be provided on the outer surface of the development sleeve 232 securely.

Because the wire members 765 structured as mentioned above are used, it is possible to provide the wire members 765 and the surface treatment device 701 which are capable of giving the roughing treatment to the outer surface of the development sleeve so that the reduction of the conveyed amount of the developer 226 due to secular variation can be limited and the variation in the image can be avoided.

Although the preferred embodiments of the present invention have been mentioned, the present invention is not limited to these embodiments, various modifications and changes can be made to the embodiments.

What is claimed is:

1. A method for manufacturing a development roller, comprising:

arranging a plurality of wire members at a circumference of a development sleeve to treat an outer surface of the development sleeve; and rotating the plurality of wire members around an axis of the development sleeve to randomly hit the outer surface of the development sleeve to form, evenly on the outer surface of the development sleeve, small depressions and large depressions which have different wave lengths.

2. A method for manufacturing a development roller according to claim 1, wherein each of the wire members comprises a circular post-like short wire member.

3. A method for manufacturing a development roller according to claim 1, wherein each of the wire members has an outer diameter that is within a range of 0.5 mm to 1.2 mm.

4. A method for manufacturing a development roller according to claim 1, wherein the wire member has an entire length L and an outer diameter D, and L/D is set to be 4 to 10.

5. A method for manufacturing a development roller according to claim 1, wherein the wire member is made of a magnetic material.

6. A method for manufacturing a development roller according to claim 1, wherein the wire member has a volume which is within a range of 1.0 $mm^3$ to 6.0 $mm^3$.

7. A method for manufacturing a development roller according to claim 1, wherein the wire member is on an inner surface of a containing tank that is circumferentially arranged around the development sleeve.

8. A method for manufacturing a development roller according to claim 7, wherein the wire member is rotated around the axis of the development sleeve by an electromagnetic coil that is circumferentially arranged around the containing tank.

9. A method for manufacturing a development roller according to claim 8, wherein a magnetic field of the electromagnetic coil causes the wire member to randomly hit the development sleeve.

* * * * *